US007740076B2

(12) United States Patent
Costa et al.

(10) Patent No.: US 7,740,076 B2
(45) Date of Patent: Jun. 22, 2010

(54) PROTECTIVE SLEEVE FOR THREADED CONNECTIONS FOR EXPANDABLE LINER HANGER

(75) Inventors: Scott Costa, Kingwood, TX (US); Joel Hockaday, Tomball, TX (US); Kevin K. Waddell, Houston, TX (US); Lev Ring, Houston, TX (US); Michael Bullock, Houston, TX (US); Robert Lance Cook, Katy, TX (US); Larry Kendziora, Needville, TX (US); David Paul Brisco, Duncan, OK (US); Tance Jackson, Plano, TX (US)

(73) Assignee: Enventure Global Technology, L.L.C., Houston, TX (US)

( * ) Notice: Subject to any disclaimer, the term of this patent is extended or adjusted under 35 U.S.C. 154(b) by 1189 days.

(21) Appl. No.: 10/510,966

(22) PCT Filed: Mar. 4, 2003

(86) PCT No.: PCT/US03/06544

§ 371 (c)(1),
(2), (4) Date: Aug. 29, 2005

(87) PCT Pub. No.: WO03/086675

PCT Pub. Date: Oct. 23, 2003

(65) Prior Publication Data

US 2006/0090902 A1 May 4, 2006

Related U.S. Application Data

(60) Provisional application No. 60/372,048, filed on Apr. 12, 2002.

(51) Int. Cl.
*E21B 17/02* (2006.01)

(52) U.S. Cl. ..... 166/380; 166/207; 166/242.6

(58) Field of Classification Search ..... 166/380, 166/206, 207, 242.6
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |

(Continued)

FOREIGN PATENT DOCUMENTS

| | | |
|---|---|---|
| AU | 767364 | 2/2004 |

(Continued)

OTHER PUBLICATIONS

Letter From Baker Oil Tools to William Norvell in Regards to Enventure's Claims of Baker Infringement of Enventure's Expandable Patents Apr. 1, 2005.

(Continued)

*Primary Examiner*—Shane Bomar
(74) *Attorney, Agent, or Firm*—Conley Rose, P.C.

(57) ABSTRACT

A tubular sleeve is coupled to and overlaps the threaded connection between a pair of adjacent tubular members.

102 Claims, 60 Drawing Sheets

U.S. PATENT DOCUMENTS

| | | | |
|---|---|---|---|
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,474,905 | A | 11/1923 | Keszthelyi |
| 1,494,128 | A | 5/1924 | Primrose |
| 1,507,138 | A | 9/1924 | Pierce |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,447,629 | A | 8/1948 | Beissinger et al. |
| 2,482,962 | A | 9/1949 | Boice |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al |
| 2,664,952 | A | 1/1954 | Losey |
| 2,691,418 | A | 10/1954 | Connolly |
| 2,723,721 | A | 11/1955 | Corsette |
| 2,734,580 | A | 2/1956 | Layne |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Hearn |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,572,777 | A | 3/1971 | Blose et al. |
| 3,574,357 | A | 4/1971 | Alexandru et al. |
| 3,578,081 | A | 5/1971 | Bodine |
| 3,579,805 | A | 5/1971 | Kast |
| 3,581,817 | A | 6/1971 | Kammerer, Jr. |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,826,124 | A | 7/1974 | Baksay |
| 3,830,294 | A | 8/1974 | Swanson |
| 3,830,295 | A | 8/1974 | Crowe |
| 3,834,742 | A | 9/1974 | McPhillips |
| 3,848,668 | A | 11/1974 | Sizer et al. |
| 3,866,954 | A | 2/1975 | Slator et al. |
| 3,874,446 | A | 4/1975 | Crowe |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,915,763 | A | 10/1975 | Jennings et al. |
| 3,935,910 | A | 2/1976 | Gaudy et al. |
| 3,942,824 | A | 3/1976 | Sable |
| 3,945,444 | A | 3/1976 | Knudson |

3,948,321 A 4/1976 Owen et al.
3,963,076 A 6/1976 Winslow
3,970,336 A 7/1976 O'Sickey et al.
3,977,473 A 8/1976 Page, Jr.
3,989,280 A 11/1976 Schwarz
3,997,193 A 12/1976 Tsuda et al.
3,999,605 A 12/1976 Braddick
4,011,652 A 3/1977 Black
4,018,634 A 4/1977 Fenci
4,019,579 A 4/1977 Thuse
4,026,583 A 5/1977 Gottlieb
4,053,247 A 10/1977 Marsh, Jr.
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchison et al.
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A * 1/1983 Lula ..... 285/55
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,411,456 A 10/1983 Martin
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,629,218 A 12/1986 Dubois
4,629,224 A 12/1986 Lanriault
4,630,849 A 12/1986 Fukui et al.
4,632,944 A 12/1986 Thompson
4,634,317 A 1/1987 Skogberg et al.
4,635,333 A 1/1987 Finch
4,635,972 A 1/1987 Lyall
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres et al.
4,754,781 A 7/1988 Putter
4,754,807 A * 7/1988 Lange ..... 166/236
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret 4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,079,837 A 1/1992 Vanselow
5,080,406 A 1/1992 Hyatt
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,249,628 A 10/1993 Surjaatmadja
5,253,713 A 10/1993 Gregg et al.
RE34,467 E 12/1993 Reeves
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink 5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,284 A * 5/1998 Hart et al. ..... 166/241.4
5,755,895 A 5/1998 Tamehiro et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,196,336 B1 3/2001 Fincher et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,966 B1 7/2001 Haut et al.
6,263,968 B1 * 7/2001 Freeman et al. ..... 166/313
6,263,972 B1 7/2001 Richard et al.
6,267,181 B1 7/2001 Rhein-Knudsen et al.
6,273,634 B1 * 8/2001 Lohbeck ..... 403/297
6,275,556 B1 8/2001 Kinney et al.
6,283,211 B1 9/2001 Vloedman
6,286,558 B1 9/2001 Quigley et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,354,734 B1 * 3/2002 Curran et al. ..... 374/148
6,390,720 B1 5/2002 LeBegue et al.

6,405,761 B1 6/2002 Shimizu et al.
6,406,063 B1 6/2002 Pfeiffer
6,409,175 B1 * 6/2002 Evans et al. ..... 277/314
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,554,287 B1 4/2003 Sivley
6,557,640 B1 * 5/2003 Cook et al. ..... 166/380
6,557,906 B1 5/2003 Carcagno
6,561,227 B2 5/2003 Cook et al.
6,561,279 B2 5/2003 MacKenzie et al.
6,564,875 B1 * 5/2003 Bullock ..... 166/382
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson et al.
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 * 4/2004 Metcalfe ..... 166/384
6,724,687 B1 * 4/2004 Stephenson et al. ..... 367/32
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrak
6,935,430 B2 8/2005 Harrell et al.
6,966,370 B2 11/2005 Cook et al.
6,976,539 B2 12/2005 Metcalfe et al.
6,976,541 B2 12/2005 Brisco et al.
7,000,953 B2 2/2006 Berghaus
7,007,760 B2 3/2006 Lohbeck
7,021,390 B2 4/2006 Cook et al.
7,036,582 B2 5/2006 Cook et al.
7,077,211 B2 7/2006 Cook et al.
7,077,213 B2 7/2006 Cook et al.
7,086,475 B2 8/2006 Cook
7,086,669 B2 * 8/2006 Evans et al. ..... 285/382.2
7,100,685 B2 9/2006 Cook et al.
7,121,337 B2 10/2006 Cook et al.
7,121,352 B2 10/2006 Cook et al.
7,140,446 B2 * 11/2006 Metcalfe ..... 166/380
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen 2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley, IV
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0090068 A1 5/2004 Evans
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Ring et al.
2005/0056434 A1 3/2005 Watson et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0172473 A1 8/2005 Cook et al.
2005/0173108 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230123 A1 10/2005 Waddell et al.
2005/0236159 A1 10/2005 Costa et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0027371 A1 2/2006 Gorrara
2006/0032640 A1 2/2006 Costa et al.
2006/0048948 A1 3/2006 Noel
2006/0054330 A1 3/2006 Ring et al.
2006/0065403 A1 3/2006 Watson et al.
2006/0065406 A1 3/2006 Shuster et al.
2006/0096762 A1 5/2006 Brisco
2006/0102360 A1 5/2006 Brisco et al.
2006/0112768 A1 6/2006 Shuster et al.
2006/0113086 A1 6/2006 Costa et al.

FOREIGN PATENT DOCUMENTS

AU 773168 5/2004
AU 770008 7/2004
AU 770359 7/2004
AU 771884 8/2004
AU 776580 1/2005
AU 780123 3/2005
AU 2001269810 8/2005
AU 782901 9/2005
AU 783245 10/2005
AU 2001294802 10/2005
AU 2001283026 7/2006
AU 2002239857 8/2006
CA 736288 6/1966
CA 771462 11/1967
CA 1171310 7/1984
CA 2292171 6/2000
CA 2298139 8/2000
CA 2234386 3/2003
CA 2414449 9/2006
DE 174521 4/1953
DE 2458188 6/1975
DE 203767 11/1983
DE 233607 A1 3/1986
DE 278517 A1 5/1990
EP 0084940 A1 8/1983
EP 0272511 12/1987

| | | | |
|---|---|---|---|
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1106778 | B1 | 3/2003 |
| EP | 1555386 | A1 | 7/2005 |
| FR | 1325596 | | 6/1962 |
| FR | 2717855 | A1 | 9/1995 |
| FR | 2741907 | A1 | 6/1997 |
| FR | 2771133 | A | 6/1997 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396639 | A | 6/2004 |

| | | | |
|---|---|---|---|
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404402 | A | 2/2005 |
| GB | 2404676 | A | 2/2005 |
| GB | 2404680 | A | 2/2005 |
| GB | 2384807 | C | 3/2005 |
| GB | 2388134 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2 403970 | B | 8/2005 |
| GB | 2398326 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |

| | | | |
|---|---|---|---|
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2421257 | B | 8/2006 |
| GB | 2421258 | B | 8/2006 |
| GB | 2422859 | A | 8/2006 |
| GB | 2422860 | A | 8/2006 |
| GB | 2423317 | | 8/2006 |
| GB | 2414493 | B | 9/2006 |
| GB | 2424077 | A | 9/2006 |
| GB | 2408277 | A | 5/2008 |
| ID | P01.012.197/2005 | | 1/2005 |
| ID | 09.044.392/2005 | | 9/2005 |
| ID | 09.046.2804/2006 | | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |

| | | | |
|---|---|---|---|
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A3 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024141 | A3 | 3/2005 |

| | | | |
|---|---|---|---|
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020810 | A3 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2004/089608 | A3 | 7/2006 |
| WO | WO2006/079072 | A2 | 7/2006 |
| WO | WO2006/088743 | A2 | 8/2006 |
| WO | WO2006/102171 | A2 | 9/2006 |
| WO | WO2006/102556 | A2 | 9/2006 |

OTHER PUBLICATIONS

International Examination Report, Application PCT/US02/39418, Feb. 18, 2005.
International Examination Report, Application PCT/US03/04837, Dec. 9, 2004.
International Examination Report, Application PCT/US03/11765; Dec. 10, 2004.
International Examination Report, Application PCT/US03/11765;; Jan. 25, 2005.
International Examination Report, Application PCT/US03/13787; Apr. 7, 2005.
International Examination Report, Application PCT/US03/13787; Mar. 2, 2005.
International Search Report, Application PCT/US03/25716; Jan 13, 2005.
International Search Report, Application PCT/US03/25742; Dec. 20, 2004.
International Examination Report, Application PCT/US03/29460; Dec. 8, 2004.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
Search Report to Application No. EP 02806451.7; Feb. 9, 2005.
Examination Report to Application No. GB 0225505.7 Feb. 15, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Search and Examination Report to Application No. GB 0411892.3, Jul. 14, 2004.
Examination Report to Application No. GB 0411892.3, Feb. 21, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Nov. 16, 2004.
Examination Report to Application No. GB 0422419.2 Dec. 8, 2004.
Search and Examination Report to Application No. GB 0422893.8 Nov. 24, 2004.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Search and Examination Report to Application No. GB 0503470.7 Mar. 21, 2005.
Written Opinion to Application No. PCT/US02/25608 Feb. 2, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
Adams, "Drilling Engineering: A Complete Well Planning Approach," 1985.
Enventure Global Technology, "Set Technology: The Facts," 2004.
Flatern, "Oilfield Service Trio Target Jules Verne Territory," at http://www.oilonline.com.
Harris, "Tube Welding." At http://www.tubenet.org.uk.technical.ewi.html.
Mohawk Energy, :Minimizing Drilling Ecoprints Houston, Dec. 16, 2005.
www.RIGZONE.com/news/article.asp?a_id=1755, "Tesco Provides Casing Drilling Operations Update," 2001.
www.RIGZONE.com/news/article.asp?a_id=2603, Conoco and Tesco Unveil Revolutionary Drilling Rig 2002.
International Search Report, Application PCT/US03/15020, Nov. 14, 2005.
International Preliminary Examination Report, Application PCT/US01/28690, Sep. 4, 2003.
International Preliminary Examination Report, Application PCT/US02/39425, Nov. 16, 2005.

International Preliminary Examination Report, Application PCT/US03/15020 (corrected), Nov. 14, 2004.
International Preliminary Report on Patentability, Application PCT/US04/00631, Mar. 2, 2006.
International Preliminary Report on Patentability, Application PCT/US04/04740, Jun. 27, 2006.
International Preliminary Report on Patentability, Application PCT/US04/10317, Jun. 23, 2006.
International Preliminary Report on Patentability, Application PCT/US04/028423, Mar. 9, 2006.
International Preliminary Report on Patentability, Application PCT/US04/028423, Jun. 19, 2006.
International Preliminary Report on Patentability, Application PCT/US04/28889, Aug. 1, 2006.
Combined Search Report and Written Opinion to Application No. PCT/US04/00631, Mar. 28, 2005.
Combined Search Report and Written Opinion to Application No. PCT/US04/10317, May 25, 2006.
Combined Search Report and Written Opinion to Application No. PCT/US04/28831, Dec. 19, 2005.
Combined Search Report and Written Opinion to Application No. PCT/US04/28889, Nov. 14, 2005.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819, Aug. 3, 2006.
Combined Search Report and Written Opinion to Application No. PCT/US05/28869, Apr. 17, 2006.
Combined Search Report and Written Opinion to Application No. PCT/US06/04809, Aug. 29, 2006.
Search Report to Application No. GB 0507980.1, Apr. 24, 2006.
Examination Report to Application No. GB 0219757.2, Oct. 31, 2004.
Examination Report to Application No. GB 03723674.2, Feb. 6, 2006.
Examination Report to Application No. GB 0400019.6, Nov. 4, 2005.
Examination Report to Application No. GB 0406257.6, Sep. 2,2005.
Examination Report to Application No. GB 0406257.6, Nov. 9, 2005.
Examination Report to Application No. GB 0406257.6, Apr. 28, 2006.
Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15. 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6, Feb. 21, 2006.
Examination Report to Application No. GB 05428141.6, Jul. 18, 2006.
Examination Report to Application No. GB 0500275.3, Apr. 5, 2006.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0503250.3, Aug. 11, 2006.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0507979.3, Jun. 16, 2005.
Examination Report to Application No. GB 0507979.3, Jan. 17, 2006.
Examination Report to Application No. GB 0507979.3, Jun. 6, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0517448.7, Jul. 19, 2006.
Examination Report to Application No. GB 0518025.2, Oct. 27, 2005.
Examination Report to Application No. GB 0518025.2, May 25, 2006.
Examination Report to Application No. GB 0518039.3, Nov. 29, 2005.
Examination Report to Application No. GB 0518039.3, Aug. 2, 2006.
Examination Report to Application No. GB 0518252.2, Oct. 28, 2005.
Examination Report to Application No. GB 0518252.2, May 25, 2006.
Examination Report to Application No. GB 0518799.2, Nov. 9, 2005.
Examination Report to Application No. GB 0518799.2, Jun. 14, 2006.
Examination Report to Application No. GB 0518893.3, Dec. 16, 2005.
Examination Report to Application No. GB 0518893.3, Jul. 28, 2006.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0522892.9, Aug. 14, 2006.
Examination Report to Application No. GB 0602877.3, Mar. 20, 2006.
Examination Report to Application No. GB 0603576.0, Apr. 5, 2006.
Examination Report to Application No. GB 0603656.0, May 3, 2006.
Examination Report to Application No. GB 0603995.2, Apr. 25, 2006.
Examination Report to Application No. GB 0603996.0, Apr. 27, 2006
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0412876.5, Sep. 27, 2005.
Search and Examination Report to Application No. GB 0507980.1, Jun. 20, 2006.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522052.0, Aug. 8, 2006.
Search and Examination Report to Application No. GB 0522155.1, Mar. 7, 2006.

Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Search and Examination Report to Application No. GB 0602877.3, Sep. 25, 2006.
Search and Examination Report to Application No. GB 0609173.0, Jul. 19, 2006.
Examination Report to Application No. AU 2003257878, Jan. 19, 2006.
Examination Report to Application No. AU 2003257878, Jan. 30, 2006.
Examination Report to Application No. AU 2003257881, Jan. 19, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examinaton Report to Application No. AU 2004202813, Jun. 14, 2006.
Examination Report to Application No. AU 2004202815, Jun. 14, 2006.
Search Report to Application No. EP 03071281.2; Nov. 7, 2005.
Search Report to Application No. EP 03071281.2; Nov. 14, 2005.
Search Report to Application No. EP 03723674.2; Nov. 22, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Examination Report to Application No. EP 03752486.5; Jun. 28, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Examination Report to Application No. Norway 2002 1613, May 13, 2006.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and Its Factors of Influence" Prof. Dorel Banabic (2003).
www.materialsresources.com, "Low Temperature Bonding of Dissimilar and Hard-to-Bond Materials and Metal-Including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.

International Search Report, Application PCT/US02/20477; Oct. 31, 2003.
International Search Report, Application PCT/US02120477; Apr. 6, 2004.
International Search Report, Application PCT/US02/24399; Feb. 27, 2004.
International Examination Report, Application PCT/US02/24399, Aug. 6, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/15020; Jul. 30, 2003.
International Search Report, Application PCT/US03/18530; Jun. 24, 2004.
International Search Report, Application PCT/US03/19993; May 24, 2004.
International Search Report, Application PCT/US03120694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. GB 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 9, 2003.
Examination Report to Application No. GB 0013661.4, Nov. 25 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4 2003.
Examination Report to Application No. GB 0208367.3, Nov. 17, 2003.
Examination Report to Application No. GB 0208367.3, Jan. 30 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Examination Report to Application GB 0220872.6, Oct. 29, 2004.
Search Report to Application No. GB 0225505.7, Mar. 5, 2003.
Search and Examination Report to Application No. GB 0225505.7, Jul. 1, 2003.
Examination Report to Application No. GB 0225505.7, Oct. 27, 2004.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.

Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, June 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0400018.8; Oct. 29, 2004.
Examination Report to Application No. GB 0400019.6; Oct. 29, 2004.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Examination Report to Application No. GB 0404830.2, Aug. 17, 2004.
Search and Examination Report to Application No. GB 0411698.4, Jun. 30, 2004.

Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application. No. Norway 1999 5593, Aug. 20, 2002.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25675 Nov. 24, 2004.
Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil & Gas Reporter*, Sep. 2004.
Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories- Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eemskanaal—2 Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expandable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.
Demong et al., "Breakthroughs Using Solid Expandable Tubulars to Construct Extended Reach Wells," *Society of Petroleum Engineers*, IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore*, Jun. 2003.

Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52, 3 Juillet 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
"Enventure Ready to Rejuvinate the North Sea," *Roustabout*, Sep. 2004.
Escobar et al., "Increasing Solid Expandable Tubular Technology Reliability in a Myriad of Downhole Environments," *Society of Petroleum Engineers*, SPE/IADC 81094, 2003.
Etsion, "A Laser Surface Textured Hydrostatic Mechanical Seal," *Sealing Technology*, Mar. 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Fraunhofer Iwu, "Research Area: Sheet Metal Forming—Superposition of Vibrations," 2001.
Furlow, "Casing Expansion, Test Process Fine Tuned on Ultradeepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Grant et al., "Deepwater Expandable Openhole Liner Case Histories: Learnings Through Field Applications," *Offshore Technology Conference*, OCT 14218, 2002.
Gusevik et al., "Reaching Deep Reservoir Targets Using Solid Expandable Tubulars" *Society of Petroleum Engineers*, SPE 77612, 2002.
Halliburton Completion Products, 1996.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Linzell, "Trib-Gel A Chemical Cold Welding Agent," 1999.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation- Extending Well Life Through The Use of Solid Expandable Casing Systems,".
Merritt et al., "Well Remediation Using Expandable Cased-Hole Liners", *World Oil*., Jul. 2002.
Merritt et al., "Well Remediation Using Expandable Cased-Hole Liners- Summary of Case Histories".
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System for Forming Metal Cans," 1999.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"Set Technology: The Facts" 2004.
Sieemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Turcotte et al., "Geodynamics Applications of Continuum Physics to Geological Problems," 1982.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.

Williams, "Straightening the Drilling Curve," *Oil and Gas Investor*, Jan. 2003.
www.JETLUBE.com, "Oilfield Catalog—Jet-Lok Product Applicatin Descriptions," 1998.
www.MITCHMET.com, "3d Surface Texture Parameters," 2004.
"Expand Your Opportunities." *Enventure*. CD-ROM. Jun. 1999.
"Expand Your Opportunities." *Enventure*. CD-ROM. May 2001.
International Search Report, Application PCT/US04/00631, Mar. 28, 2005.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/02122, May 13, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
International Preliminary Report on Patentability, Application PCT/US04/28438, Sep. 20, 2005.
Written Opinion to Application No. PCT/US03/25675, May 9, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, July 13, 2005.
Search Report to Application No. GB 0415835.8, Mar. 10, 2005.
Examination Report to Application No. GB 0400018.8, May 17, 2005.
Examination Report to Application No. GB 0400019.6, May 19, 2005.
Examination Report to Application No. GB 0403891.5, Jun. 30 2005.
Examination Report to Application No. GB 0404796.5, Apr. 14, 2005.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0412533.2, May 20, 2005.
Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0503470.7, Sep. 22, 2005.
Examination Report to Application No. GB 0506699.8, Sep. 21, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. Norway 1999 5593, Aug. 20, 2002.

U.S. Appl. No. 10/500,745 Restriction Requirement dated Jan. 21, 2009.
U.S. Appl. No. 10/500,745 Office Action dated May 28, 2009.
U.S. Appl. No. 10/500,745 Restriction Requirement dated Jul. 31, 2008.
U.S. Appl. No. 10/511,410 Restriction Requirement dated Sep. 6, 2007.
U.S. Appl. No. 10/511,410 Office Action dated Dec. 10, 2007.
U.S. Appl. No. 10/511,410 Office Action dated Aug. 19, 2008.
U.S. Appl. No. 10/511,410 Office Action dated Mar. 23, 2009.
U.S. Appl. No. 10/522,039 Restriction Requirement dated Apr. 2, 2008.
U.S. Appl. No. 10/522,039 Office Action dated Aug. 26, 2008.
U.S. Appl. No. 10/522,099 Restriction Requirement dated Nov. 15, 2007.
U.S. Appl. No. 10/522,099 Office Communication dated Mar. 26, 2008.
U.S. Appl. No. 10/522,099 Restriction Requirement dated Jul. 25, 2008.
U.S. Appl. No. 10/525,402 Office Action dated Jul. 23, 2007.
U.S. Appl. No. 10/528,223 Restriction Requirement dated Sep. 6, 2007.
U.S. Appl. No. 10/494,045 Restriction Requirement dated Apr. 10, 2008.
U.S. Appl. No. 10/494,045 Restriction Requirement dated Jun. 12, 2008.

* cited by examiner

PROTECTIVE SLEEVE FOR THREADED CONNECTIONS FOR EXPANDABLE LINER HANGER

CROSS REFERENCE TO RELATED APPLICATIONS

The present application is related to the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference.

BACKGROUND OF THE INVENTION

This invention relates generally to oil and gas exploration, and in particular to forming and repairing wellbore casings to facilitate oil and gas exploration.

During oil exploration, a wellbore typically traverses a number of zones within a subterranean formation. Wellbore casings are then formed in the wellbore by radially expanding and plastically deforming tubular members that are coupled to one another by threaded connections. Existing methods for radially expanding and plastically deforming tubular members coupled to one another by threaded connections are not always reliable or produce satisfactory results. In particular, the threaded connections can be damaged during the radial expansion process.

The present invention is directed to overcoming one or more of the limitations of the existing processes for radially expanding and plastically deforming tubular members coupled to one another by threaded connections.

SUMMARY OF THE INVENTION

According to one aspect of the present invention, a method is provided that includes coupling an end of a first tubular member to an end of a tubular sleeve, coupling an end of a second tubular member to another end of the tubular sleeve, threadably coupling the ends of the first and second tubular members, and radially expanding and plastically deforming the first tubular member and the second tubular member.

According to another aspect of the present invention, an apparatus is provided that includes a tubular sleeve, a first tubular member coupled to an end of the tubular sleeve comprising internal threads at an end portion, and a second tubular member coupled to another end of the tubular sleeve comprising external threads at an end portion that engage the internal threads of the end portion of the first tubular member.

According to another aspect of the present invention, a method of extracting geothermal energy from a subterranean source of geothermal energy is provided that includes drilling a borehole that traverses the subterranean source of geothermal energy, positioning a first casing string within the borehole, radially expanding and plastically deforming the first casing string within the borehole, positioning a second casing string within the borehole that traverses the subterranean source of geothermal energy, overlapping a portion of the second casing string with a portion of the first casing string, radially expanding and plastically deforming the second casing string within the borehole, and extracting geothermal energy from the subterranean source of geothermal energy using the first and second casing strings.

According to another aspect of the present invention, an apparatus for extracting geothermal energy from a subterranean source of geothermal energy is provided that includes a borehole that traverses the subterranean source of geothermal energy, a first casing string positioned within the borehole, and a second casing positioned within the borehole that overlaps with the first casing string that traverses the subterranean source of geothermal energy. The first casing string and the second casing string are radially expanded and plastically deformed within the borehole.

BRIEF DESCRIPTION OF THE DRAWINGS

¶¶

DETAILED DESCRIPTION OF THE ILLUSTRATIVE EMBODIMENTS

Figure 1A:
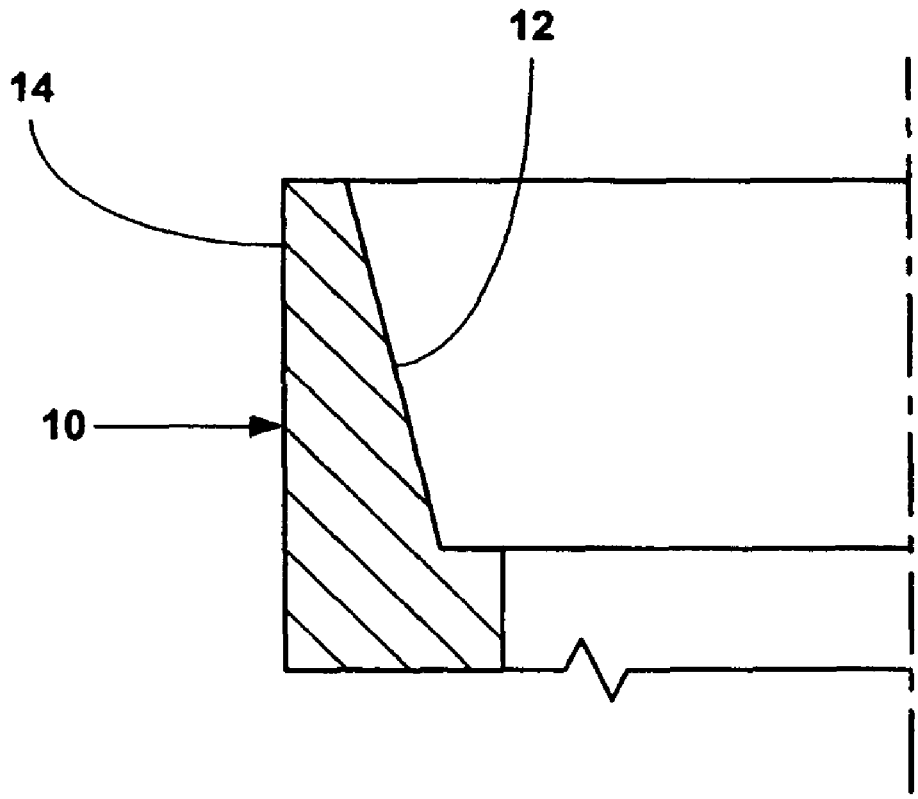
FIG. 1*a* is a fragmentary cross-sectional illustration of a first tubular member having an internally threaded connection at an end portion.
Figure 1B:
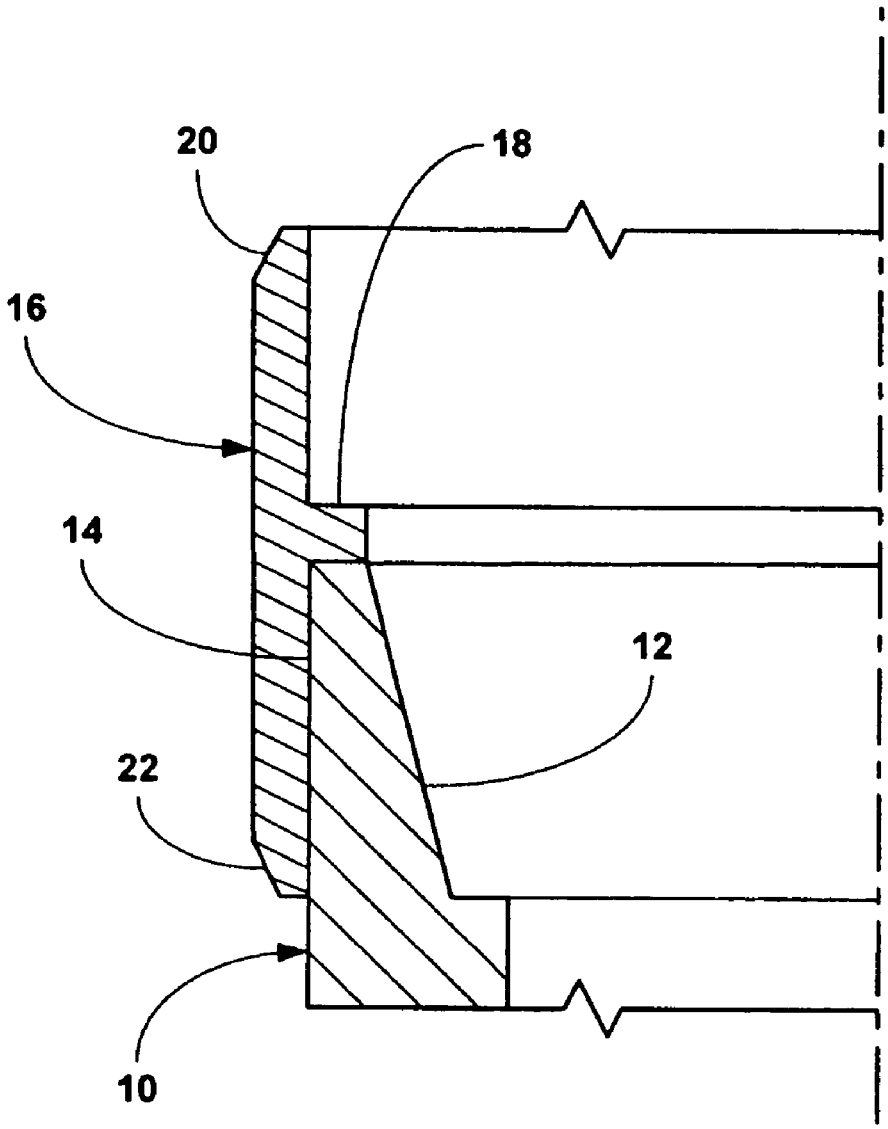
FIG. 1*b* is a fragmentary cross-sectional illustration of the placement of a tubular sleeve onto the end portion of the first tubular member of FIG. 1*a*.
Figure 1C:
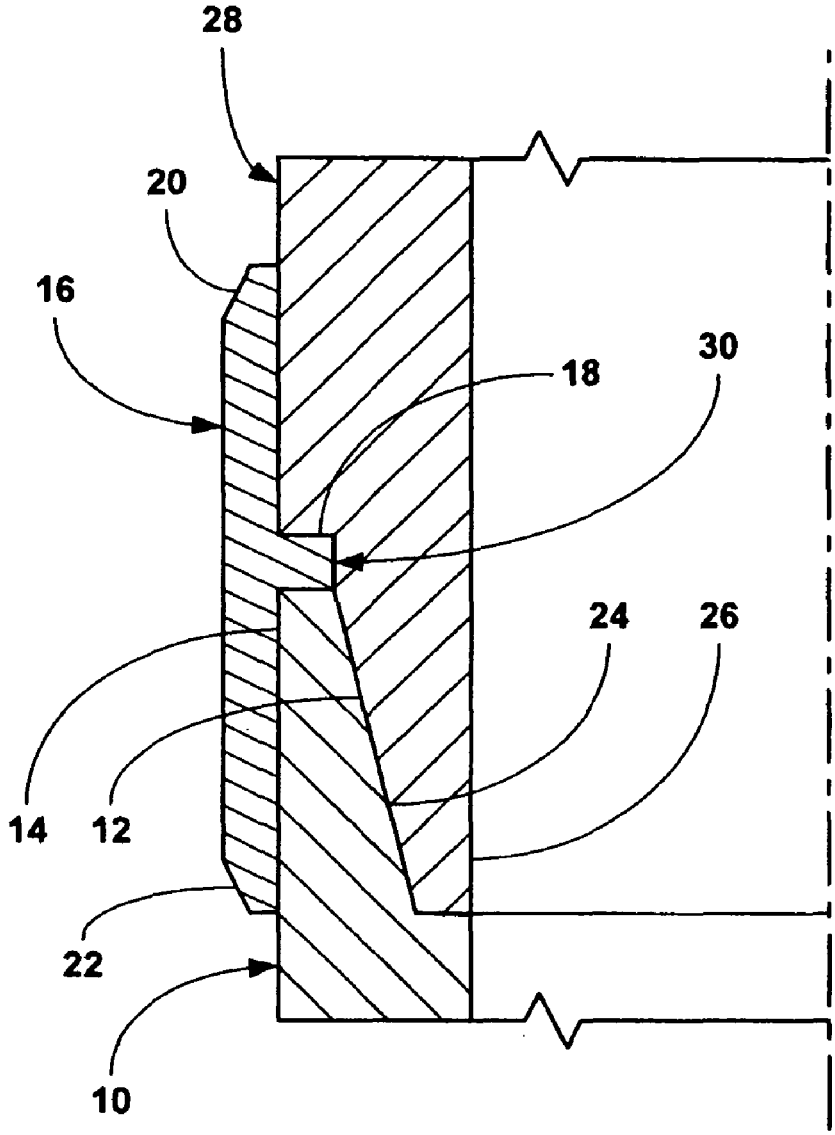
FIG. 1*c* is a fragmentary cross-sectional illustration of the coupling of an externally threaded connection at an end portion of a second tubular member to the internally threaded connection at the end portion of the first tubular member of FIG. 1*b*.

Referring to FIG. 1*a*, a first tubular member 10 includes an internally threaded connection 12 at an end portion 14. As illustrated in FIG. 1*b*, a first end of a tubular sleeve 16 that includes an internal flange 18 and tapered portions, 20 and 22, at opposite ends is then mounted upon and receives the end portion 14 of the first tubular member 10. In an exemplary embodiment, the end portion 14 of the first tubular member 10 abuts one side of the internal flange 18 of the tubular sleeve 16, and the internal diameter of the internal flange of the tubular sleeve is substantially equal to or greater than the maximum internal diameter of the internally threaded connection 12 of the end portion of the first tubular member. As illustrated in FIG. 1*c*, an externally threaded connection 24 of an end portion 26 of a second tubular member 28 having an annular recess 30 is then positioned within the tubular sleeve 16 and threadably coupled to the internally threaded connection 12 of the end portion 14 of the first tubular member 10. In an exemplary embodiment, the internal flange 18 of the tubular sleeve 16 mates with and is received within the annular recess 30 of the end portion 26 of the second tubular member 28. Thus, the tubular sleeve 16 is coupled to and surrounds the external surfaces of the first and second tubular members, 10 and 28.

In an exemplary embodiment, the internally threaded connection 12 of the end portion 14 of the first tubular member 10 is a box connection, and the externally threaded connection 24 of the end portion 26 of the second tubular member 28 is a pin connection. In an exemplary embodiment, the internal diameter of the tubular sleeve 16 is at least approximately 0.020" greater than the outside diameters of the first and second tubular members, 10 and 28. In this manner, during the threaded coupling of the first and second tubular members, 10 and 28, fluidic materials within the first and second tubular members may be vented from the tubular members.

Figure 1D:
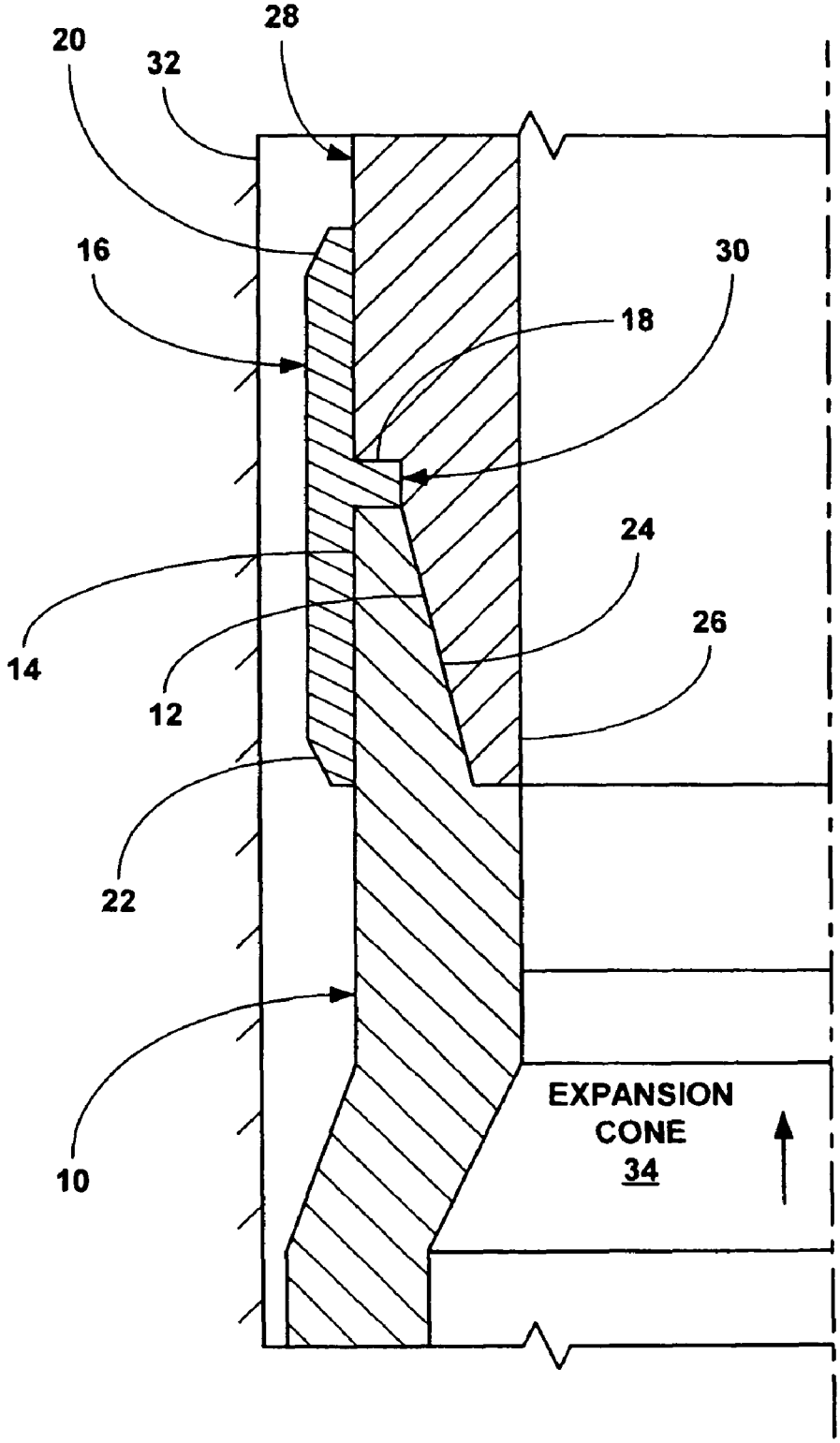
FIG. 1*d* is a fragmentary cross-sectional illustration of the radial expansion and plastic deformation of a portion of the first tubular member of FIG. 1*c*.
Figure 1E:
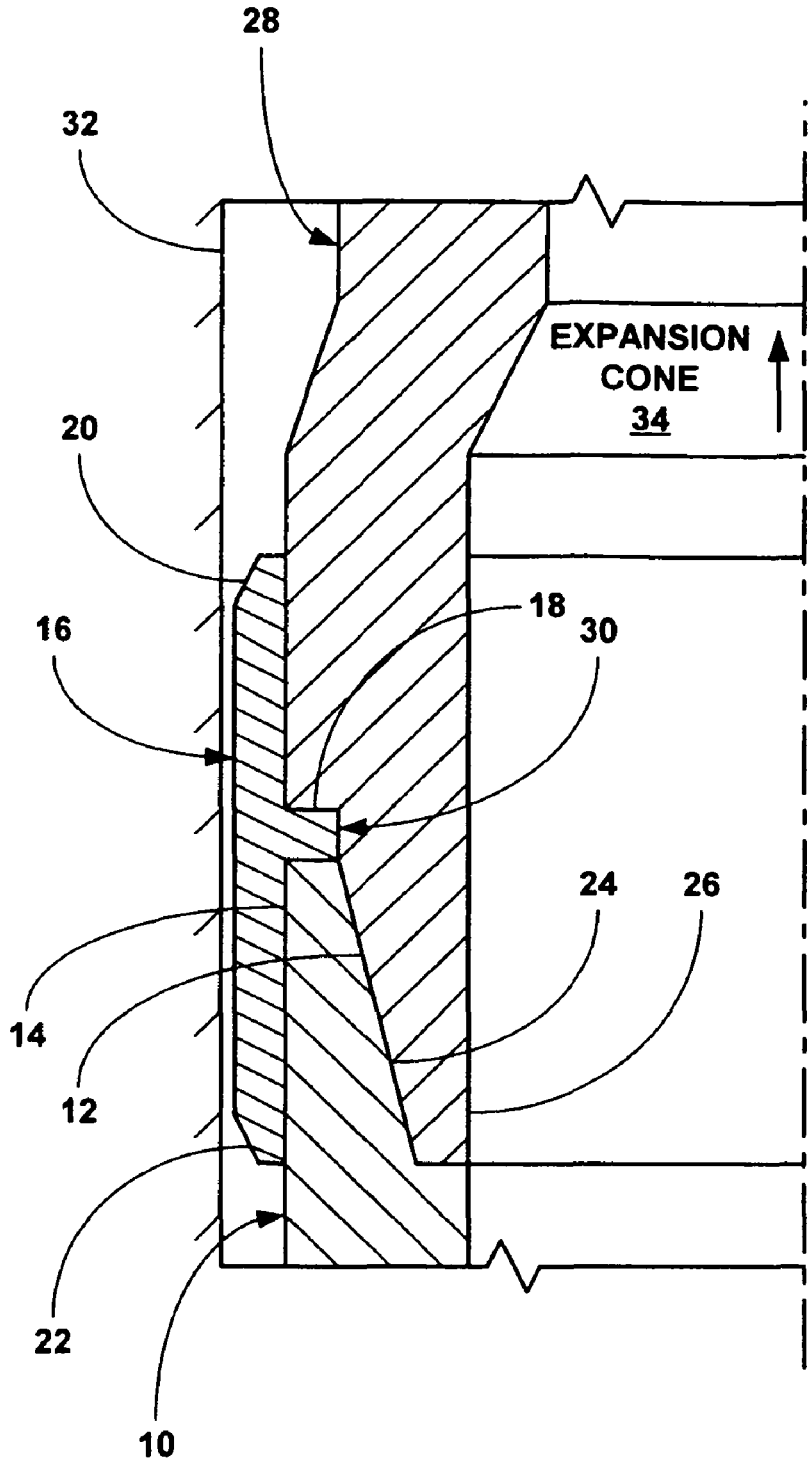
FIG. 1*e* is a fragmentary cross sectional of the continued radial expansion and plastic deformation of the threaded connection between the first and second tubular members and the tubular sleeve of FIG. 1*d*.

In an exemplary embodiment, as illustrated in FIGS. 1*d* and 1*e*, the first and second tubular members, 10 and 28, and the tubular sleeve 16 may then be positioned within another structure 32 such as, for example, a wellbore, and radially expanded and plastically deformed, for example, by moving an expansion cone 34 through the interiors of the first and second tubular members. The tapered portions, 20 and 22, of the tubular sleeve 16 facilitate the insertion and movement of the first and second tubular members within and through the structure 32, and the movement of the expansion cone 34 through the interiors of the first and second tubular members, 10 and 28, may be from top to bottom or from bottom to top.

In an exemplary embodiment, during the radial expansion and plastic deformation of the first and second tubular members, 10 and 28, the tubular sleeve 16 is also radially expanded and plastically deformed. In an exemplary embodiment, as a result, the tubular sleeve 16 may be maintained in circumferential tension and the end portions, 14 and 26, of the first and second tubular members, 10 and 28, may be maintained in circumferential compression.

In several exemplary embodiments, the first and second tubular members, 10 and 28, are radially expanded and plastically deformed using the expansion cone 34 in a conventional manner and/or using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference.

In several alternative embodiments, the first and second tubular members, 10 and 28, are radially expanded and plastically deformed using other conventional methods for radially expanding and plastically deforming tubular members such as, for example, internal pressurization and/or roller expansion devices such as, for example, that disclosed in U.S. patent application publication no. US 2001/0045284 A1, the disclosure of which is incorporated herein by reference.

The use of the tubular sleeve 16 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 16 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular member, 10 and 28, are prevented that could result in stress concentrations that could result in a catastrophic failure during subsequent radial expansion operations. Furthermore, the tubular sleeve 16 provides an alignment guide that facilitates the insertion and threaded coupling of the second tubular member 28 to the first tubular member 10. In this manner, misalignment that could result in damage to the threaded connections, 12 and 24, of the first and second tubular members, 10 and 28, may be avoided. In addition, during the relative rotation of the second tubular member with respect to the first tubular member, required during the threaded coupling of the first and second tubular members, the tubular sleeve 16 provides an indication of to what degree the first and second tubular members are threadably coupled. For example, if the tubular sleeve 16 can be easily rotated, that would indicate that the first and second tubular members, 10 and 28, are not fully threadably coupled and in intimate contact with the internal flange 18 of the tubular sleeve. Furthermore, the tubular sleeve 16 may prevent crack propagation during the radial expansion and plastic deformation of the first and second tubular members, 10 and 28. In this manner, failure modes such as, for example, longitudinal cracks in the end portions, 14 and 26, of the first and second tubular members may be limited in severity or eliminated all together. In addition, after completing the radial expansion and plastic deformation of the first and second tubular members, 10 and 28, the tubular sleeve 16 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 16 may be maintained in circumferential tension and the end portions, 14 and 26, of the first and second tubular members, 10 and 28, may be maintained in circumferential compression, axial loads and/or torque loads may be transmitted through the tubular sleeve.

Figure 2A:
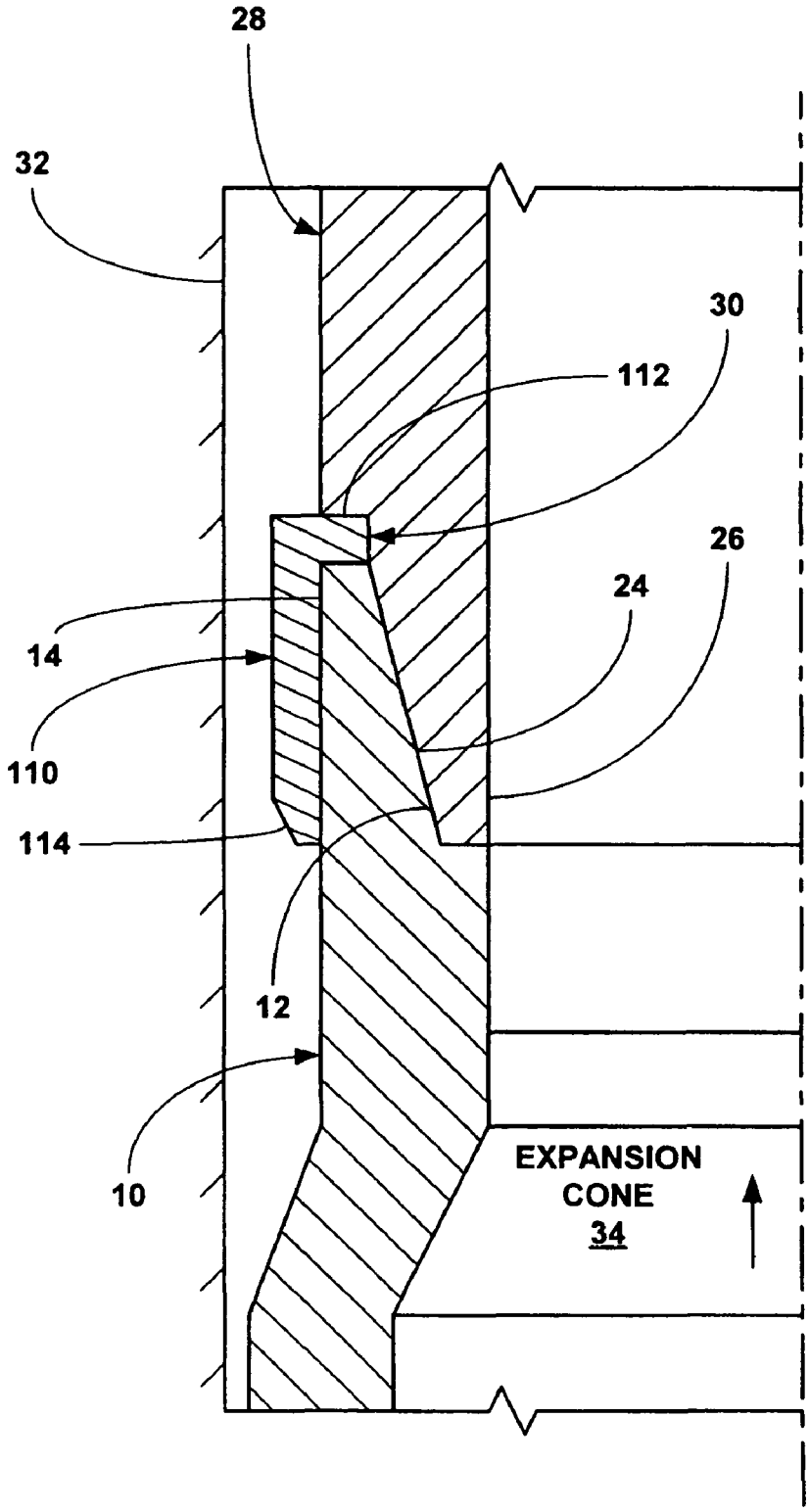
FIG. 2*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 2B:
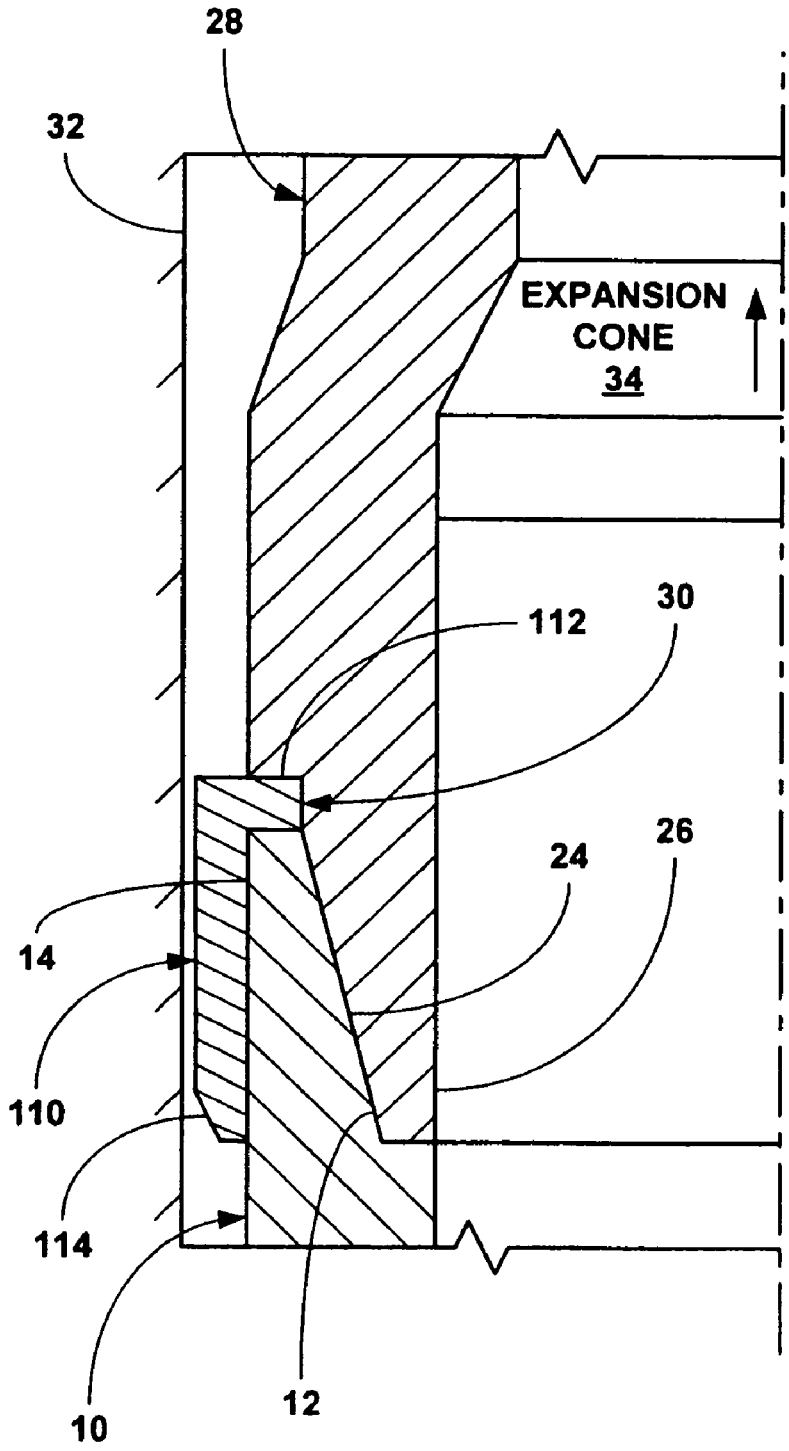
FIG. 2*b* is a fragmentary cross sectional of the continued radial expansion and plastic deformation of the threaded connection between the first and second tubular members and the tubular sleeve of FIG. 2*a*.

Referring to FIGS. 2*a* and 2*b*, in an alternative embodiment, a tubular sleeve 110 having an internal flange 112 and a tapered portion 114 is coupled to the first and second tubular members, 10 and 28. In particular, the tubular sleeve 110 receives and mates with the end portion 14 of the first tubular member 10, and the internal flange 112 of the tubular sleeve is received within the annular recess 30 of the second tubular member 28 proximate the end of the first tubular member. In this manner, the tubular sleeve 110 is coupled to the end portions, 14 and 26, of the first and second tubular members, 10 and 28, and the tubular sleeve covers the end portion 14 of the first tubular member 10.

In an exemplary embodiment, the first and second tubular members, 10 and 28, and the tubular sleeve 110 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 110 may be maintained in circumferential tension and the end portions, 14 and 26, of the first and second tubular members, 10 and 28, may be maintained in circumferential compression.

The use of the tubular sleeve 110 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 110 protects the exterior surface of the end portion 14 of the first tubular member 10 during handling and insertion of the tubular members within the structure 32. In this manner, damage to the exterior surfaces of the end portion 14 of the first tubular member 10 is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 110 provides an indication of to what degree the first and second tubular members are threadably coupled. For example, if the tubular sleeve 110 can be easily rotated, that would indicate that the first and second tubular members, 10 and 28, are not fully threadably coupled and in intimate contact with the internal flange 112 of the tubular sleeve. Furthermore, the tubular sleeve 110 may prevent crack propagation during the radial expansion and plastic deformation of the first and second tubular members, 10 and 28. In this manner, failure modes such as, for example, longitudinal cracks in the end portions, 14 and 26, of the first and second tubular members may be limited in severity or eliminated all together. In addition, after completing the radial expansion and plastic deformation of the first and second tubular members, 10 and 28, the tubular sleeve 110 may provide a fluid tight metal-to-metal seal between interior surface of the tubular sleeve and the exterior surface of the end portion 14 of the first tubular member. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 110 may be maintained in circumferential tension and the end portions, 14 and 26, of the first and second tubular members, 10 and 28, may be maintained in circumferential compression, axial loads and/or torque loads may be transmitted through the tubular sleeve.

Figure 3A:
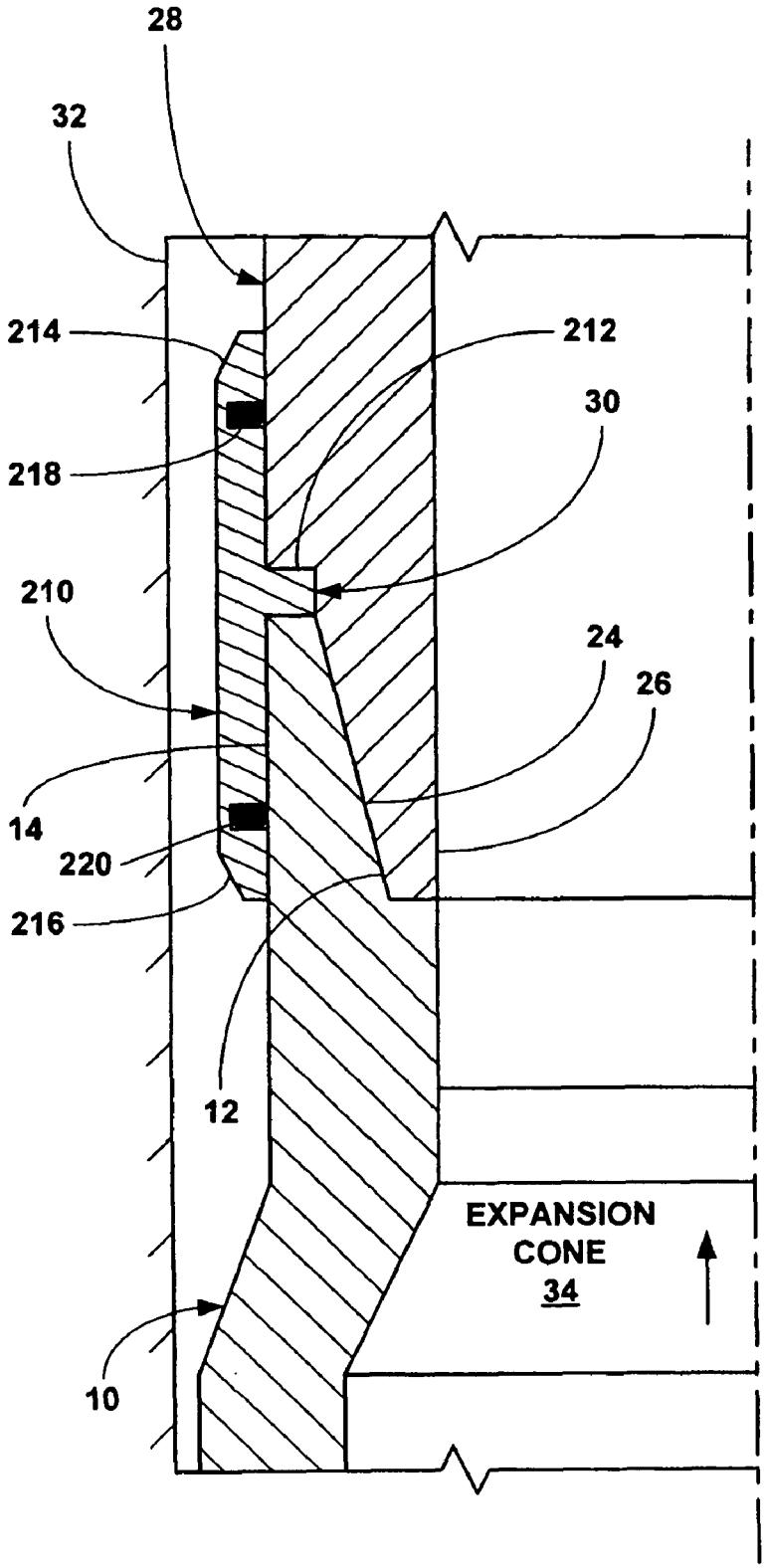
FIG. 3*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 3B:
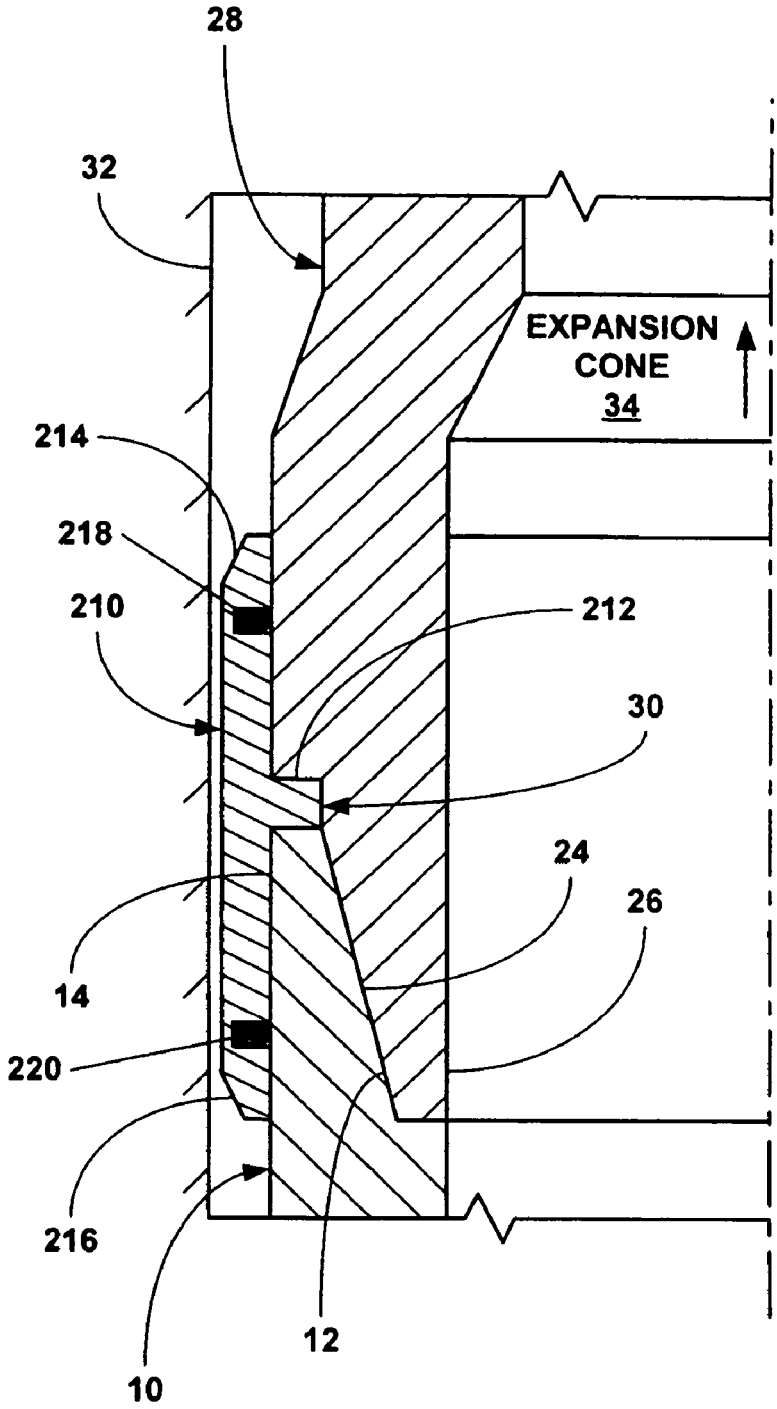
FIG. 3*b* is a fragmentary cross sectional of the continued radial expansion and plastic deformation of the threaded connection between the first and second tubular members and the tubular sleeve of FIG. 3*a*.

Referring to FIGS. 3*a* and 3*b*, in an alternative embodiment, a tubular sleeve 210 having an internal flange 212, tapered portions, 214 and 216, at opposite ends, and annular sealing members, 218 and 220, positioned on opposite sides of the internal flange, is coupled to the first and second tubular members, 10 and 28. In particular, the tubular sleeve 210 receives and mates with the end portions, 14 and 26, of the first and second tubular members, 10 and 28, and the internal flange 212 of the tubular sleeve is received within the annular recess 30 of the second tubular member 28 proximate the end of the first tubular member. Furthermore, the sealing members, 218 and 220, of the tubular sleeve 210 engage and fluidicly seal the interface between the tubular sleeve and the end portions, 14 and 26, of the first and second tubular members, 10 and 28. In this manner, the tubular sleeve 210 is coupled to the end portions, 14 and 26, of the first and second tubular members, 10 and 28, and the tubular sleeve covers the end portions, 14 and 26, of the first and second tubular members, 10 and 28.

In an exemplary embodiment, the first and second tubular members, 10 and 28, and the tubular sleeve 210 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 210 may be maintained in circumferential tension and the end portions, 14 and 26, of the first and second tubular members, 10 and 28, may be maintained in circumferential compression.

The use of the tubular sleeve 210 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 210 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 210 provides an indication of to what degree the first and second tubular members are threadably coupled. For example, if the tubular sleeve 210 can be easily rotated, that would indicate that the first and second tubular members, 10 and 28, are not fully threadably coupled and in intimate contact with the internal flange 212 of the tubular sleeve. Furthermore, the tubular sleeve 210 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 210 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 210 may be maintained in circumferential tension and the end portions, 14 and 26, of the first and second tubular members, 10 and 28, may be maintained in circumferential compression, axial loads and/or torque loads may be transmitted through the tubular sleeve.

Figure 4A:
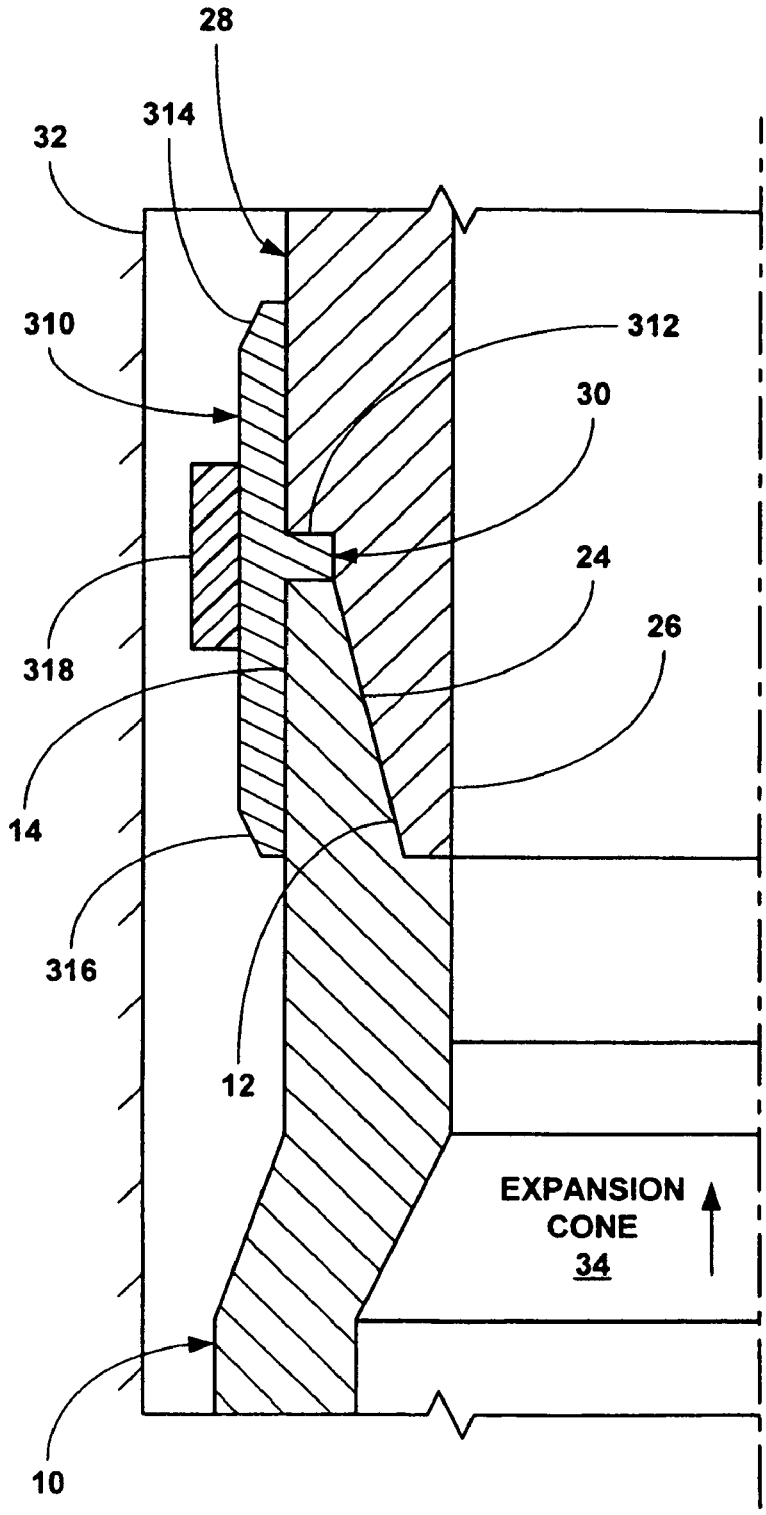
FIG. 4*a* is a fragmentary cross-sectional illustration of the radial expansion and plastic deformation of a portion of a first tubular member having an internally threaded connection at an end portion, an alternative embodiment of a tubular sleeve having an external sealing element supported by the end portion of the first tubular member, and a second tubular member having an externally threaded portion coupled to the internally threaded portion of the first tubular member.
Figure 4B:
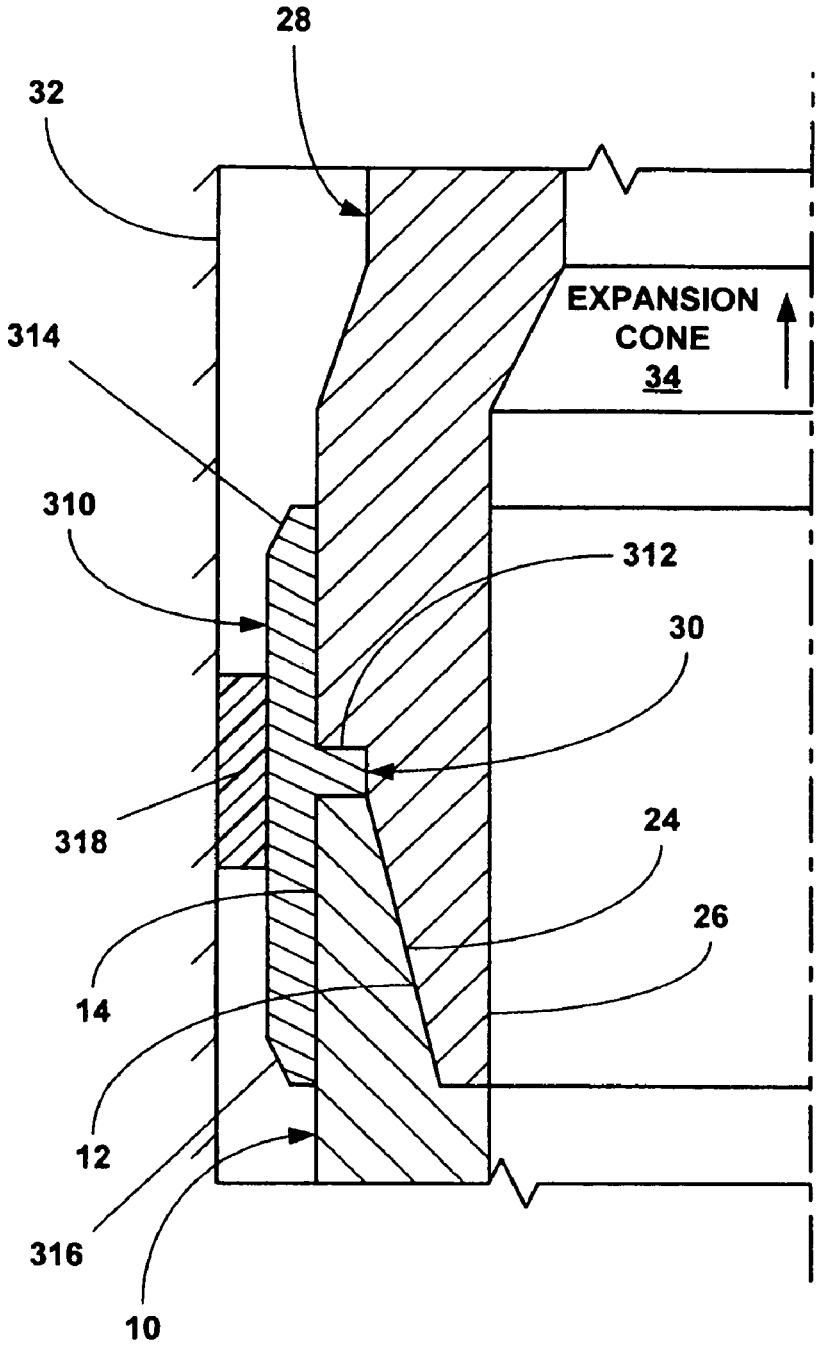
FIG. 4*b* is a fragmentary cross sectional of the continued radial expansion and plastic deformation of the threaded connection between the first and second tubular members and the tubular sleeve of FIG. 4*a*.

Referring to FIGS. 4*a* and 4*b*, in an alternative embodiment, a tubular sleeve 310 having an internal flange 312, tapered portions, 314 and 316, at opposite ends, and an annular sealing member 318 positioned on the exterior surface of the tubular sleeve, is coupled to the first and second tubular members, 10 and 28. In particular, the tubular sleeve 310 receives and mates with the end portions, 14 and 26, of the first and second tubular members, 10 and 28, and the internal flange 312 of the tubular sleeve is received within the annular recess 30 of the second tubular member 28 proximate the end of the first tubular member. In this manner, the tubular sleeve 310 is coupled to the end portions, 14 and 26, of the first and second tubular members, 10 and 28, and the tubular sleeve covers the end portions, 14 and 26, of the first and second tubular members, 10 and 28.

In an exemplary embodiment, the first and second tubular members, 10 and 28, and the tubular sleeve 310 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 310 may be maintained in circumferential tension and the end portions, 14 and 26, of the first and second tubular members, 10 and 28, may be maintained in circumferential compression. Furthermore, in an exemplary embodiment, following the radial expansion and plastic deformation of the first and second tubular members, 10 and 28, the annular sealing member 318 circumferentially engages the interior surface of the structure 32 thereby preventing the passage of fluidic materials through the annulus between the tubular sleeve 310 and the structure. In this manner, the tubular sleeve 310 may provide an expandable packer element.

The use of the tubular sleeve 310 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 310 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 310 provides an indication of to what degree the first and second tubular members are threadably coupled. For example, if the tubular sleeve 310 can be easily rotated, that would indicate that the first and second tubular members, 10 and 28, are not fully threadably coupled and in intimate contact with the internal flange 312 of the tubular sleeve. Furthermore, the tubular sleeve 310 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 310 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 310 may be maintained in circumferential tension and the end portions, 14 and 26, of the first and second tubular members, 10 and 28, may be maintained in circumferential compression, axial loads and/or torque loads may be transmitted through the tubular sleeve. In addition, because, following the radial expansion and plastic deformation of the first and second tubular members, 10 and 28, the annular sealing member 318 may circumferentially engage the interior surface of the structure 32, the tubular sleeve 310 may provide an expandable packer element.

Figure 5A:
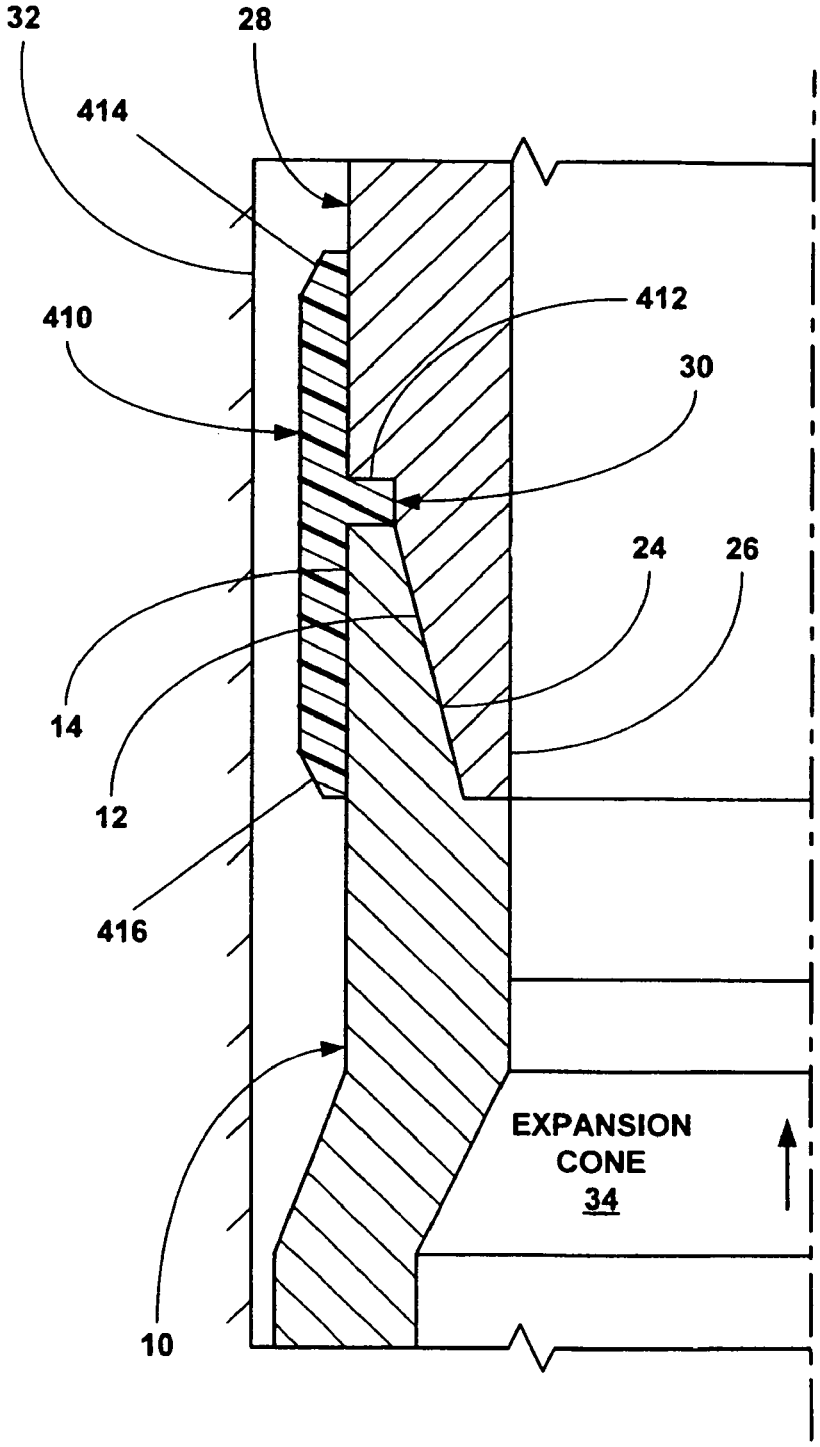
FIG. 5*a* is a fragmentary cross-sectional illustration of the radial expansion and plastic deformation of a portion of a first tubular member having an internally threaded connection at an end portion, an alternative embodiment of a tubular sleeve supported by the end portion of the first tubular member, and a second tubular member having an externally threaded portion coupled to the internally threaded portion of the first tubular member.
Figure 5B:
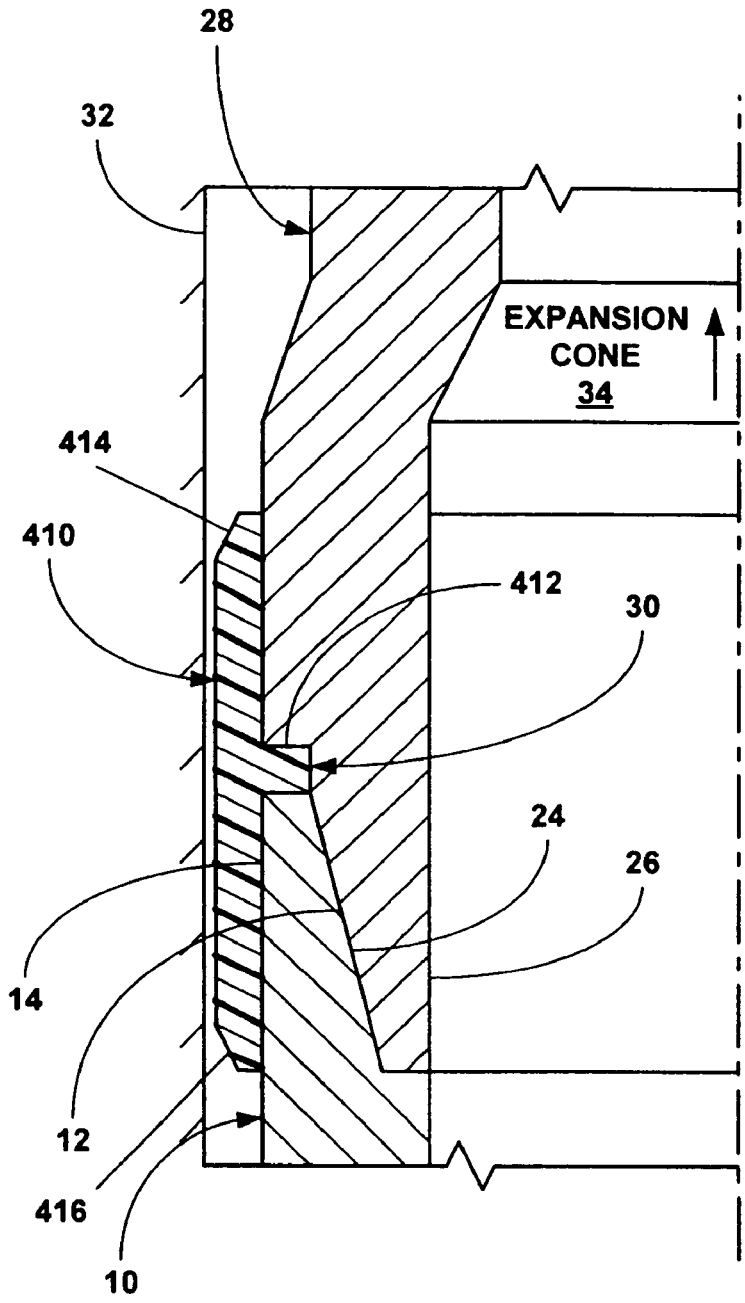
FIG. 5*b* is a fragmentary cross sectional of the continued radial expansion and plastic deformation of the threaded connection between the first and second tubular members and the tubular sleeve of FIG. 5*a*.

Referring to FIGS. 5*a* and 5*b*, in an alternative embodiment, a non-metallic tubular sleeve 410 having an internal flange 412, and tapered portions, 414 and 416, at opposite ends, is coupled to the first and second tubular members, 10 and 28. In particular, the tubular sleeve 410 receives and mates with the end portions, 14 and 26, of the first and second tubular members, 10 and 28, and the internal flange 412 of the tubular sleeve is received within the annular recess 30 of the second tubular member 28 proximate the end of the first tubular member. In this manner, the tubular sleeve 410 is coupled to the end portions, 14 and 26, of the first and second tubular members, 10 and 28, and the tubular sleeve covers the end portions, 14 and 26, of the first and second tubular members, 10 and 28.

In several exemplary embodiments, the tubular sleeve 410 may be plastic, ceramic, elastomeric, composite and/or a frangible material.

In an exemplary embodiment, the first and second tubular members, 10 and 28, and the tubular sleeve 410 may then be positioned within the structure 32 and radially expanded and plastically deformed, for example, by moving an expansion cone 34 through the interiors of the first and second tubular members. In an exemplary embodiment, following the radial expansion and plastic deformation of the first and second tubular members, 10 and 28, the tubular sleeve 410 may be maintained in circumferential tension and the end portions, 14 and 26, of the first and second tubular members, 10 and 28, may be maintained in circumferential compression. Furthermore, in an exemplary embodiment, during the radial expansion and plastic deformation of the first and second tubular members, 10 and 28, the tubular sleeve 310 may be broken off of the first and second tubular members.

The use of the tubular sleeve 410 during (a) the coupling of the first tubular member 10 to the second tubular member 28, (b) the placement of the first and second tubular members in the structure 32, and (c) the radial expansion and plastic deformation of the first and second tubular members provides a number of significant benefits. For example, the tubular sleeve 410 protects the exterior surfaces of the end portions, 14 and 26, of the first and second tubular members, 10 and 28, during handling and insertion of the tubular members within the structure 32. In this manner, damage to the exterior surfaces of the end portions, 14 and 26, of the first and second tubular members, 10 and 28, is prevented that could result in stress concentrations that could result in a catastrophic failure during subsequent radial expansion operations. In addition, during the relative rotation of the second tubular member with respect to the first tubular member, required during the threaded coupling of the first and second tubular members, the tubular sleeve 410 provides an indication of to what degree the first and second tubular members are threadably coupled. For example, if the tubular sleeve 410 can be easily rotated, that would indicate that the first and second tubular members, 10 and 28, are not fully threadably coupled and in intimate contact with the internal flange 412 of the tubular sleeve. Furthermore, the tubular sleeve 410 may prevent crack propagation during the radial expansion and plastic deformation of the first and second tubular members, 10 and 28. In this manner, failure modes such as, for example, longitudinal cracks in the end portions, 14 and 26, of the first and second tubular members, 10 and 28, may be limited in severity or eliminated all together. In addition, after completing the radial expansion and plastic deformation of the first and second tubular members, 10 and 28, the tubular sleeve 410 may provide a fluid tight metal-to-metal seal between interior surface of the tubular sleeve and the exterior surfaces of the end portions, 14 and 26, of the first and second tubular members. In this manner, fluidic materials are prevented from passing through the threaded connections, 12 and 24, of the first and second tubular members, 10 and 28, into the annulus between the first and second tubular members and the structure 32. Furthermore, because, following the radial expansion and plastic deformation of the first and second tubular members, 10 and 28, the tubular sleeve 410 may be maintained in circumferential tension and the end portions, 14 and 26, of the first and second tubular members, 10 and 28, may be maintained in circumferential compression, axial loads and/or torque loads may be transmitted through the tubular sleeve. In addition, because, during the radial expansion and plastic deformation of the first and second tubular members, 10 and 28, the tubular sleeve 410 may be broken off of the first and second tubular members, the final outside diameter of the first and second tubular members may more closely match the inside diameter of the structure 32.

Figure 6A:
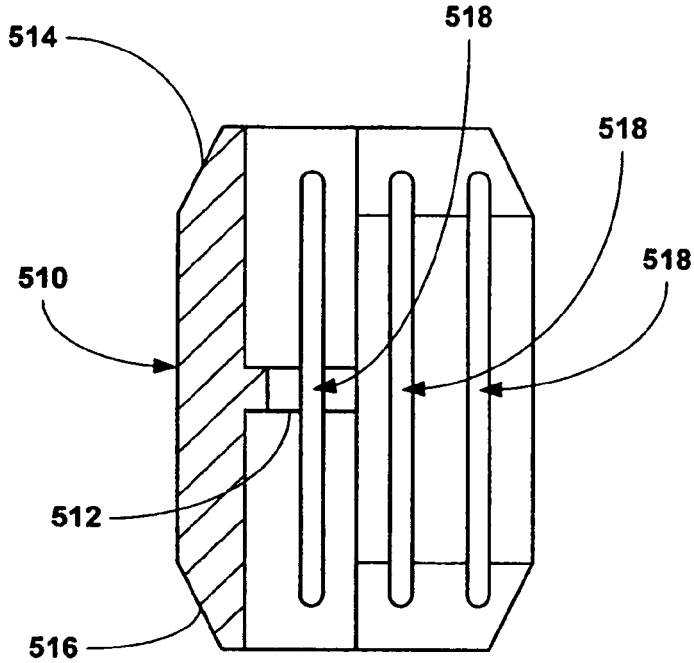
FIG. 6*a* is a fragmentary cross sectional illustration of an alternative embodiment of a tubular sleeve.

Referring to FIG. 6*a*, in an exemplary embodiment, a tubular sleeve 510 includes an internal flange 512, tapered portions, 514 and 516, at opposite ends, and defines one or more axial slots 518. In an exemplary embodiment, during the radial expansion and plastic deformation of the first and second tubular members, 10 and 28, the axial slots 518 reduce the required radial expansion forces.

Figure 6B:
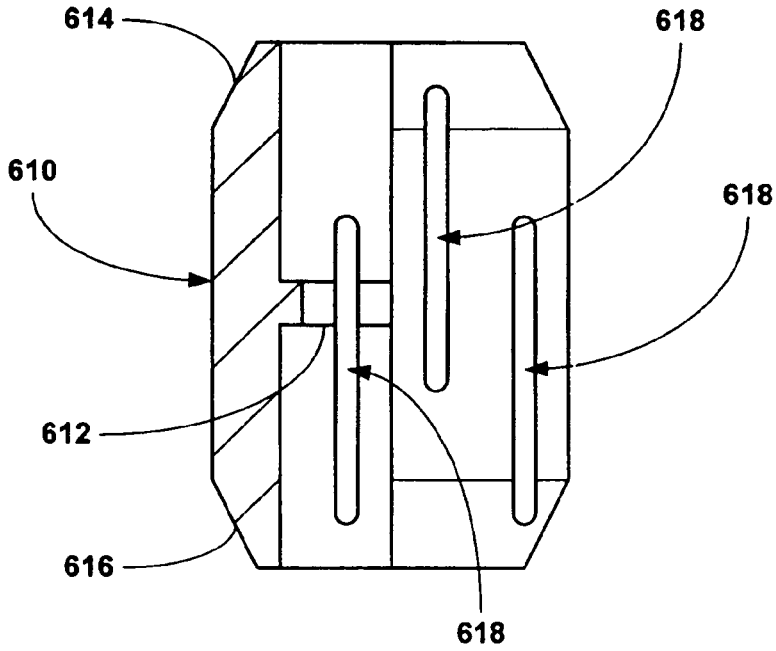
FIG. 6*b* is a fragmentary cross sectional illustration of an alternative embodiment of a tubular sleeve.

Referring to FIG. 6*b*, in an exemplary embodiment, a tubular sleeve 610 includes an internal flange 612, tapered portions, 614 and 616, at opposite ends, and defines one or more offset axial slots 618. In an exemplary embodiment, during the radial expansion and plastic deformation of the first and second tubular members, 10 and 28, the axial slots 618 reduce the required radial expansion forces.

Figure 6C:
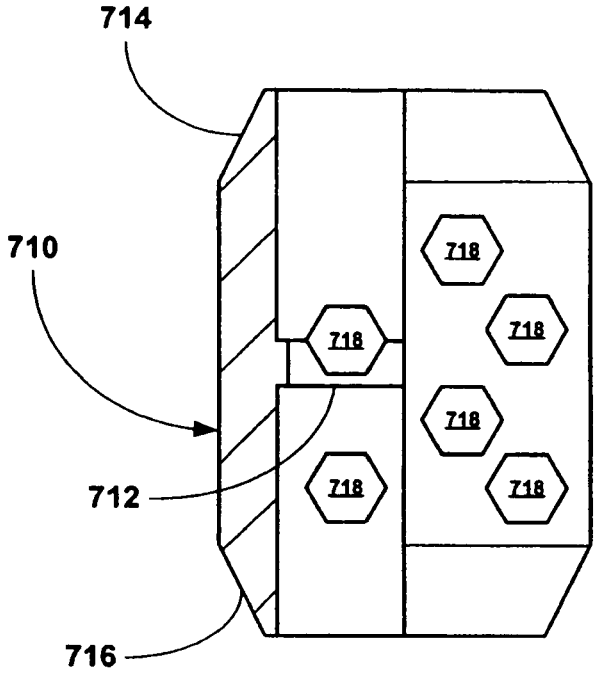
FIG. 6*c* is a fragmentary cross sectional illustration of an alternative embodiment of a tubular sleeve.

Referring to FIG. 6*c*, in an exemplary embodiment, a tubular sleeve 710 includes an internal flange 712, tapered portions, 714 and 716, at opposite ends, and defines one or more radial openings 718. In an exemplary embodiment, during the radial expansion and plastic deformation of the first and second tubular members, 10 and 28, the radial openings 718 reduce the required radial expansion forces.

Figure 6D:
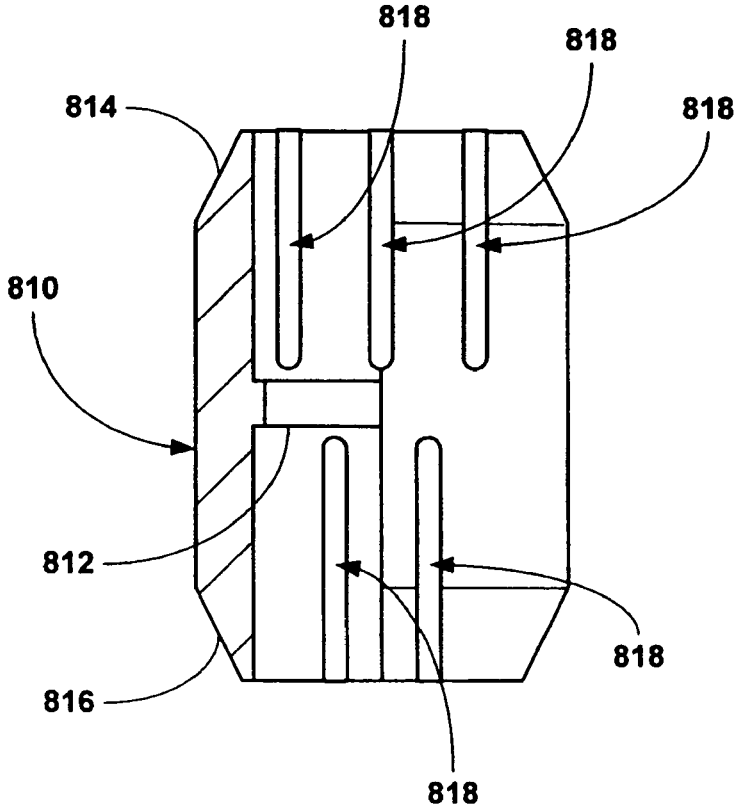
FIG. 6*d* is a fragmentary cross sectional illustration of an alternative embodiment of a tubular sleeve.

Referring to FIG. 6*d*, in an exemplary embodiment, a tubular sleeve 810 includes an internal flange 812, tapered portions, 814 and 816, at opposite ends, and defines one or more axial slots 818 that extend from the ends of the tubular sleeve. In an exemplary embodiment, during the radial expansion and plastic deformation of the first and second tubular members, 10 and 28, the axial slots 818 reduce the required radial expansion forces.

Figure 7A:
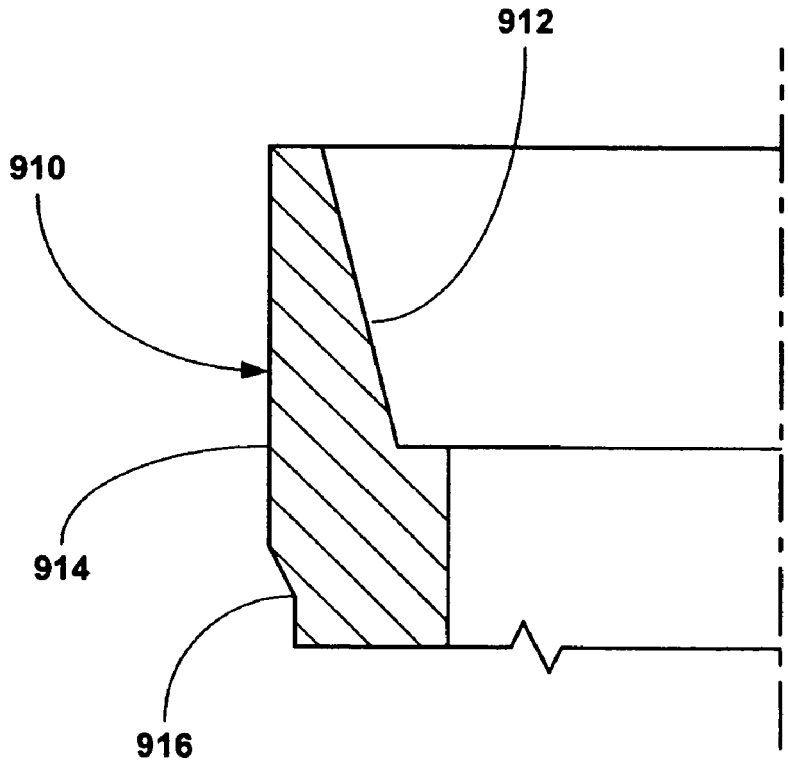
FIG. 7*a* is a fragmentary cross-sectional illustration of a first tubular member having an internally threaded connection at an end portion.
Figure 7B:
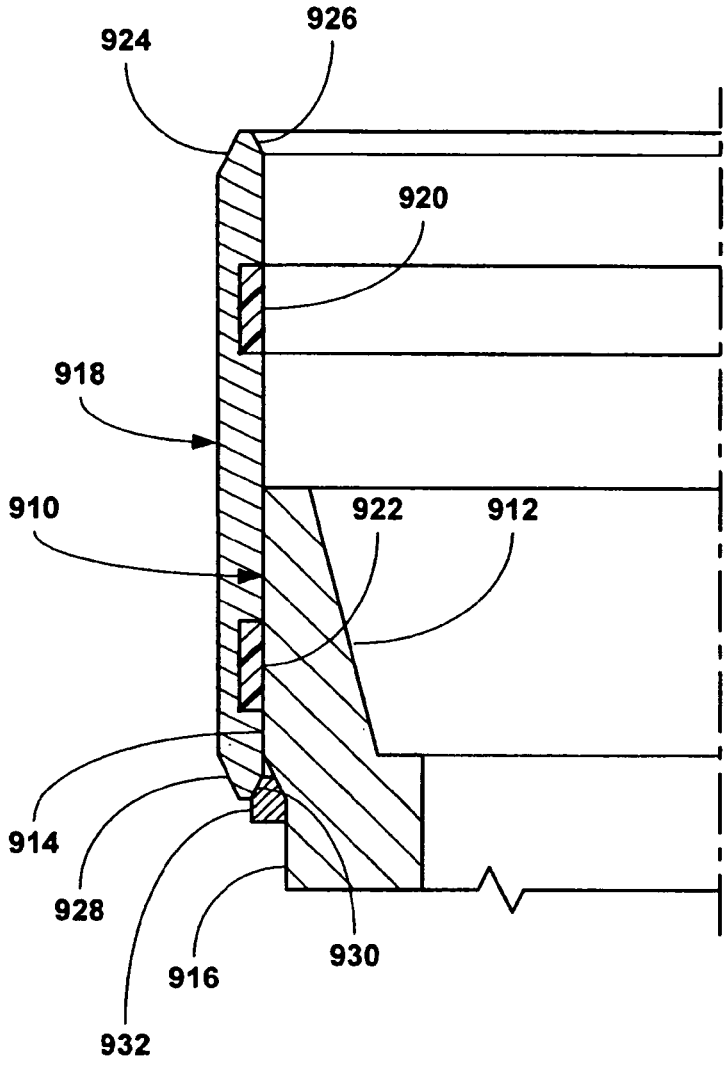
FIG. 7*b* is a fragmentary cross-sectional illustration of the placement of an alternative embodiment of a tubular sleeve onto the end portion of the first tubular member of FIG. 7*a*.

Referring to FIG. 7*a*, a first tubular member 910 includes an internally threaded connection 912 at an end portion 914 and a recessed portion 916 having a reduced outside diameter. As illustrated in FIG. 7*b*, a first end of a tubular sleeve 918 that includes annular sealing members, 920 and 922, at opposite ends, tapered portions, 924 and 926, at one end, and tapered portions, 928 and 930, at another end is then mounted upon and receives the end portion 914 of the first tubular member 910. In an exemplary embodiment, a resilient retaining ring 930 is positioned between the lower end of the tubular sleeve 918 and the recessed portion 916 of the first tubular member 910 in order to couple the tubular sleeve to the first tubular member. In an exemplary embodiment, the resilient retaining ring 930 is a split ring having a toothed surface in order to lock the tubular sleeve 918 in place.

Figure 7C:
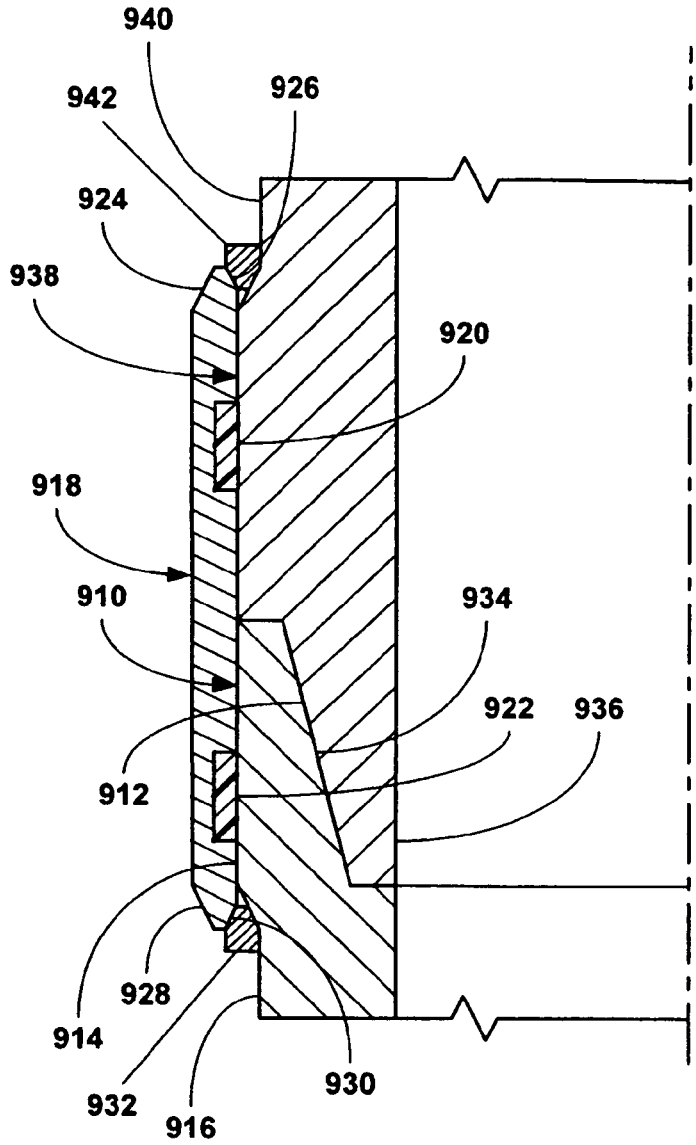
FIG. 7*c* is a fragmentary cross-sectional illustration of the coupling of an externally threaded connection at an end portion of a second tubular member to the internally threaded connection at the end portion of the first tubular member of FIG. 7*b*.

As illustrated in FIG. 7*c*, an externally threaded connection 934 of an end portion 936 of a second tubular member 938 having a recessed portion 940 having a reduced outside diameter is then positioned within the tubular sleeve 918 and threadably coupled to the internally threaded connection 912 of the end portion 914 of the first tubular member 910. In an exemplary embodiment, a resilient retaining ring 942 is positioned between the upper end of the tubular sleeve 918 and the recessed portion 940 of the second tubular member 938 in order to couple the tubular sleeve to the second tubular member. In an exemplary embodiment, the resilient retaining ring 942 is a split ring having a toothed surface in order to lock the tubular sleeve 918 in place.

In an exemplary embodiment, the internally threaded connection 912 of the end portion 914 of the first tubular member 910 is a box connection, and the externally threaded connection 934 of the end portion 936 of the second tubular member 938 is a pin connection. In an exemplary embodiment, the internal diameter of the tubular sleeve 918 is at least approximately 0.020" greater than the outside diameters of the end portions, 914 and 936, of the first and second tubular members, 910 and 938. In this manner, during the threaded coupling of the first and second tubular members, 910 and 938, fluidic materials within the first and second tubular members may be vented from the tubular members.

Figure 7D:
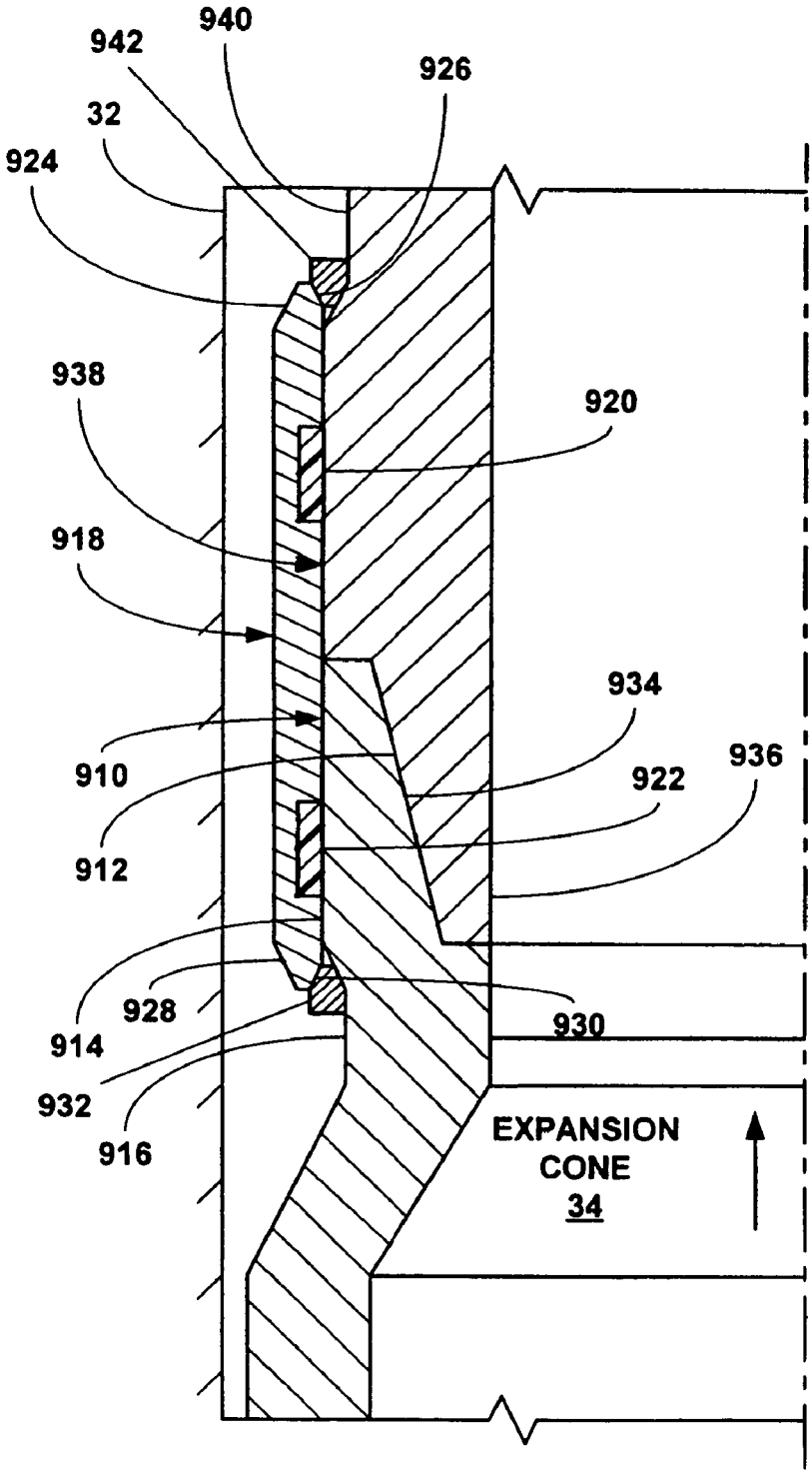
FIG. 7*d* is a fragmentary cross-sectional illustration of the radial expansion and plastic deformation of a portion of the first tubular member of FIG. 1 *c*.
Figure 7E:
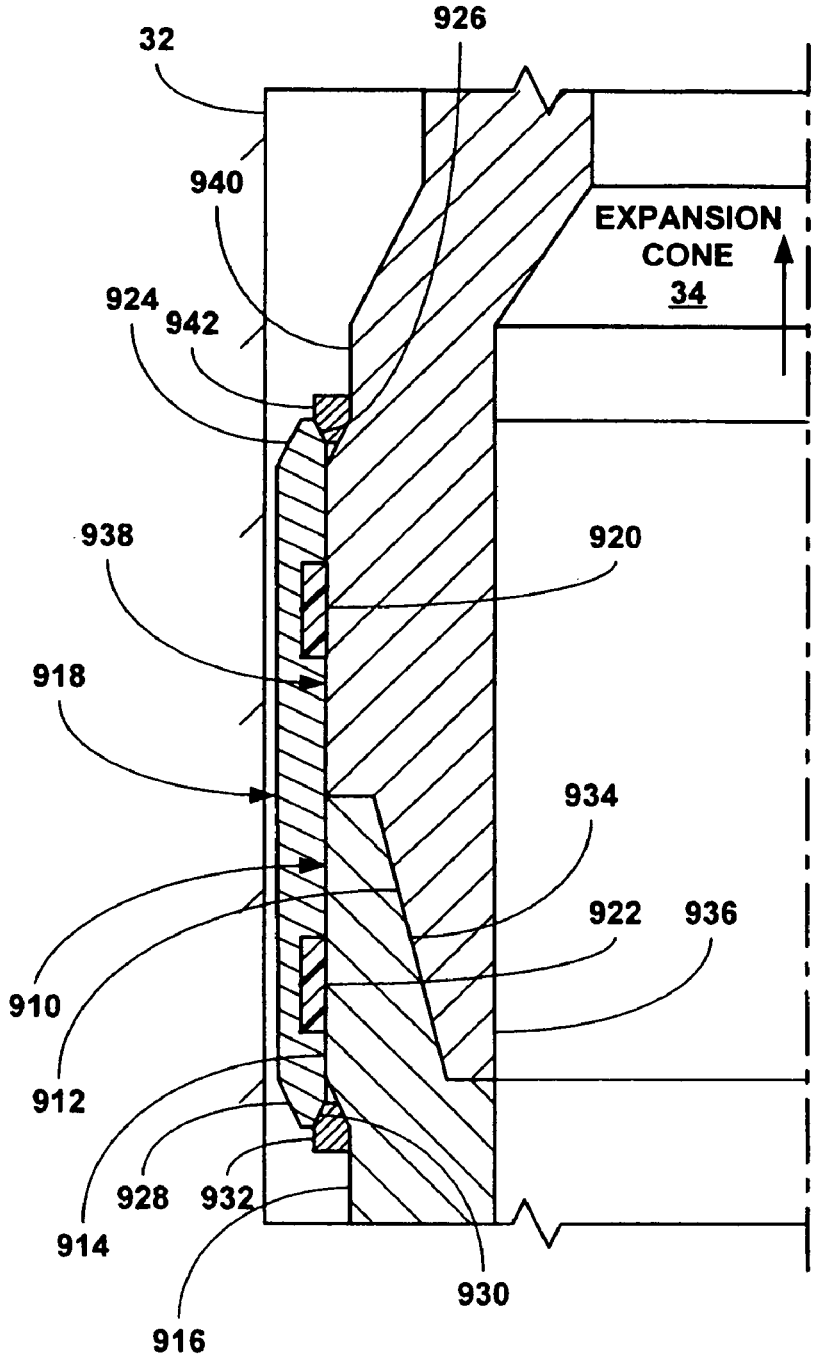
FIG. 7*e* is a fragmentary cross sectional of the continued radial expansion and plastic deformation of the threaded connection between the first and second tubular members and the tubular sleeve of FIG. 7*d*.

In an exemplary embodiment, as illustrated in FIGS. 7*d* and 7*e*, the first and second tubular members, 910 and 938, and the tubular sleeve 918 may then be positioned within another structure 32 such as, for example, a wellbore, and radially expanded and plastically deformed, for example, by moving an expansion cone 34 through the interiors of the first and second tubular members. The tapered portions, 924 and 928, of the tubular sleeve 918 facilitate the insertion and movement of the first and second tubular members within and through the structure 32, and the movement of the expansion cone 34 through the interiors of the first and second tubular members, 910 and 938, may be from top to bottom or from bottom to top.

In an exemplary embodiment, during the radial expansion and plastic deformation of the first and second tubular members, 910 and 938, the tubular sleeve 918 is also radially expanded and plastically deformed. In an exemplary embodiment, as a result, the tubular sleeve 918 may be maintained in circumferential tension and the end portions, 914 and 936, of the first and second tubular members, 910 and 938, may be maintained in circumferential compression.

The use of the tubular sleeve 918 during (a) the coupling of the first tubular member 910 to the second tubular member 938, (b) the placement of the first and second tubular members in the structure 32, and (c) the radial expansion and plastic deformation of the first and second tubular members provides a number of significant benefits. For example, the tubular sleeve 918 protects the exterior surfaces of the end portions, 914 and 936, of the first and second tubular members, 910 and 938, during handling and insertion of the tubular members within the structure 32. In this manner, damage to the exterior surfaces of the end portions, 914 and 936, of the first and second tubular member, 910 and 938, are prevented that could result in stress concentrations that could result in a catastrophic failure during subsequent radial expansion operations. Furthermore, the tubular sleeve 918 provides an alignment guide that facilitates the insertion and threaded coupling of the second tubular member 938 to the first tubular member 910. In this manner, misalignment that could result in damage to the threaded connections, 912 and 934, of the first and second tubular members, 910 and 938, may be avoided. Furthermore, the tubular sleeve 918 may prevent crack propagation during the radial expansion and plastic deformation of the first and second tubular members, 910 and 938. In this manner, failure modes such as, for example, longitudinal cracks in the end portions, 914 and 936, of the first and second tubular members may be limited in severity or eliminated all together. In addition, after completing the radial expansion and plastic deformation of the first and second tubular members, 910 and 938, the tubular sleeve 918 may provide a fluid tight metal-to-metal seal between interior surface of the tubular sleeve and the exterior surfaces of the end portions, 914 and 936, of the first and second tubular members. In this manner, fluidic materials are prevented from passing through the threaded connections, 912 and 934, of the first and second tubular members, 910 and 938, into the annulus between the first and second tubular members and the structure 32. Furthermore, because, following the radial expansion and plastic deformation of the first and second tubular members, 910 and 938, the tubular sleeve 918 may be maintained in circumferential tension and the end portions, 914 and 936, of the first and second tubular members, 910 and 938, may be maintained in circumferential compression, axial loads and/or torque loads may be transmitted through the tubular sleeve. In addition, the annular sealing members, 920 and 922, of the tubular sleeve 918 may provide a fluid tight seal between the tubular sleeve and the end portions, 914 and 936, of the first and second tubular members, 910 and 938.

Figure 8A:
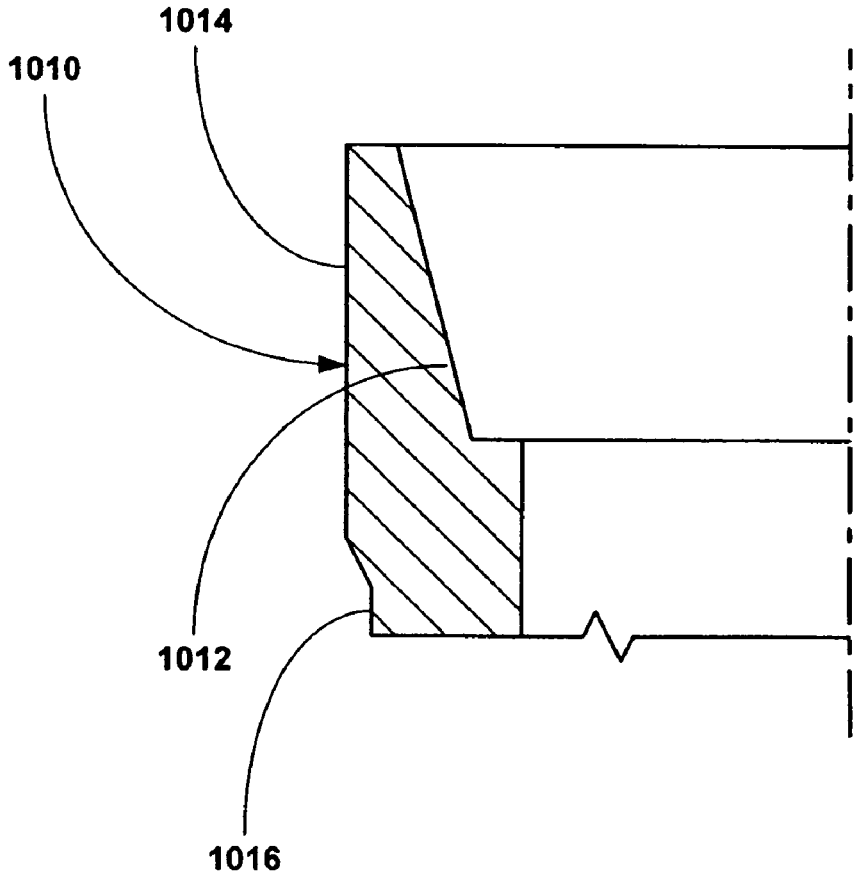
FIG. 8*a* is a fragmentary cross-sectional illustration of a first tubular member having an internally threaded connection at an end portion.
Figure 8B:
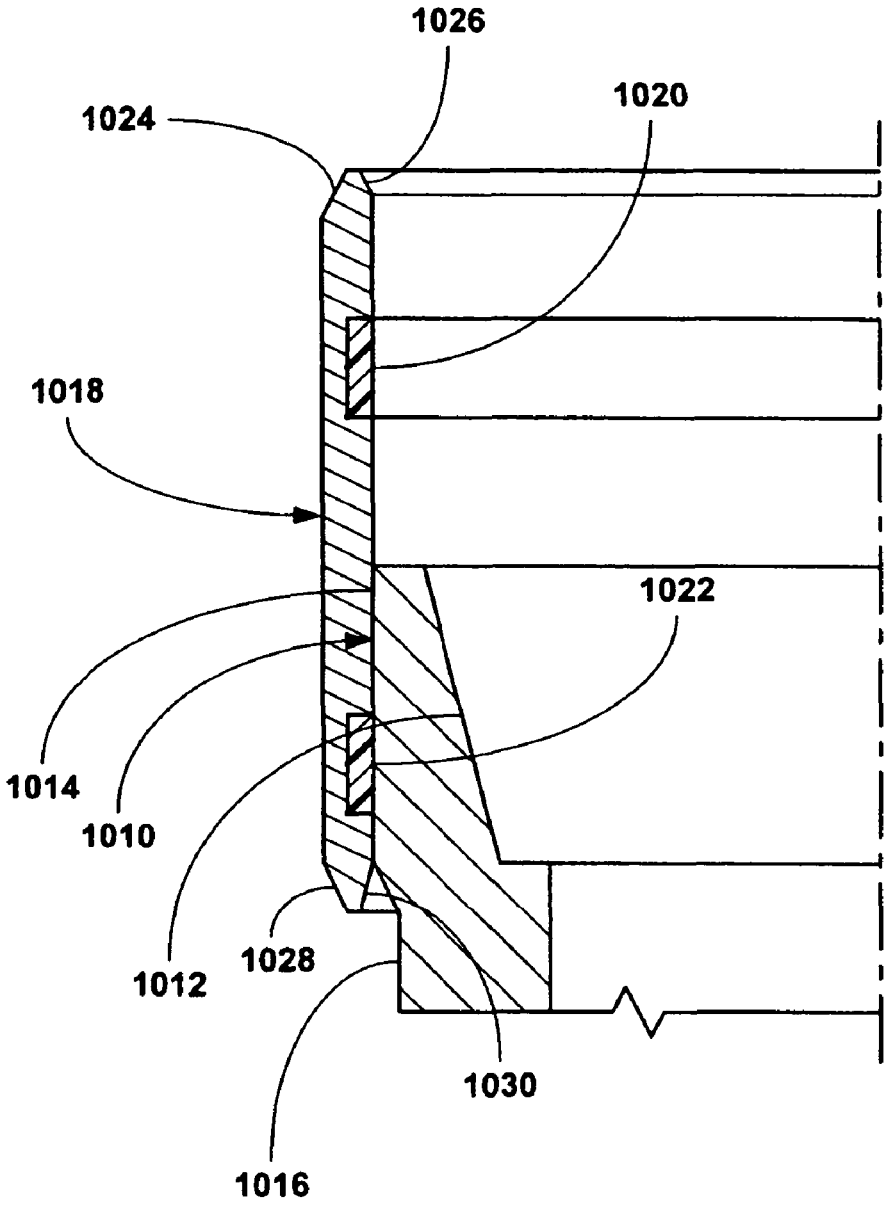
FIG. 8*b* is a fragmentary cross-sectional illustration of the placement of an alternative embodiment of a tubular sleeve onto the end portion of the first tubular member of FIG. 8*a*.
Figure 8C:
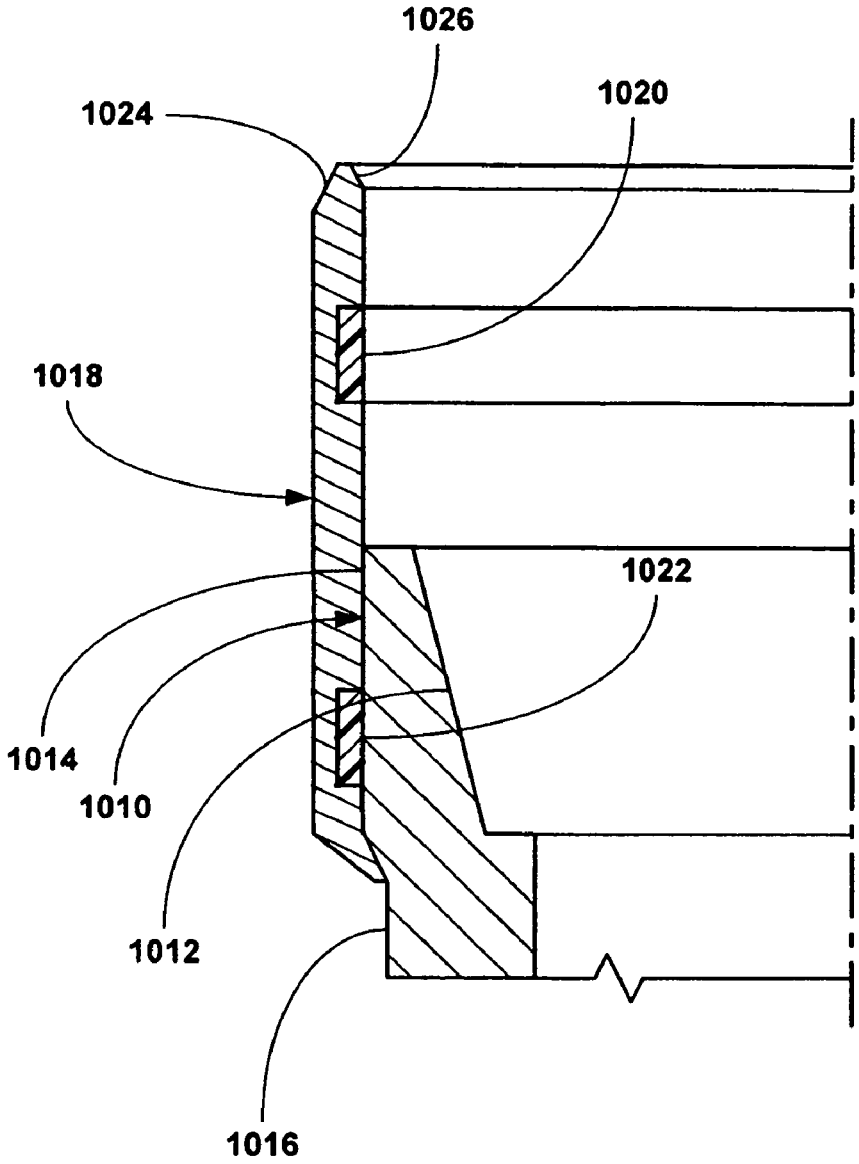
FIG. 8*c* is a fragmentary cross-sectional illustration of the coupling of the tubular sleeve of FIG. 8*b* to the end portion of the first tubular member.

Referring to FIG. 8*a*, a first tubular member 1010 includes an internally threaded connection 1012 at an end portion 1014 and a recessed portion 1016 having a reduced outside diameter. As illustrated in FIG. 8*b*, a first end of a tubular sleeve 1018 that includes annular sealing members, 1020 and 1022, at opposite ends, tapered portions, 1024 and 1026, at one end, and tapered portions, 1028 and 1030, at another end is then mounted upon and receives the end portion 1014 of the first tubular member 1010. In an exemplary embodiment, as illustrated in FIG. 8*c*, the end of the tubular sleeve 1018 is then crimped onto the recessed portion 1016 of the first tubular member 1010 in order to couple the tubular sleeve to the first tubular member.

Figure 8D:
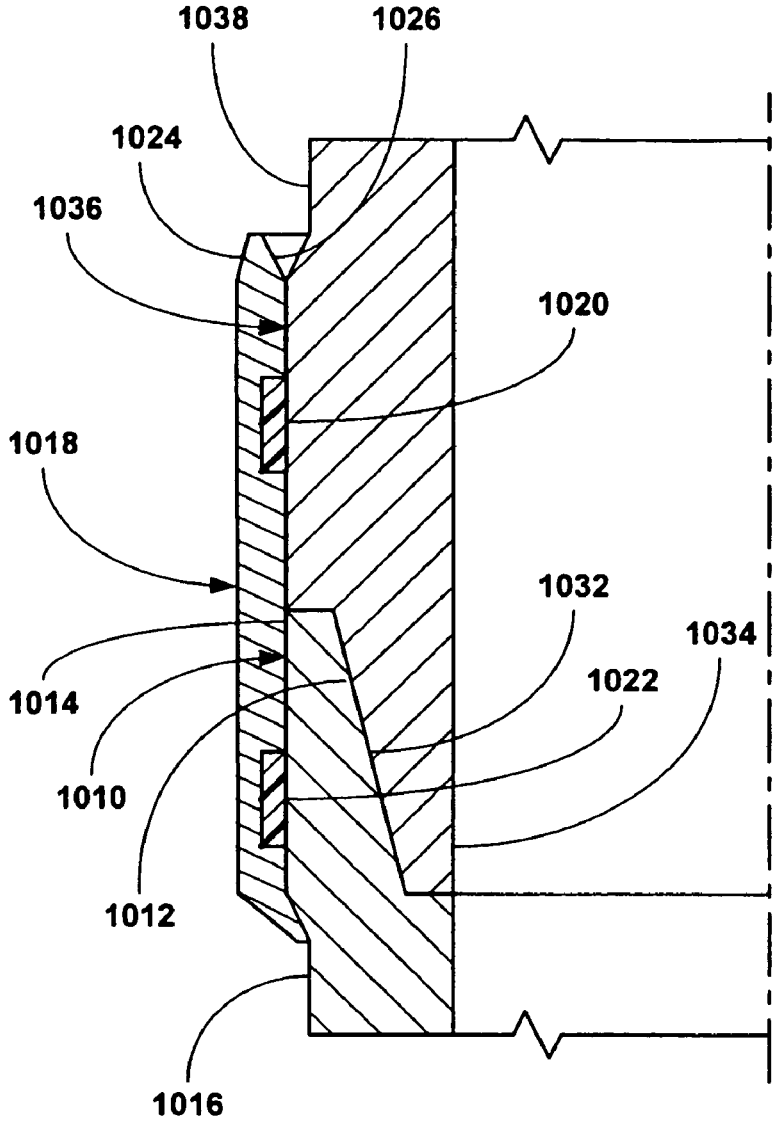
FIG. 8*d* is a fragmentary cross-sectional illustration of the coupling of an externally threaded connection at an end portion of a second tubular member to the internally threaded connection at the end portion of the first tubular member of FIG. 8*b*.
Figure 8E:
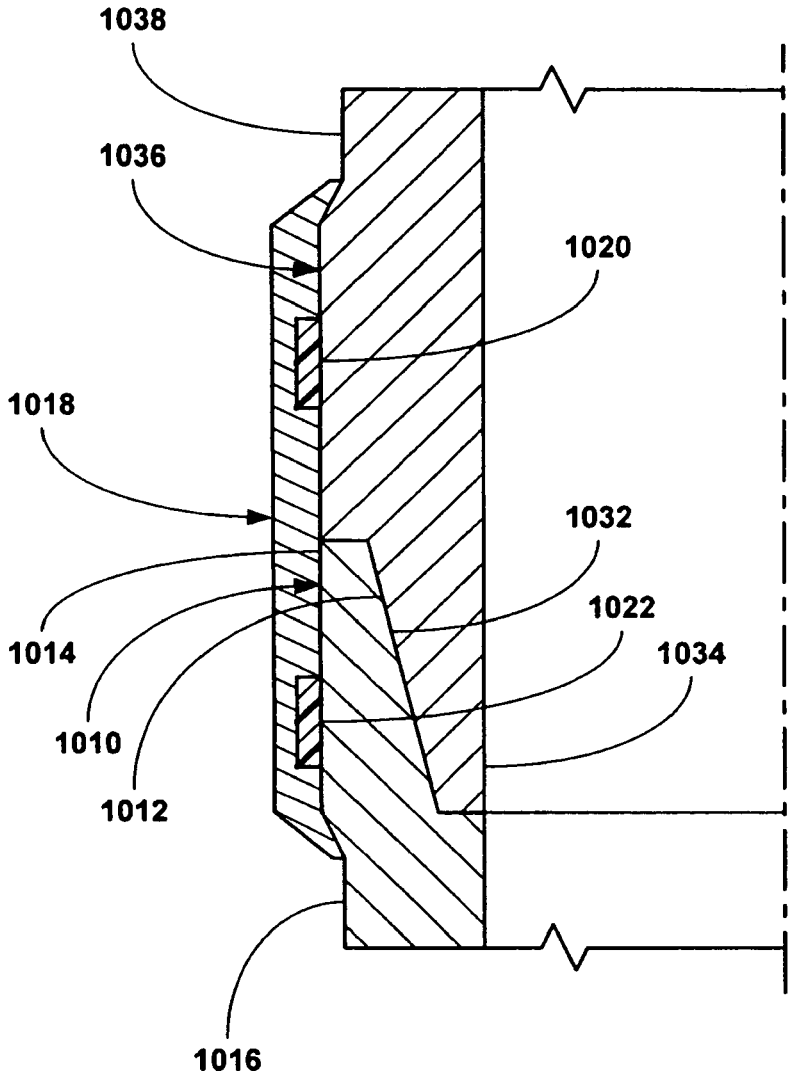
FIG. 8*e* is a fragmentary cross-sectional illustration of the coupling of the tubular sleeve of FIG. 8*d* to the end portion of the second tubular member.

As illustrated in FIG. 8*d*, an externally threaded connection 1032 of an end portion 1034 of a second tubular member 1036 having a recessed portion 1038 having a reduced external diameter is then positioned within the tubular sleeve 1018 and threadably coupled to the internally threaded connection 1012 of the end portion 1014 of the first tubular member 1010. In an exemplary embodiment, as illustrated in FIG. 8*e*, the other end of the tubular sleeve 1018 is then crimped into the recessed portion 1038 of the second tubular member 1036 in order to couple the tubular sleeve to the second tubular member.

In an exemplary embodiment, the internally threaded connection 1012 of the end portion 1014 of the first tubular member 1010 is a box connection, and the externally threaded connection 1032 of the end portion 1034 of the second tubular member 1036 is a pin connection. In an exemplary embodiment, the internal diameter of the tubular sleeve 1018 is at least approximately 0.020" greater than the outside diameters of the end portions, 1014 and 1034, of the first and second tubular members, 1010 and 1036. In this manner, during the threaded coupling of the first and second tubular members, 1010 and 1036, fluidic materials within the first and second tubular members may be vented from the tubular members.

Figure 8F:
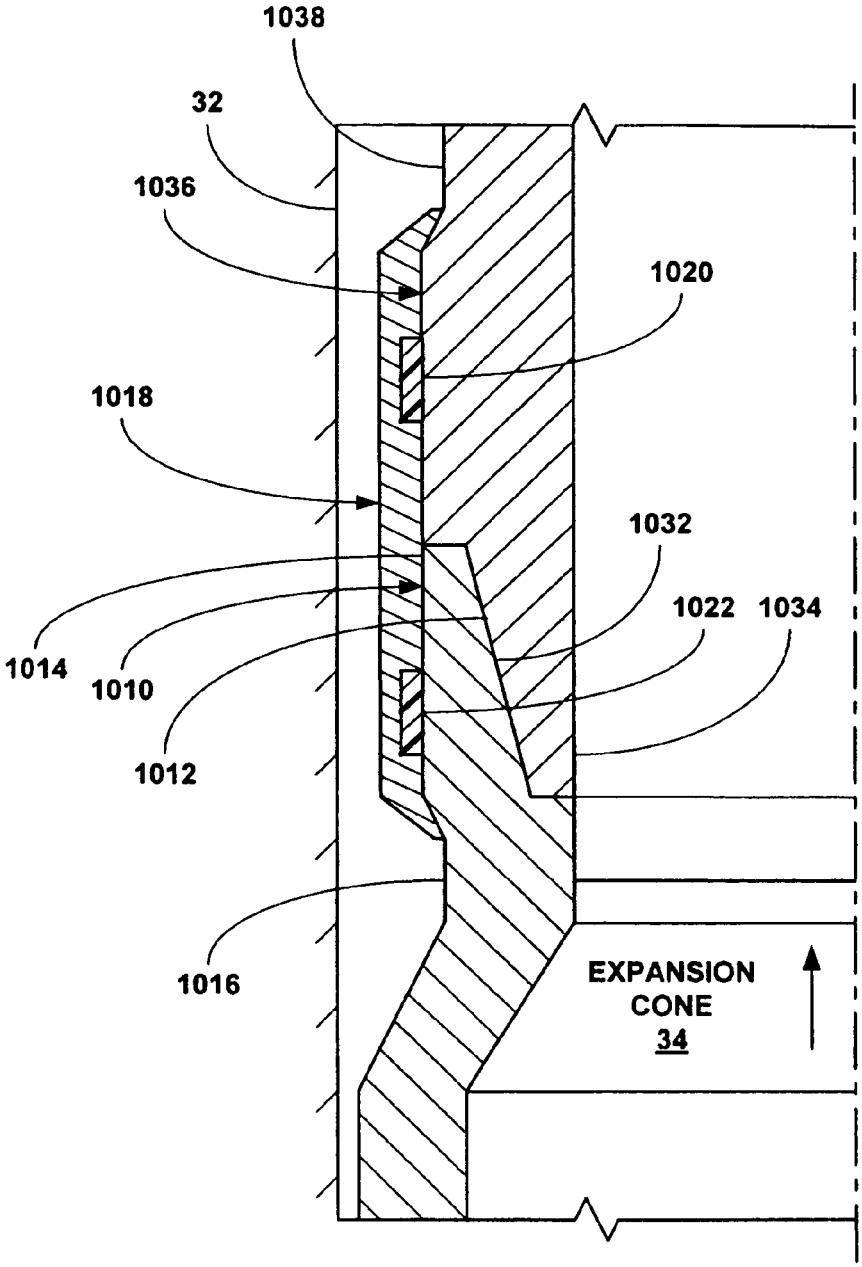
FIG. 8*f* is a fragmentary cross-sectional illustration of the radial expansion and plastic deformation of a portion of the first tubular member of FIG. 8*e*.
Figure 8G:
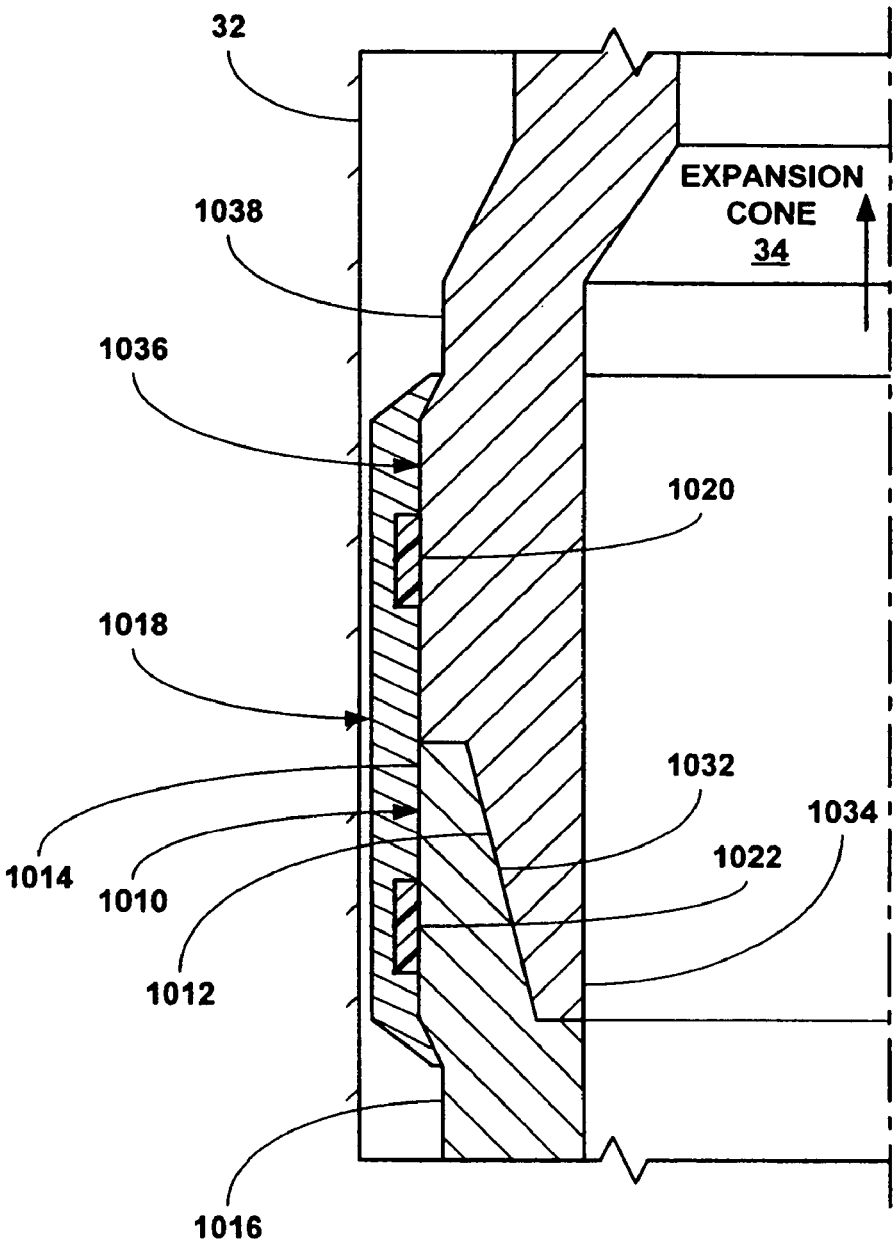
FIG. 8*g* is a fragmentary cross sectional of the continued radial expansion and plastic deformation of the threaded connection between the first and second tubular members and the tubular sleeve of FIG. 8*f*.

In an exemplary embodiment, as illustrated in FIGS. 8*f* and 8*g*, the first and second tubular members, 1010 and 1036, and the tubular sleeve 1018 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1010 and 1036, may be from top to bottom or from bottom to top.

In an exemplary embodiment, during the radial expansion and plastic deformation of the first and second tubular members, 1010 and 1036, the tubular sleeve 1018 is also radially expanded and plastically deformed. In an exemplary embodiment, as a result, the tubular sleeve 1018 may be maintained in circumferential tension and the end portions, 1014 and 1034, of the first and second tubular members, 1010 and 1036, may be maintained in circumferential compression.

The use of the tubular sleeve 1018 during (a) the coupling of the first tubular member 1010 to the second tubular member 1036, (b) the placement of the first and second tubular members in the structure 32, and (c) the radial expansion and plastic deformation of the first and second tubular members provides a number of significant benefits. For example, the tubular sleeve 1018 protects the exterior surfaces of the end portions, 1014 and 1034, of the first and second tubular members, 1010 and 1036, during handling and insertion of the tubular members within the structure 32. In this manner, damage to the exterior surfaces of the end portions, 1014 and 1034, of the first and second tubular members, 1010 and 1036, are prevented that could result in stress concentrations that could result in a catastrophic failure during subsequent radial expansion operations. Furthermore, the tubular sleeve 1018 provides an alignment guide that facilitates the insertion and threaded coupling of the second tubular member 1036 to the first tubular member 1010. In this manner, misalignment that could result in damage to the threaded connections, 1012 and 1032, of the first and second tubular members, 1010 and 1036, may be avoided. Furthermore, the tubular sleeve 1018 may prevent crack propagation during the radial expansion and plastic deformation of the first and second tubular members, 1010 and 1036. In this manner, failure modes such as, for example, longitudinal cracks in the end portions, 1014 and 1034, of the first and second tubular members may be limited in severity or eliminated all together. In addition, after completing the radial expansion and plastic deformation of the first and second tubular members, 1010 and 1036, the tubular sleeve 1018 may provide a fluid tight metal-to-metal seal between interior surface of the tubular sleeve and the exterior surfaces of the end portions, 1014 and 1034, of the first and second tubular members. In this manner, fluidic materials are prevented from passing through the threaded connections, 1012 and 1032, of the first and second tubular members, 1010 and 1036, into the annulus between the first and second tubular members and the structure 32. Furthermore, because, following the radial expansion and plastic deformation of the first and second tubular members, 1010 and 1036, the tubular sleeve 1018 may be maintained in circumferential tension and the end portions, 1014 and 1034, of the first and second tubular members, 1010 and 1036, may be maintained in circumferential compression, axial loads and/or torque loads may be transmitted through the tubular sleeve. In addition, the annular sealing members, 1020 and 1022, of the tubular sleeve 1018 may provide a fluid tight seal between the tubular sleeve and the end portions, 1014 and 1034, of the first and second tubular members, 1010 and 1036.

Figure 9A:
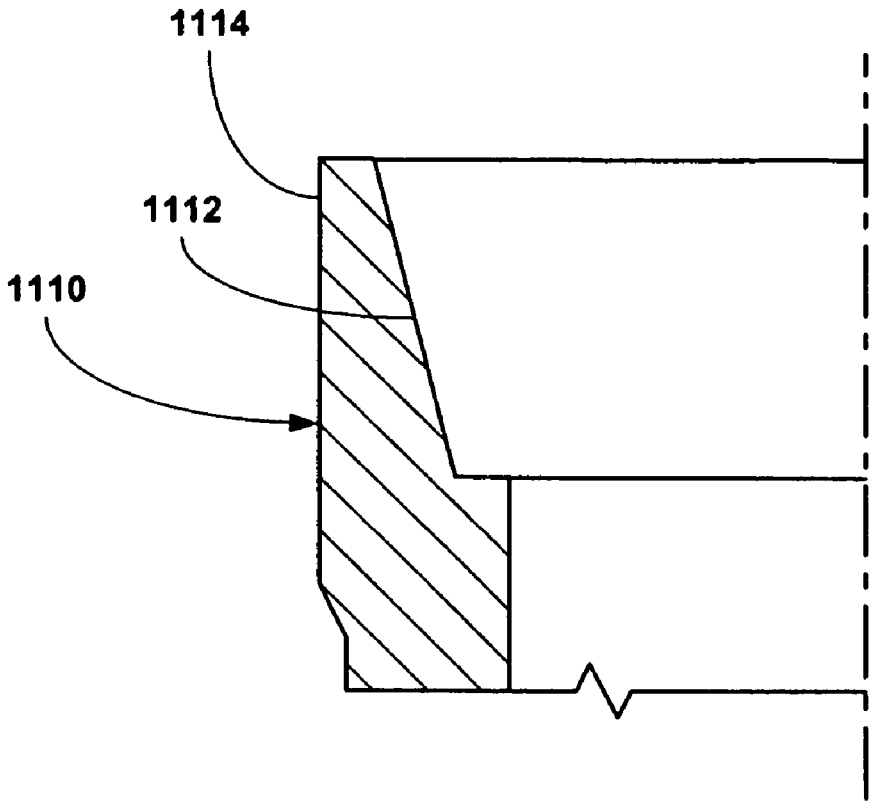
FIG. 9*a* is a fragmentary cross-sectional illustration of a first tubular member having an internally threaded connection at an end portion.
Figure 9B:
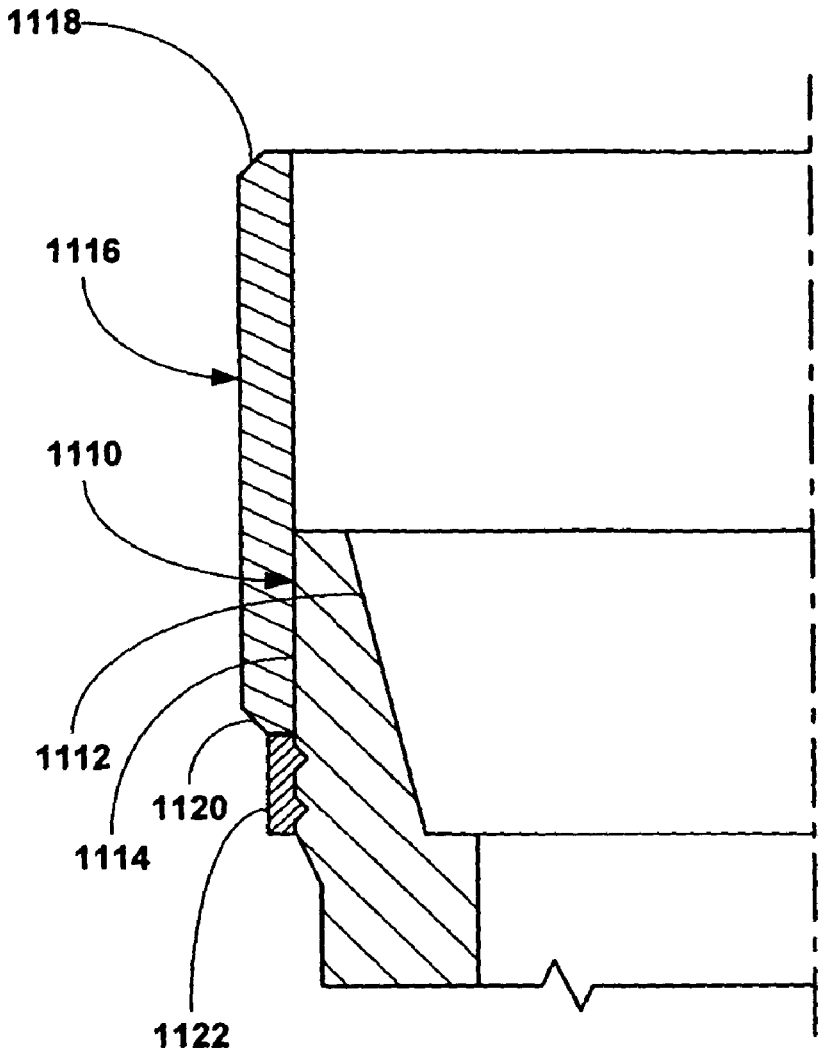
FIG. 9*b* is a fragmentary cross-sectional illustration of the placement of an alternative embodiment of a tubular sleeve onto the end portion of the first tubular member of FIG. 9*a*.

Referring to FIG. 9*a*, a first tubular member 1110 includes an internally threaded connection 1112 at an end portion 1114. As illustrated in FIG. 9*b*, a first end of a tubular sleeve 1116 having tapered portions, 1118 and 1120, at opposite ends, is then mounted upon and receives the end portion 1114 of the first tubular member 1110. In an exemplary embodiment, a toothed resilient retaining ring 1122 is then attached to first tubular member 1010 below the end of the tubular sleeve 1116 in order to couple the tubular sleeve to the first tubular member.

Figure 9C:
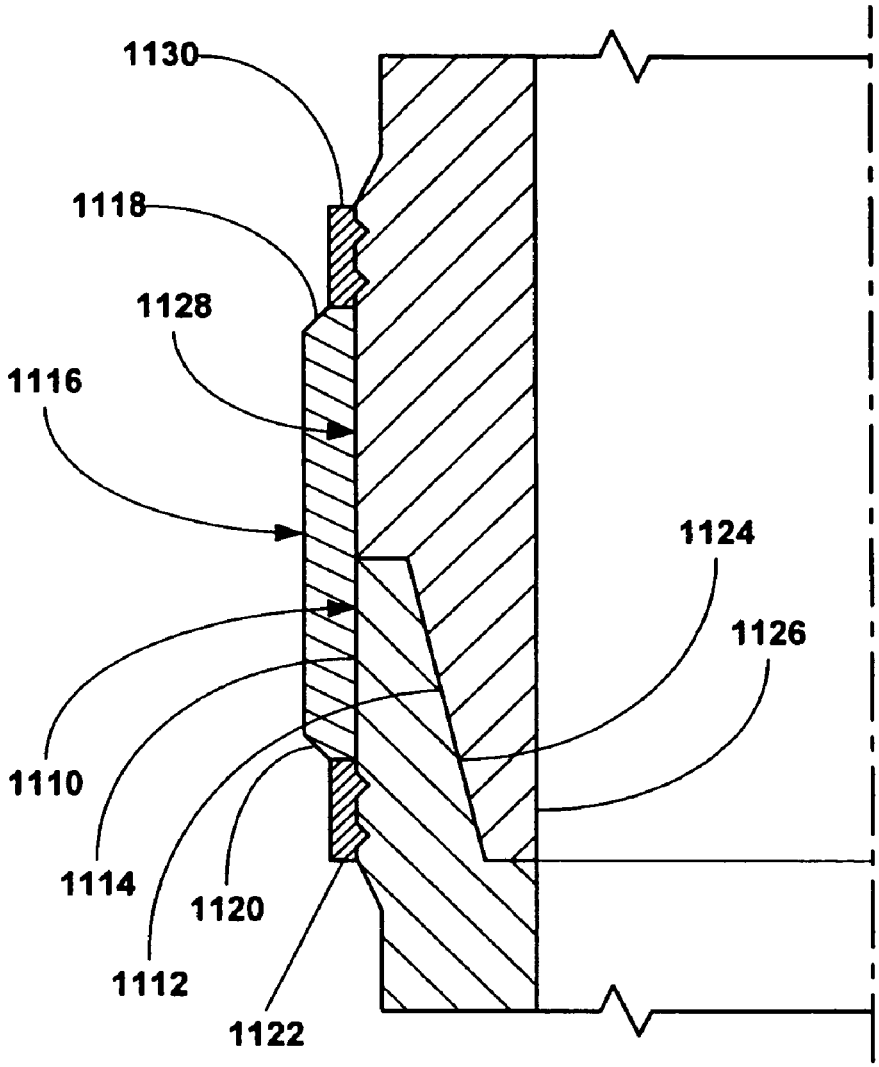
FIG. 9*c* is a fragmentary cross-sectional illustration of the coupling of an externally threaded connection at an end portion of a second tubular member to the internally threaded connection at the end portion of the first tubular member of FIG. 9*b*.

As illustrated in FIG. 9*c*, an externally threaded connection 1124 of an end portion 1126 of a second tubular member 1128 is then positioned within the tubular sleeve 1116 and threadably coupled to the internally threaded connection 1112 of the end portion 1114 of the first tubular member 1110. In an exemplary embodiment, a toothed resilient retaining ring 1130 is then attached to second tubular member 1128 above the end of the tubular sleeve 1116 in order to couple the tubular sleeve to the second tubular member.

In an exemplary embodiment, the internally threaded connection 1112 of the end portion 1114 of the first tubular member 1110 is a box connection, and the externally threaded connection 1124 of the end portion 1126 of the second tubular member 1128 is a pin connection. In an exemplary embodiment, the internal diameter of the tubular sleeve 1116 is at least approximately 0.020" greater than the outside diameters of the end portions, 1114 and 1126, of the first and second tubular members, 1110 and 1128. In this manner, during the threaded coupling of the first and second tubular members, 1110 and 1128, fluidic materials within the first and second tubular members may be vented from the tubular members.

Figure 9D:
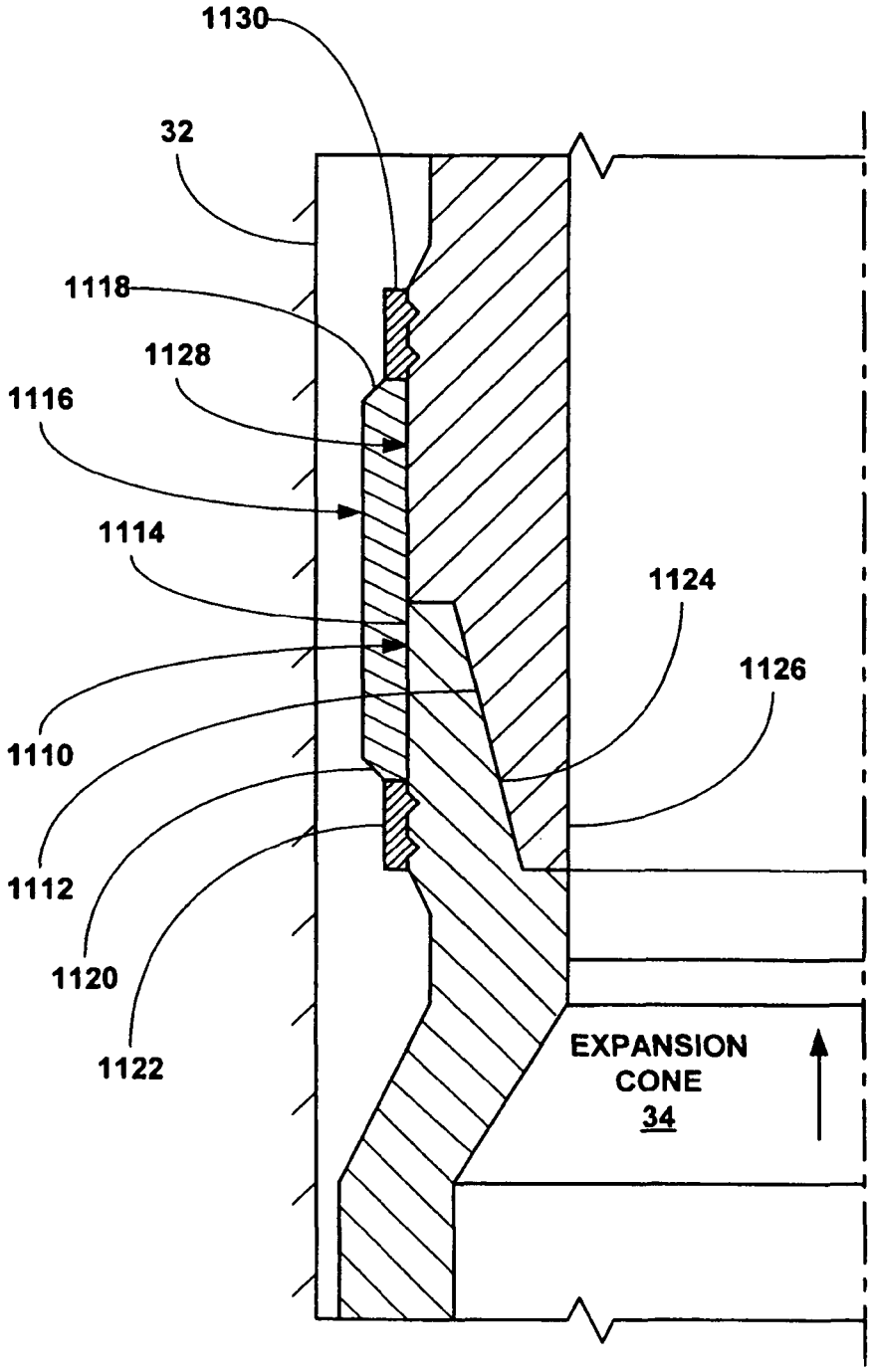
FIG. 9*d* is a fragmentary cross-sectional illustration of the radial expansion and plastic deformation of a portion of the first tubular member of FIG. 9*c*.
Figure 9E:
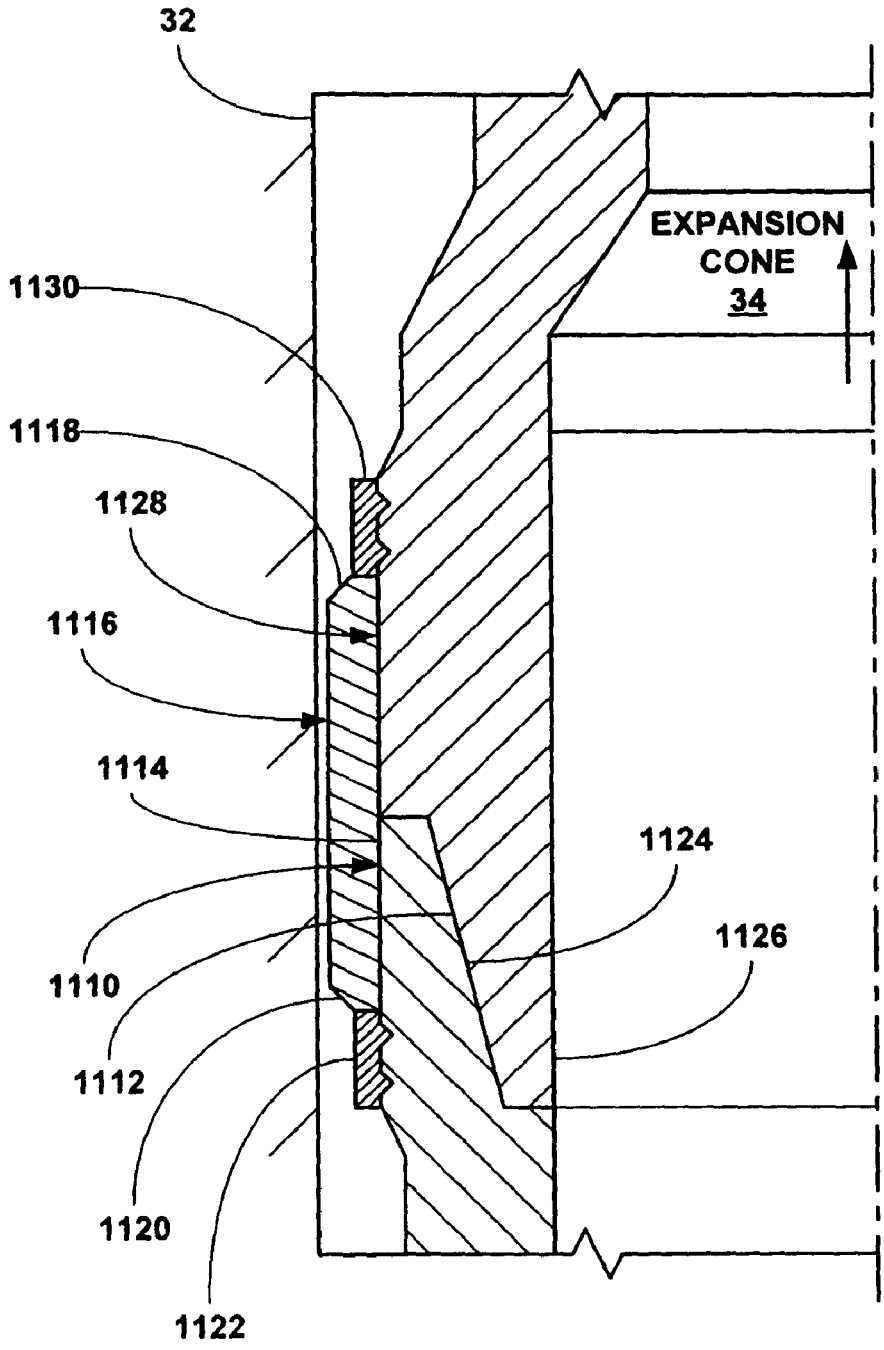
FIG. 9*e* is a fragmentary cross sectional of the continued radial expansion and plastic deformation of the threaded connection between the first and second tubular members and the tubular sleeve of FIG. 9*d*.

In an exemplary embodiment, as illustrated in FIGS. 9*d* and 9*e*, the first and second tubular members, 1110 and 1128, and the tubular sleeve 1116 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1110 and 1128, may be from top to bottom or from bottom to top.

In an exemplary embodiment, during the radial expansion and plastic deformation of the first and second tubular members, 1110 and 1128, the tubular sleeve 1116 is also radially expanded and plastically deformed. In an exemplary embodiment, as a result, the tubular sleeve 1116 may be maintained in circumferential tension and the end portions, 1114 and 1126, of the first and second tubular members, 1110 and 1128, may be maintained in circumferential compression.

The use of the tubular sleeve 1116 during (a) the coupling of the first tubular member 1110 to the second tubular member 1128, (b) the placement of the first and second tubular members in the structure 32, and (c) the radial expansion and plastic deformation of the first and second tubular members provides a number of significant benefits. For example, the tubular sleeve 1116 protects the exterior surfaces of the end portions, 1114 and 1126, of the first and second tubular members, 1110 and 1128, during handling and insertion of the tubular members within the structure 32. In this manner, damage to the exterior surfaces of the end portions, 1114 and 1126, of the first and second tubular members, 1110 and 1128, are prevented that could result in stress concentrations that could result in a catastrophic failure during subsequent radial expansion operations. Furthermore, the tubular sleeve 1116 provides an alignment guide that facilitates the insertion and threaded coupling of the second tubular member 1128 to the first tubular member 1110. In this manner, misalignment that could result in damage to the threaded connections, 1112 and 1124, of the first and second tubular members, 1110 and 1128, may be avoided. Furthermore, the tubular sleeve 1116 may prevent crack propagation during the radial expansion and plastic deformation of the first and second tubular members, 1110 and 1128. In this manner, failure modes such as, for example, longitudinal cracks in the end portions, 1114 and 1126, of the first and second tubular members may be limited in severity or eliminated all together. In addition, after completing the radial expansion and plastic deformation of the first and second tubular members, 1110 and 1128, the tubular sleeve 1116 may provide a fluid tight metal-to-metal seal between interior surface of the tubular sleeve and the exterior surfaces of the end portions, 1114 and 1128, of the first and second tubular members. In this manner, fluidic materials are prevented from passing through the threaded connections, 1112 and 1124, of the first and second tubular members, 1110 and 1128, into the annulus between the first and second tubular members and the structure 32. Furthermore, because, following the radial expansion and plastic deformation of the first and second tubular members, 1110 and 1128, the tubular sleeve 1116 may be maintained in circumferential tension and the end portions, 1114 and 1126, of the first and second tubular members, 1110 and 1128, may be maintained in circumferential compression, axial loads and/or torque loads may be transmitted through the tubular sleeve.

Figure 10A:
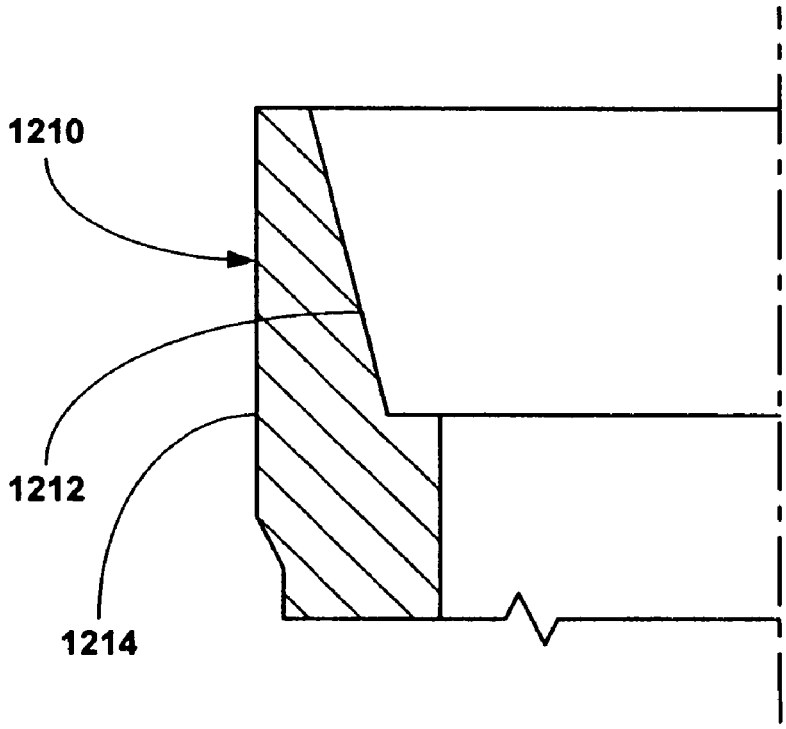
FIG. 10*a* is a fragmentary cross-sectional illustration of a first tubular member having an internally threaded connection at an end portion.
Figure 10B:
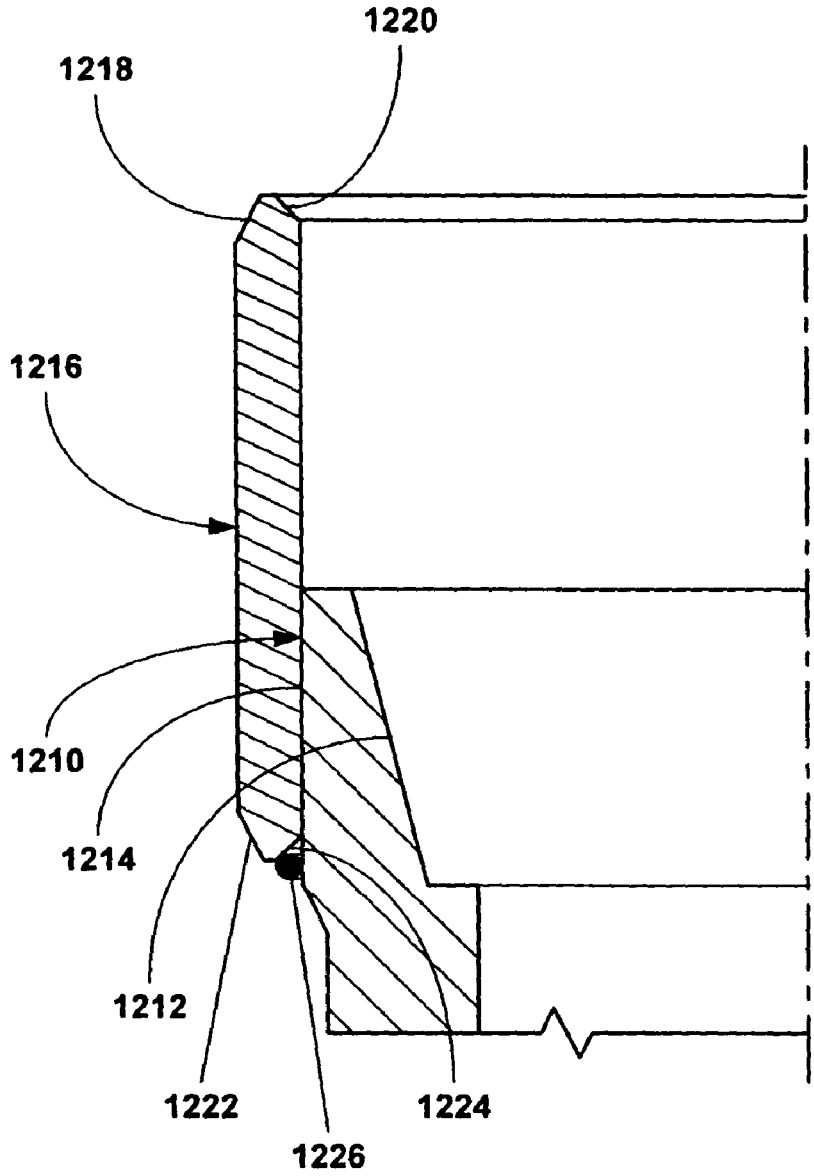
FIG. 10*b* is a fragmentary cross-sectional illustration of the placement of an alternative embodiment of a tubular sleeve onto the end portion of the first tubular member of FIG. 10*a*.

Referring to FIG. 10*a*, a first tubular member 1210 includes an internally threaded connection 1212 at an end portion 1214. As illustrated in FIG. 10*b*, a first end of a tubular sleeve 1216 having tapered portions, 1218 and 1220, at one end and tapered portions, 1222 and 1224, at another end, is then mounted upon and receives the end portion 1114 of the first tubular member 1110. In an exemplary embodiment, a resilient elastomeric O-ring 1226 is then positioned on the first tubular member 1210 below the tapered portion 1224 of the tubular sleeve 1216 in order to couple the tubular sleeve to the first tubular member.

Figure 10C:
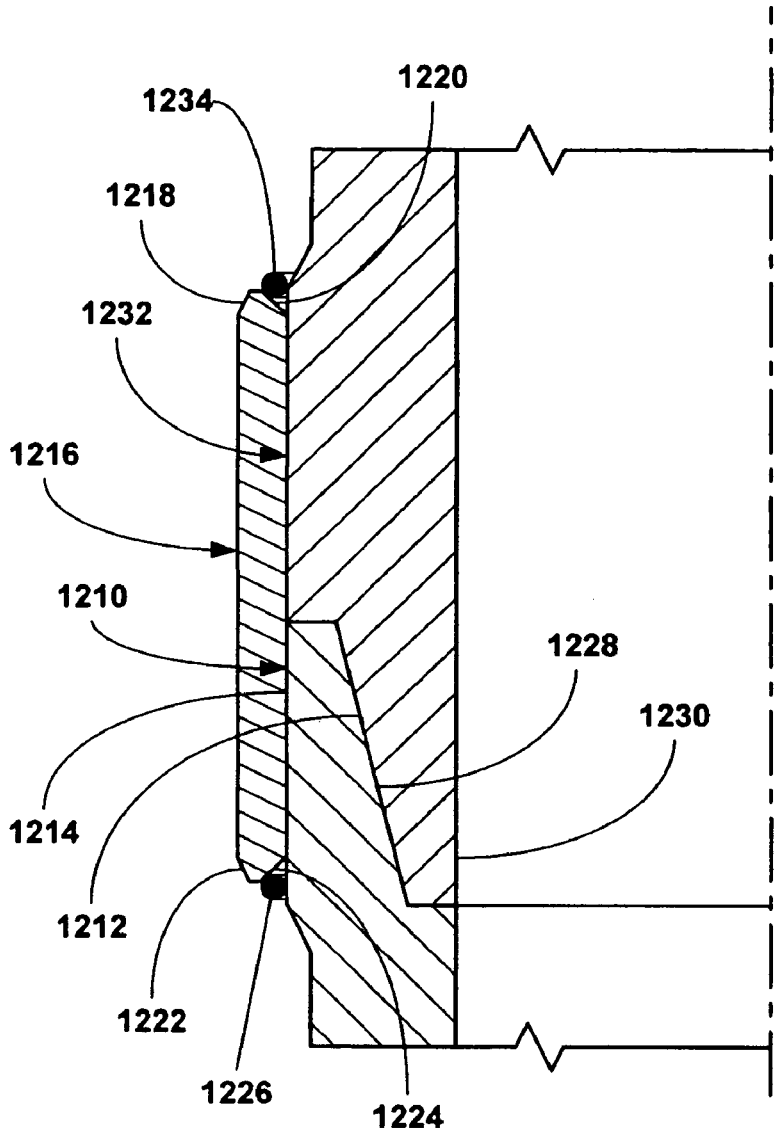
FIG. 10*c* is a fragmentary cross-sectional illustration of the coupling of an externally threaded connection at an end portion of a second tubular member to the internally threaded connection at the end portion of the first tubular member of FIG. 10*b*.

As illustrated in FIG. 10*c*, an externally threaded connection 1228 of an end portion 1230 of a second tubular member 1232 is then positioned within the tubular sleeve 1216 and threadably coupled to the internally threaded connection 1212 of the end portion 1214 of the first tubular member 1210. In an exemplary embodiment, a resilient elastomeric O-ring 1234 is then positioned on the second tubular member 1232 below the tapered portion 1220 of the tubular sleeve 1216 in order to couple the tubular sleeve to the first tubular member.

In an exemplary embodiment, the internally threaded connection 1212 of the end portion 1214 of the first tubular member 1210 is a box connection, and the externally threaded connection 1228 of the end portion 1230 of the second tubular member 1232 is a pin connection. In an exemplary embodiment, the internal diameter of the tubular sleeve 1216 is at least approximately 0.020" greater than the outside diameters of the end portions, 1214 and 1230, of the first and second tubular members, 1210 and 1232. In this manner, during the threaded coupling of the first and second tubular members,

1210 and 1232, fluidic materials within the first and second tubular members may be vented from the tubular members.

Figure 10D:
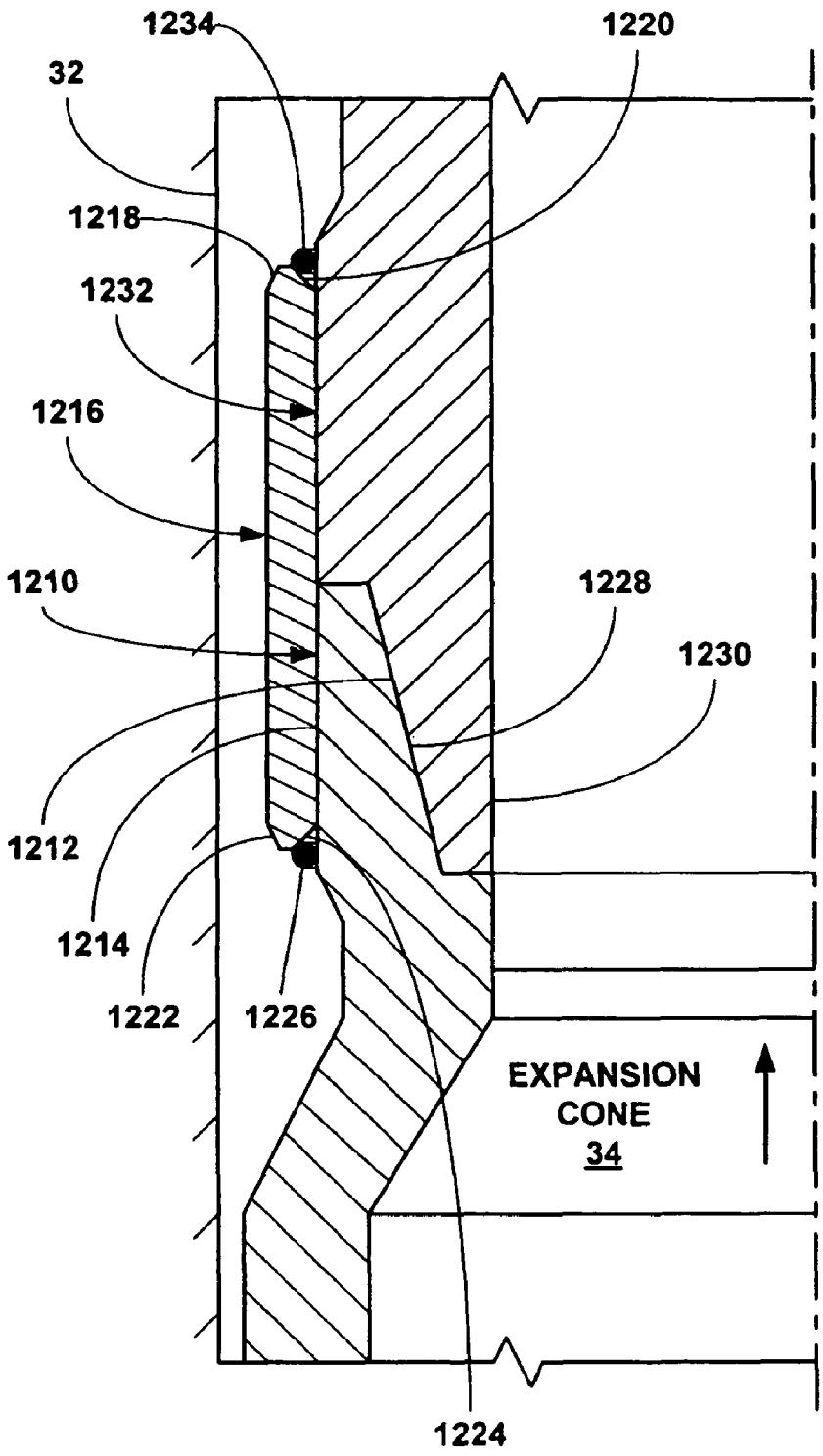
FIG. 10*d* is a fragmentary cross-sectional illustration of the radial expansion and plastic deformation of a portion of the first tubular member of FIG. 10*c*.
Figure 10E:
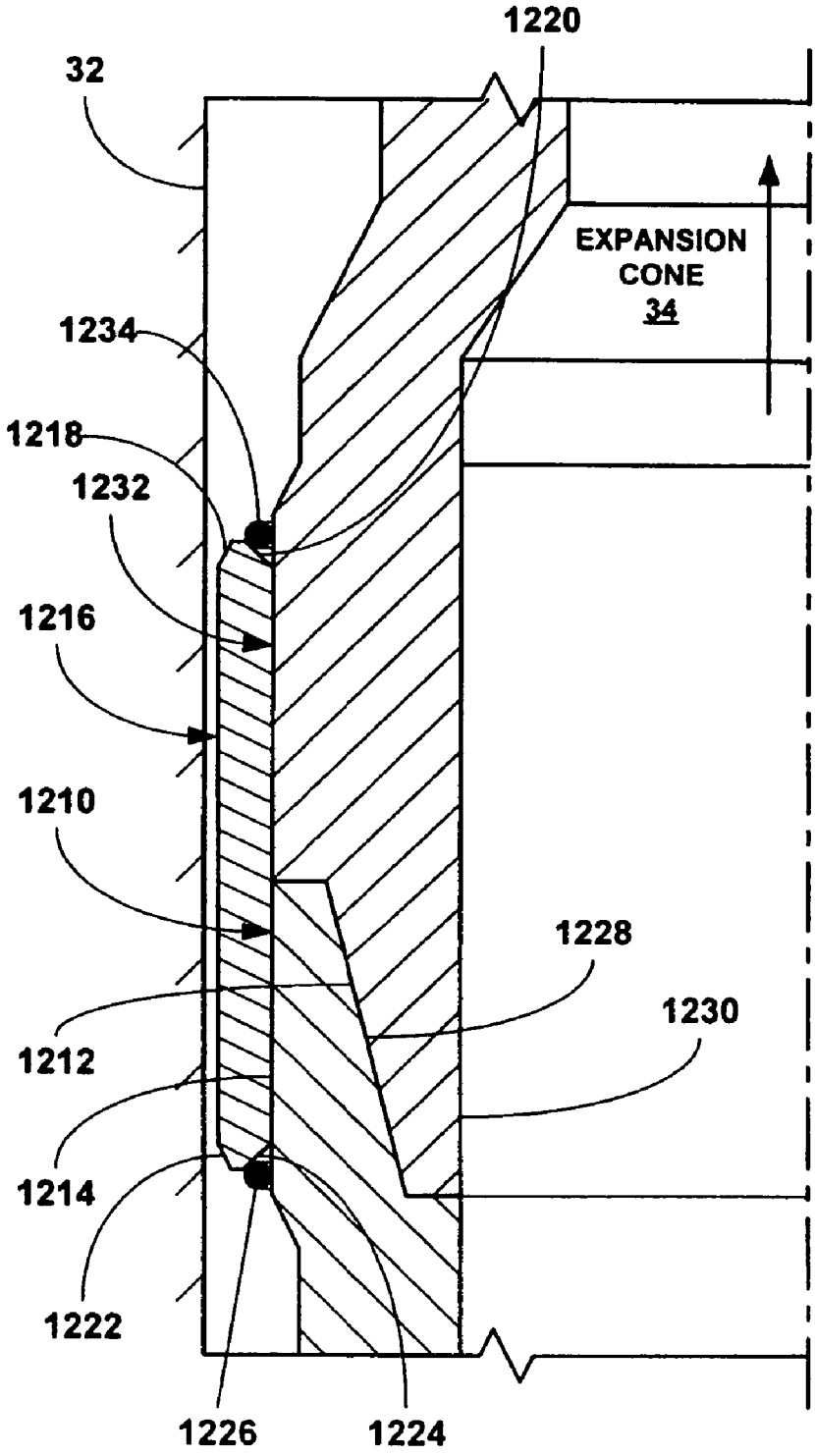
FIG. 10*e* is a fragmentary cross sectional of the continued radial expansion and plastic deformation of the threaded connection between the first and second tubular members and the tubular sleeve of FIG. 10*d*.

In an exemplary embodiment, as illustrated in FIGS. 10*d* and 10*e*, the first and second tubular members, 1210 and 1232, and the tubular sleeve 1216 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1210 and 1232, may be from top to bottom or from bottom to top.

In an exemplary embodiment, during the radial expansion and plastic deformation of the first and second tubular members, 1210 and 1232, the tubular sleeve 1216 is also radially expanded and plastically deformed. In an exemplary embodiment, as a result, the tubular sleeve 1216 may be maintained in circumferential tension and the end portions, 1214 and 1230, of the first and second tubular members, 1210 and 1232, may be maintained in circumferential compression.

The use of the tubular sleeve 1216 during (a) the coupling of the first tubular member 1210 to the second tubular member 1232, (b) the placement of the first and second tubular members in the structure 32, and (c) the radial expansion and plastic deformation of the first and second tubular members provides a number of significant benefits. For example, the tubular sleeve 1216 protects the exterior surfaces of the end portions, 1214 and 1230, of the first and second tubular members, 1210 and 1232, during handling and insertion of the tubular members within the structure 32. In this manner, damage to the exterior surfaces of the end portions, 1214 and 1230, of the first and second tubular members, 1210 and 1232, are prevented that could result in stress concentrations that could result in a catastrophic failure during subsequent radial expansion operations. Furthermore, the tubular sleeve 1216 provides an alignment guide that facilitates the insertion and threaded coupling of the second tubular member 1232 to the first tubular member 1210. In this manner, misalignment that could result in damage to the threaded connections, 1212 and 1228, of the first and second tubular members, 1210 and 1232, may be avoided. Furthermore, the tubular sleeve 1216 may prevent crack propagation during the radial expansion and plastic deformation of the first and second tubular members, 1210 and 1232. In this manner, failure modes such as, for example, longitudinal cracks in the end portions, 1214 and 1230, of the first and second tubular members may be limited in severity or eliminated all together. In addition, after completing the radial expansion and plastic deformation of the first and second tubular members, 1210 and 1232, the tubular sleeve 1216 may provide a fluid tight metal-to-metal seal between interior surface of the tubular sleeve and the exterior surfaces of the end portions, 1214 and 1230, of the first and second tubular members. In this manner, fluidic materials are prevented from passing through the threaded connections, 1212 and 1228, of the first and second tubular members, 1210 and 1232, into the annulus between the first and second tubular members and the structure 32. Furthermore, because, following the radial expansion and plastic deformation of the first and second tubular members, 1210 and 1232, the tubular sleeve 1216 may be maintained in circumferential tension and the end portions, 1214 and 1230, of the first and second tubular members, 1210 and 1232, may be maintained in circumferential compression, axial loads and/or torque loads may be transmitted through the tubular sleeve.

Figure 11A:
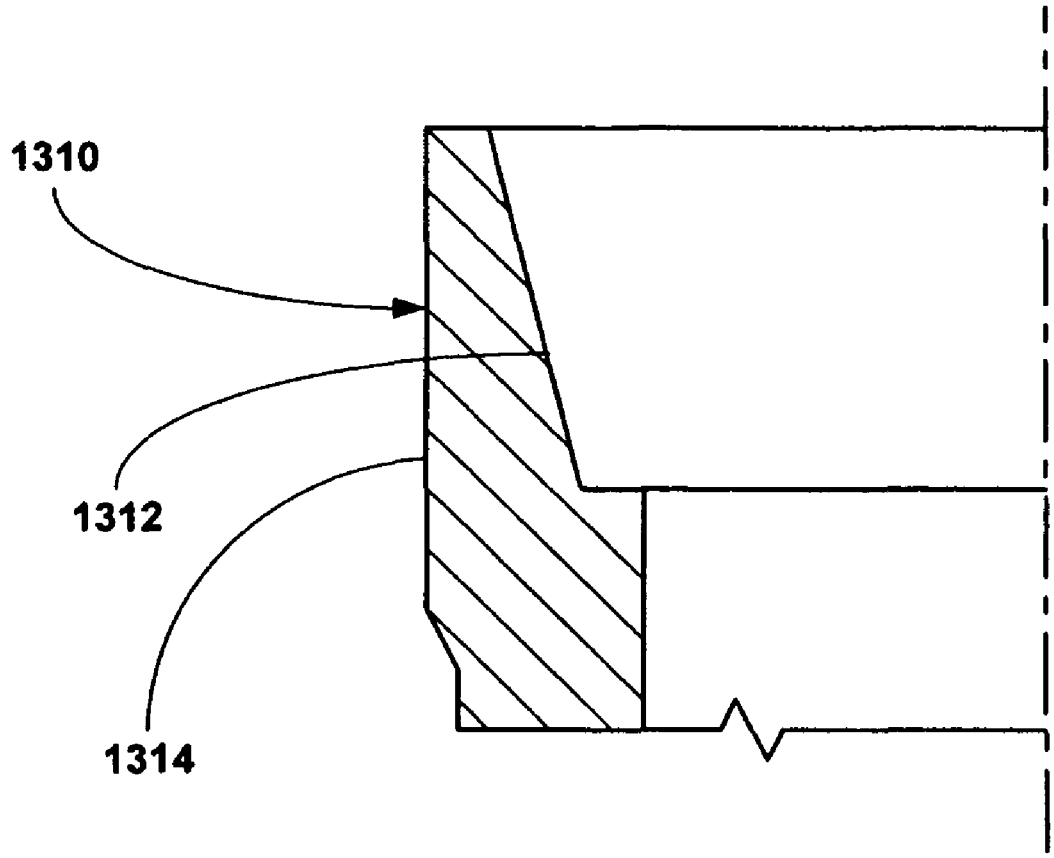
FIG. 11*a* is a fragmentary cross-sectional illustration of a first tubular member having an internally threaded connection at an end portion.
Figure 11B:
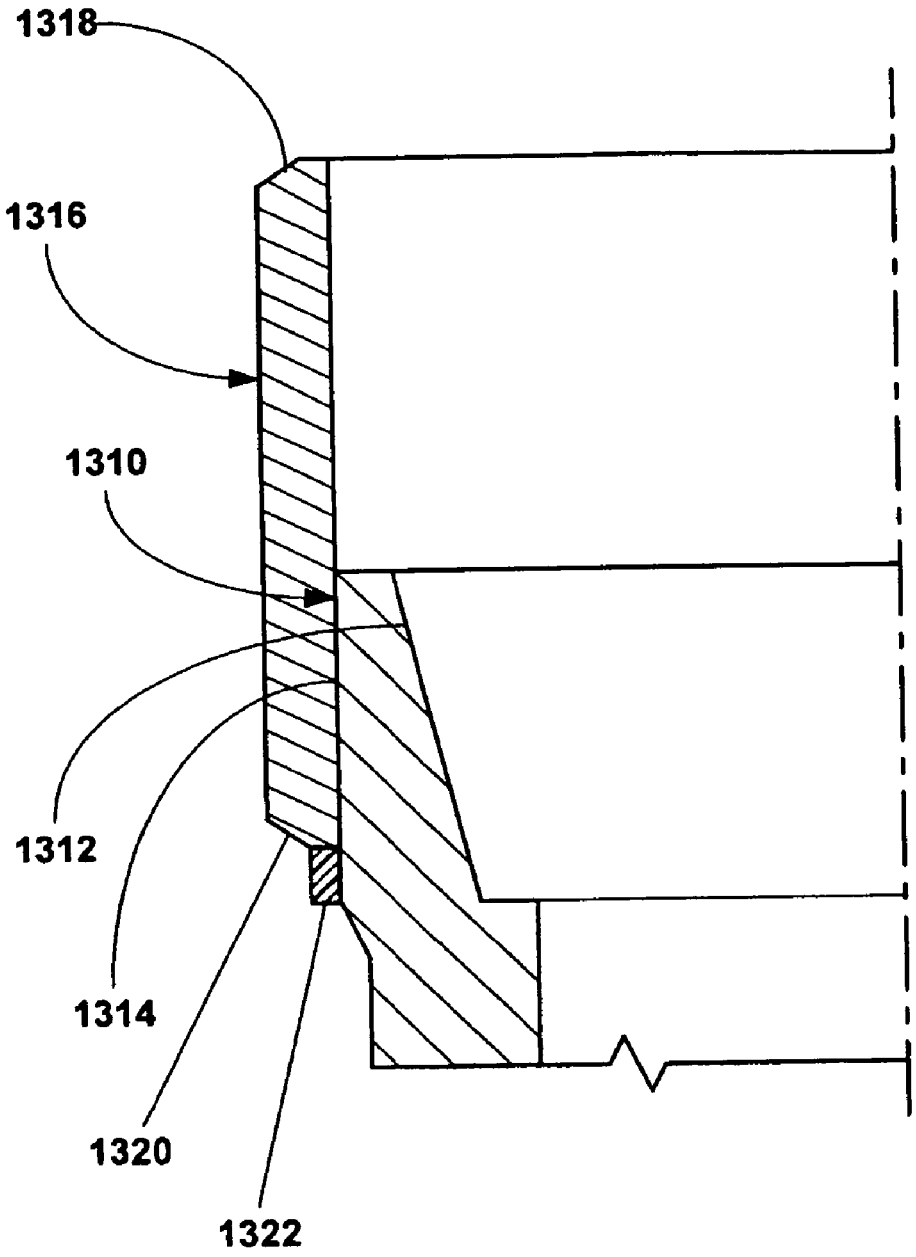
FIG. 11*b* is a fragmentary cross-sectional illustration of the placement of an alternative embodiment of a tubular sleeve onto the end portion of the first tubular member of FIG. 11*a*.

Referring to FIG. 11*a*, a first tubular member 1310 includes an internally threaded connection 1312 at an end portion 1314. As illustrated in FIG. 11*b*, a first end of a tubular sleeve 1316 having tapered portions, 1318 and 1320, at opposite ends is then mounted upon and receives the end portion 1314 of the first tubular member 1310. In an exemplary embodiment, an annular resilient retaining member 1322 is then positioned on the first tubular member 1310 below the bottom end of the tubular sleeve 1316 in order to couple the tubular sleeve to the first tubular member.

Figure 11C:
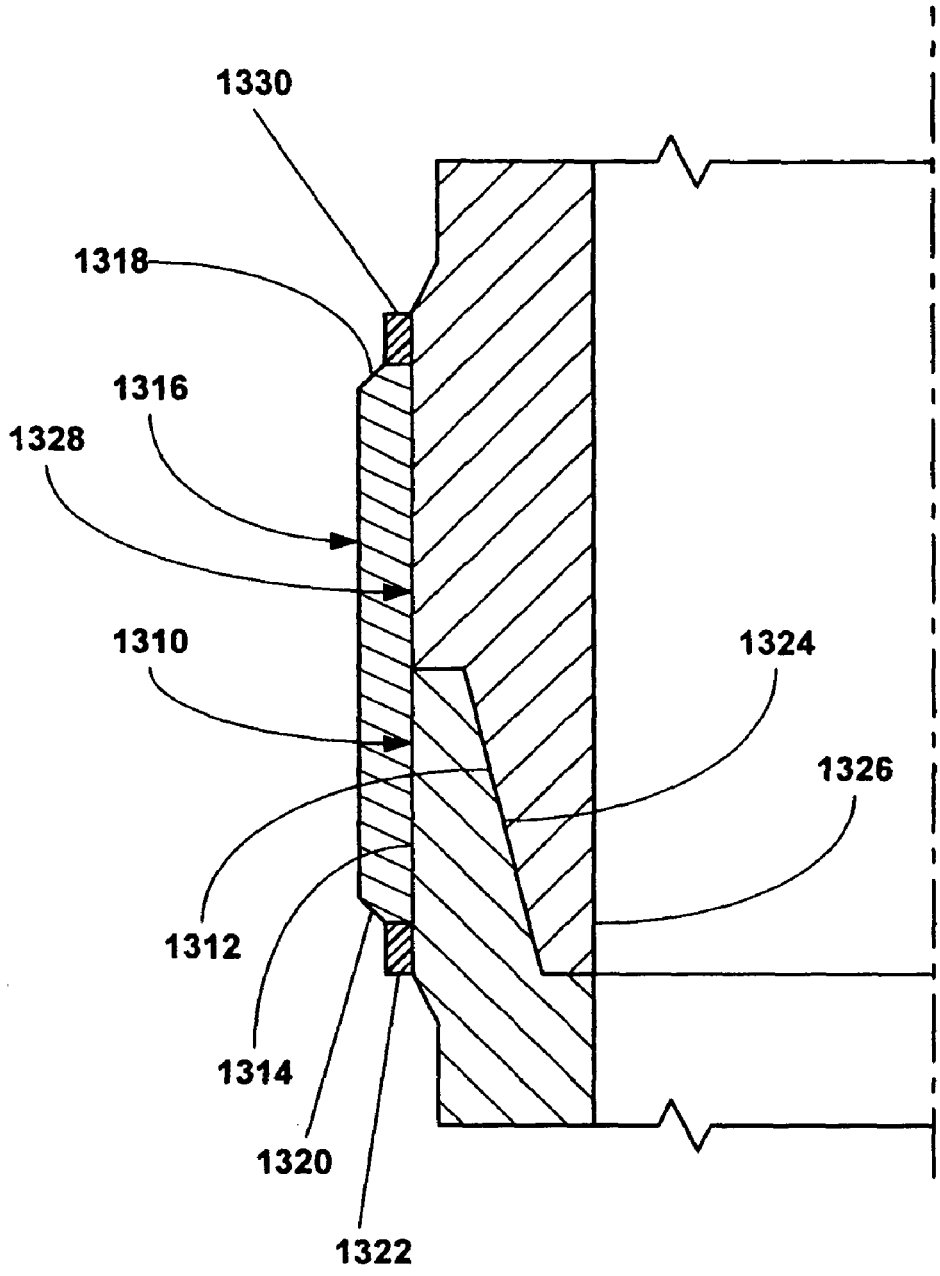
FIG. 11*c* is a fragmentary cross-sectional illustration of the coupling of an externally threaded connection at an end portion of a second tubular member to the internally threaded connection at the end portion of the first tubular member of FIG. 11*b*.

As illustrated in FIG. 11*c*, an externally threaded connection 1324 of an end portion 1326 of a second tubular member 1328 is then positioned within the tubular sleeve 1316 and threadably coupled to the internally threaded connection 1312 of the end portion 1314 of the first tubular member 1310. In an exemplary embodiment, an annular resilient retaining member 1330 is then positioned on the second tubular member 1328 above the top end of the tubular sleeve 1316 in order to couple the tubular sleeve to the second tubular member.

In an exemplary embodiment, the internally threaded connection 1312 of the end portion 1314 of the first tubular member 1310 is a box connection, and the externally threaded connection 1324 of the end portion 1326 of the second tubular member 1328 is a pin connection. In an exemplary embodiment, the internal diameter of the tubular sleeve 1316 is at least approximately 0.020" greater than the outside diameters of the end portions, 1314 and 1326, of the first and second tubular members, 1310 and 1328. In this manner, during the threaded coupling of the first and second tubular members, 1310 and 1328, fluidic materials within the first and second tubular members may be vented from the tubular members.

Figure 11D:
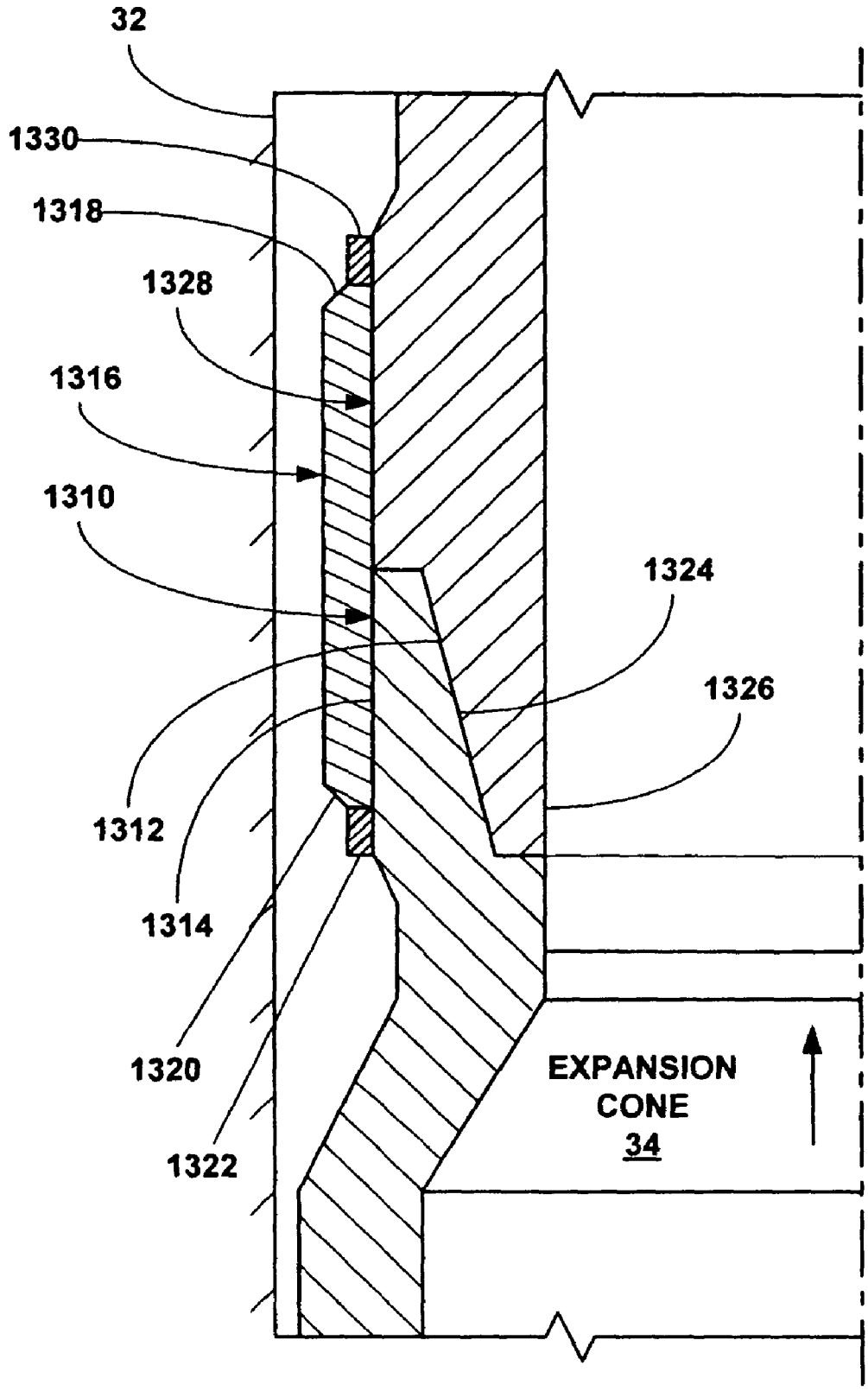
FIG. 11*d* is a fragmentary cross-sectional illustration of the radial expansion and plastic deformation of a portion of the first tubular member of FIG. 11*c*.
Figure 11E:
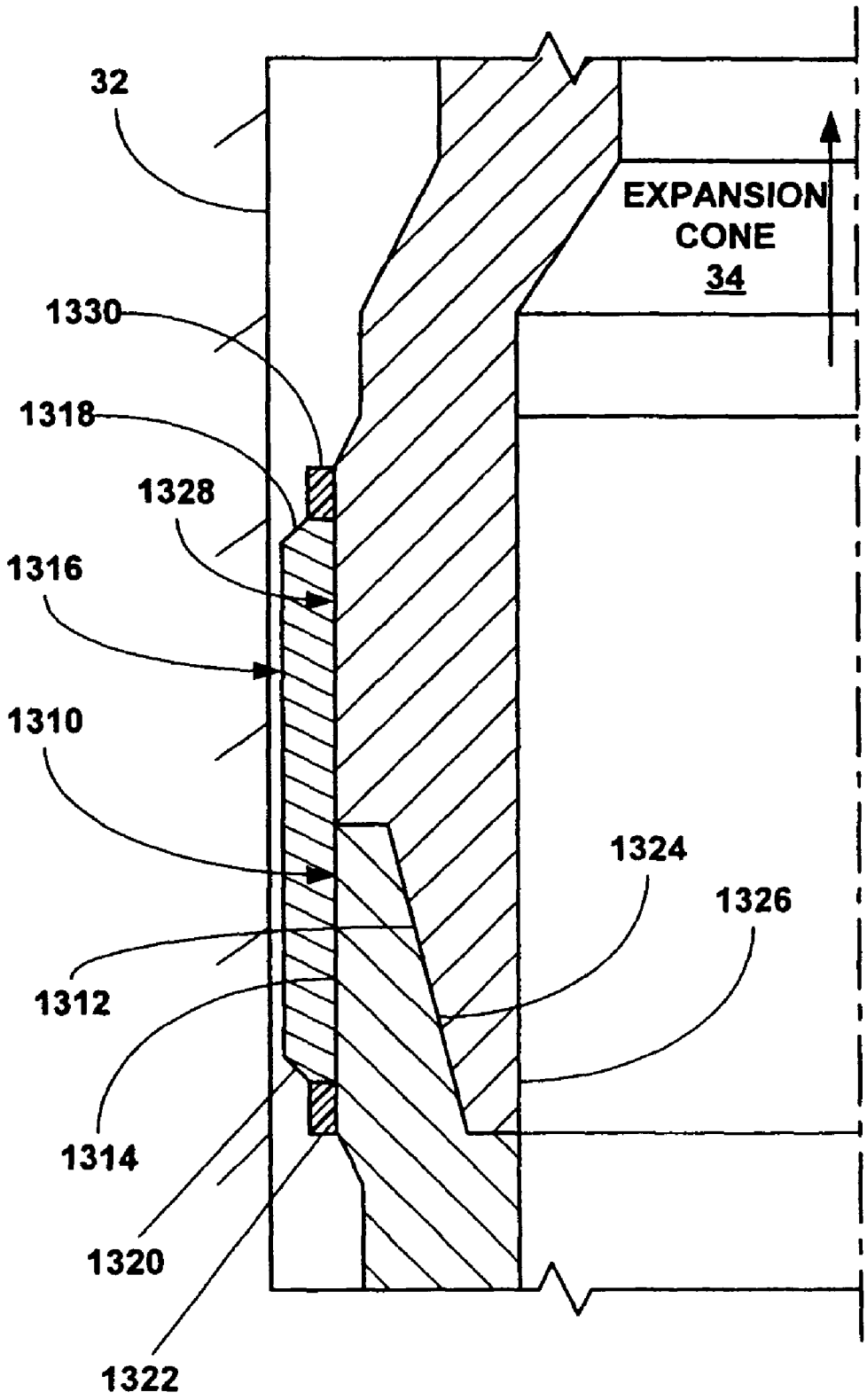
FIG. 11*e* is a fragmentary cross sectional of the continued radial expansion and plastic deformation of the threaded connection between the first and second tubular members and the tubular sleeve of FIG. 11*d*.

In an exemplary embodiment, as illustrated in FIGS. 11*d* and 11*e*, the first and second tubular members, 1310 and 1328, and the tubular sleeve 1316 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1310 and 1328, may be from top to bottom or from bottom to top.

In an exemplary embodiment, during the radial expansion and plastic deformation of the first and second tubular members, 1310 and 1328, the tubular sleeve 1316 is also radially expanded and plastically deformed. In an exemplary embodiment, as a result, the tubular sleeve 1316 may be maintained in circumferential tension and the end portions, 1314 and 1326, of the first and second tubular members, 1310 and 1328, may be maintained in circumferential compression.

The use of the tubular sleeve 1316 during (a) the coupling of the first tubular member 1310 to the second tubular member 1328, (b) the placement of the first and second tubular members in the structure 32, and (c) the radial expansion and plastic deformation of the first and second tubular members provides a number of significant benefits. For example, the tubular sleeve 1316 protects the exterior surfaces of the end portions, 1314 and 1326, of the first and second tubular members, 1310 and 1328, during handling and insertion of the tubular members within the structure 32. In this manner, damage to the exterior surfaces of the end portions, 1314 and 1326, of the first and second tubular members, 1310 and 1328, are prevented that could result in stress concentrations that could result in a catastrophic failure during subsequent radial expansion operations. Furthermore, the tubular sleeve 1316 provides an alignment guide that facilitates the insertion and threaded coupling of the second tubular member 1328 to the first tubular member 1310. In this manner, misalignment that could result in damage to the threaded connections, 1312 and 1324, of the first and second tubular members, 1310 and 1328, may be avoided. Furthermore, the tubular sleeve 1316 may prevent crack propagation during the radial expansion and plastic deformation of the first and second tubular members, 1310 and 1328. In this manner, failure modes such as, for example, longitudinal cracks in the end portions, 1314 and 1326, of the first and second tubular members may be limited in severity or eliminated all together. In addition, after completing the radial expansion and plastic deformation of the first and second tubular members, 1310 and 1328, the tubular sleeve 1316 may provide a fluid tight metal-to-metal seal between interior surface of the tubular sleeve and the exterior surfaces of the end portions, 1314 and 1326, of the first and second tubular members. In this manner, fluidic materials are prevented from passing through the threaded connections, 1312 and 1324, of the first and second tubular members, 1310 and 1328, into the annulus between the first and second tubular members and the structure 32. Furthermore, because, following the radial expansion and plastic deformation of the first and second tubular members, 1310 and 1328, the tubular sleeve 1316 may be maintained in circumferential tension and the end portions, 1314 and 1326, of the first and second tubular members, 1310 and 1328, may be maintained in circumferential compression, axial loads and/or torque loads may be transmitted through the tubular sleeve.

Figure 12A:
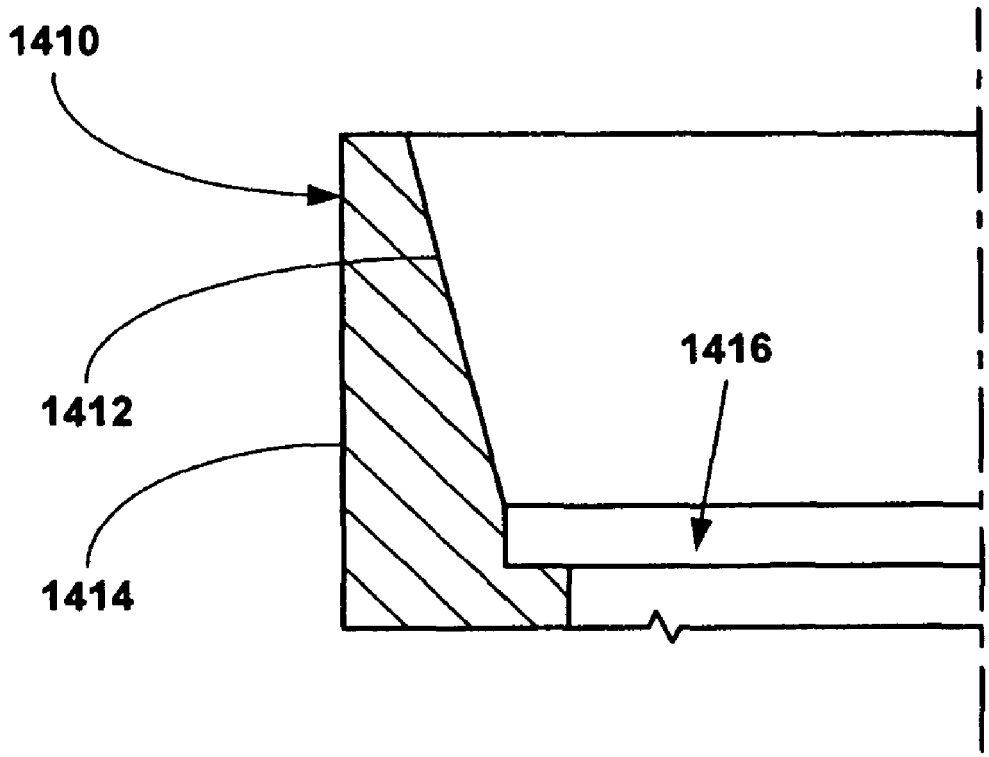
FIG. 12*a* is a fragmentary cross-sectional illustration of a first tubular member having an internally threaded connection at an end portion.
Figure 12B:
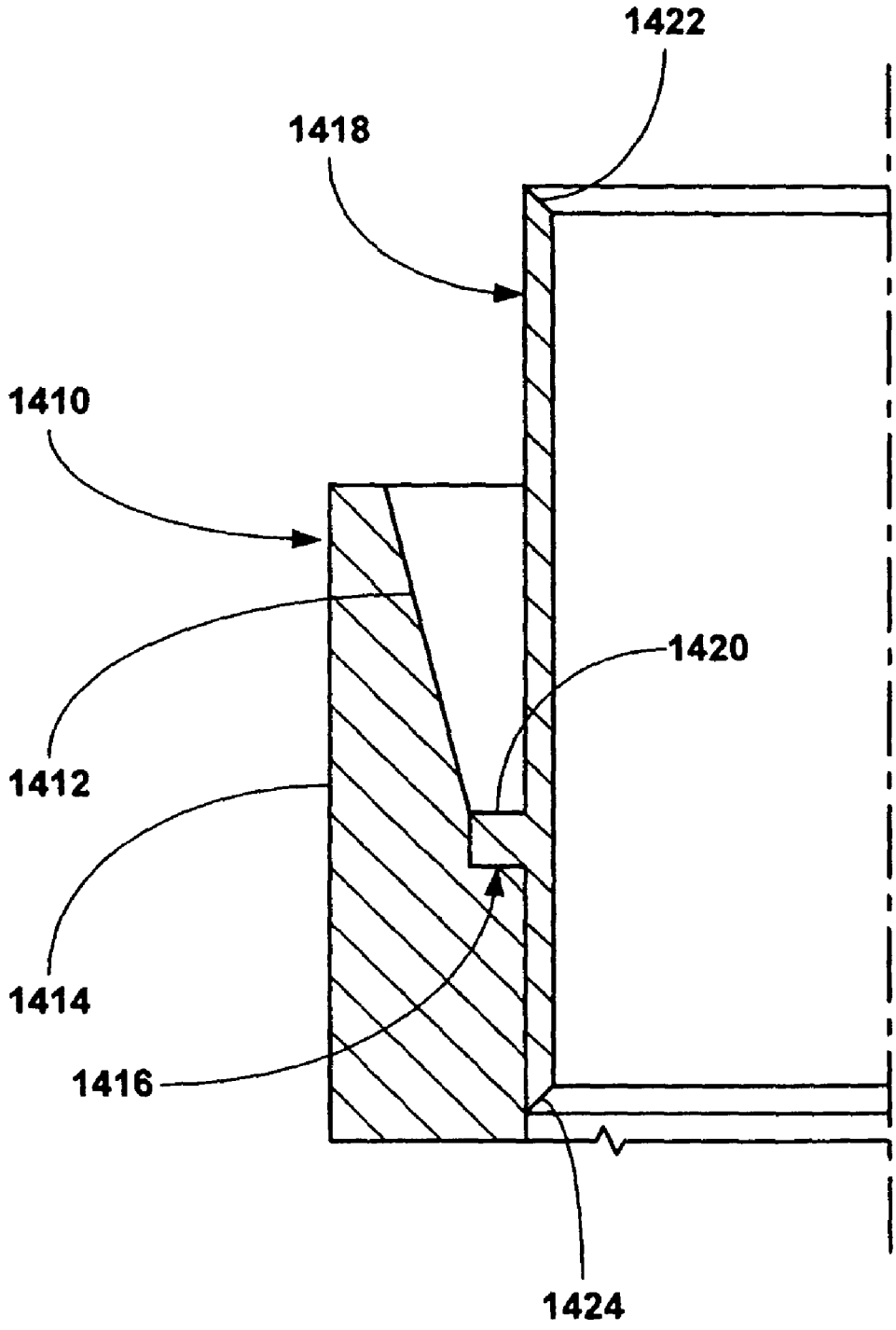
FIG. 12*b* is a fragmentary cross-sectional illustration of the placement of an alternative embodiment of a tubular sleeve onto the end portion of the first tubular member of FIG. 12*a*.
Figure 12C:
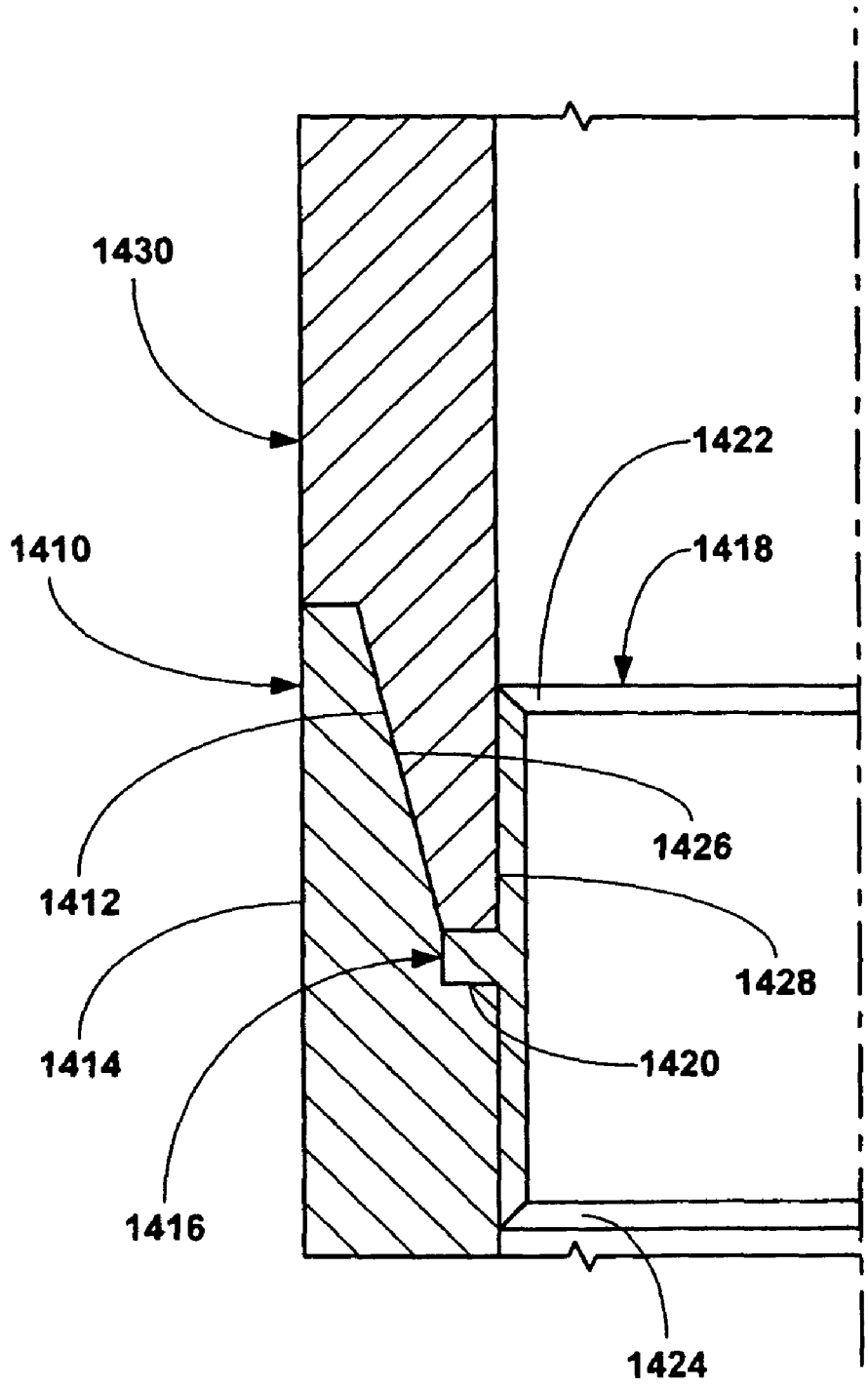
FIG. 12*c* is a fragmentary cross-sectional illustration of the coupling of an externally threaded connection at an end portion of a second tubular member to the internally threaded connection at the end portion of the first tubular member of FIG. 12*b*.

Referring to FIG. 12*a*, a first tubular member 1410 includes an internally threaded connection 1412 and an annular recess 1414 at an end portion 1416. As illustrated in FIG. 12*b*, a first end of a tubular sleeve 1418 that includes an external flange 1420 and tapered portions, 1422 and 1424, at opposite ends is then mounted within the end portion 1416 of the first tubular member 1410. In an exemplary embodiment, the external flange 1420 of the tubular sleeve 1418 is received within and is supported by the annular recess 1414 of the end portion 1416 of the first tubular member 1410. As illustrated in FIG. 12*c*, an externally threaded connection 1426 of an end portion 1428 of a second tubular member 1430 is then positioned around a second end of the tubular sleeve 1418 and threadably coupled to the internally threaded connection 1412 of the end portion 1414 of the first tubular member 1410. In an exemplary embodiment, the external flange 1420 of the tubular sleeve 1418 mates with and is received within the annular recess 1416 of the end portion 1414 of the first tubular member 1410, and the external flange of the tubular sleeve is retained in the annular recess by the end portion 1428 of the second tubular member 1430. Thus, the tubular sleeve 1416 is coupled to and is surrounded by the internal surfaces of the first and second tubular members, 1410 and 1430.

In an exemplary embodiment, the internally threaded connection 1412 of the end portion 1414 of the first tubular member 1410 is a box connection, and the externally threaded connection 1426 of the end portion 1428 of the second tubular member 1430 is a pin connection. In an exemplary embodiment, the external diameter of the tubular sleeve 1418 is at least approximately 0.020" less than the inside diameters of the first and second tubular members, 1410 and 1430. In this manner, during the threaded coupling of the first and second tubular members, 1410 and 1430, fluidic materials within the first and second tubular members may be vented from the tubular members.

Figure 12D:
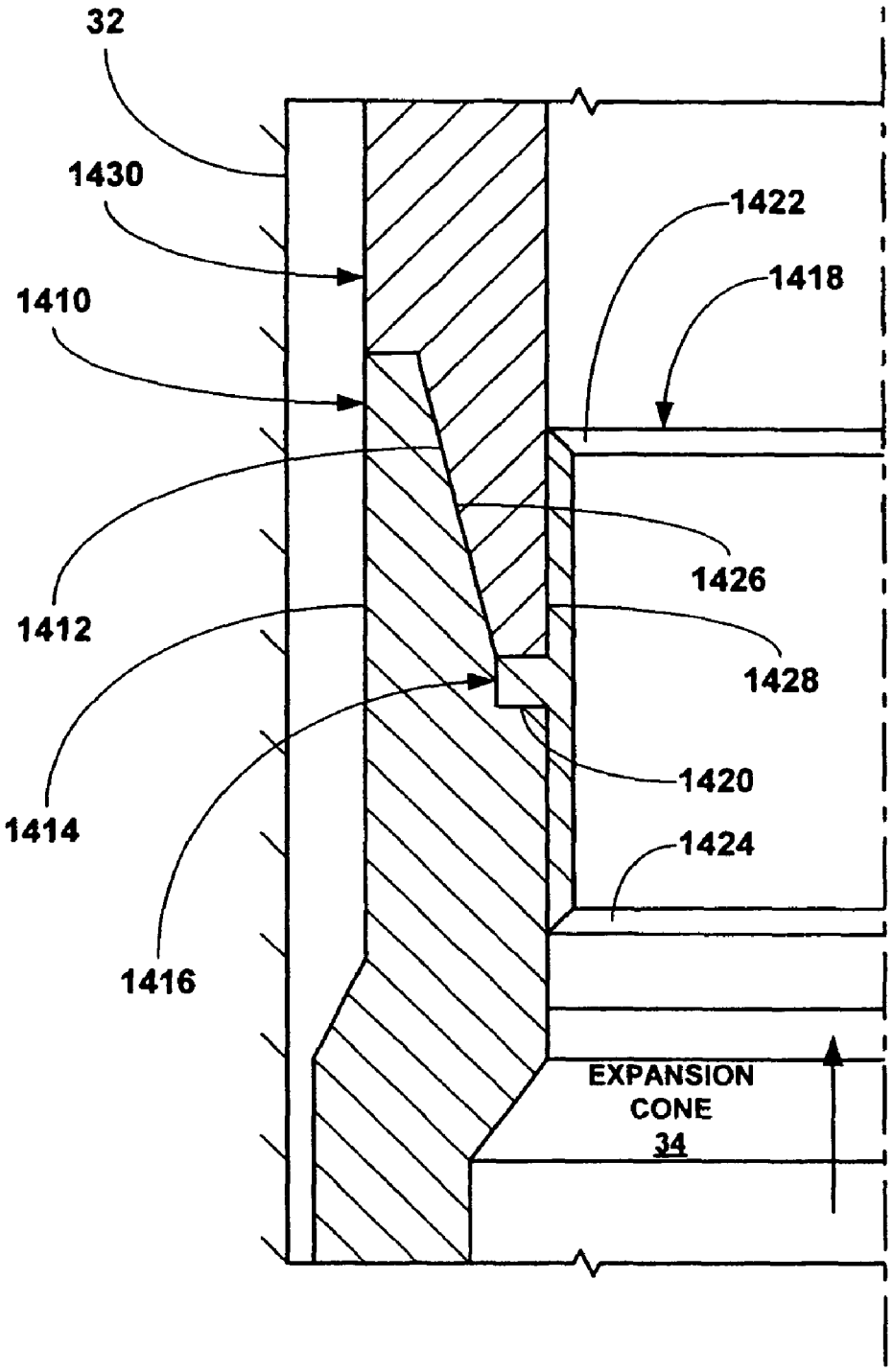
FIG. 12*d* is a fragmentary cross-sectional illustration of the radial expansion and plastic deformation of a portion of the first tubular member of FIG. 12*c*.
Figure 12E:
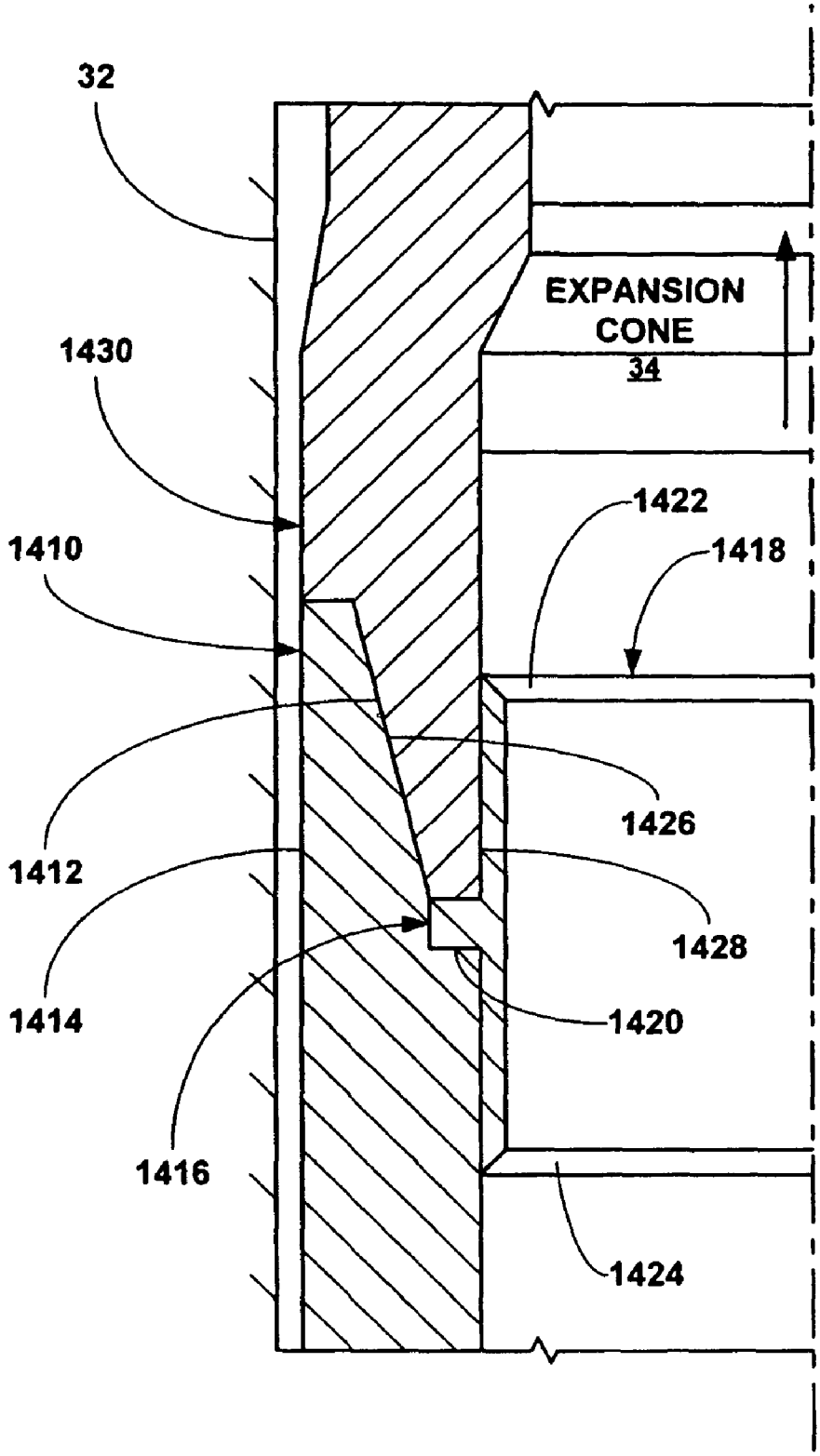
FIG. 12*e* is a fragmentary cross sectional of the continued radial expansion and plastic deformation of the threaded connection between the first and second tubular members and the tubular sleeve of FIG. 12*d*.

In an exemplary embodiment, as illustrated in FIGS. 12*d* and 12*e*, the first and second tubular members, 1410 and 1430, and the tubular sleeve 1418 may then be positioned within another structure 32 such as, for example, a wellbore, and radially expanded and plastically deformed, for example, by moving an expansion cone 34 through the interiors of the first and second tubular members. The tapered portions, 1422 and 1424, of the tubular sleeve 1418 facilitate the movement of the expansion cone 34 through the first and second tubular members, 1410 and 1430, and the movement of the expansion cone 34 through the interiors of the first and second tubular members, 1410 and 1430, may be from top to bottom or from bottom to top.

In an exemplary embodiment, during the radial expansion and plastic deformation of the first and second tubular members, 1410 and 1430, the tubular sleeve 1418 is also radially expanded and plastically deformed. In an exemplary embodiment, as a result, the tubular sleeve 1418 may be maintained in circumferential compression and the end portions, 1414 and 1428, of the first and second tubular members, 1410 and 1430, may be maintained in circumferential tension.

In several alternative embodiments, the first and second tubular members, 1410 and 1430, are radially expanded and plastically deformed using other conventional methods for radially expanding and plastically deforming tubular members such as, for example, internal pressurization and/or roller expansion devices.

The use of the tubular sleeve 1418 during (a) the coupling of the first tubular member 1410 to the second tubular member 1430, (b) the placement of the first and second tubular members in the structure 32, and (c) the radial expansion and plastic deformation of the first and second tubular members provides a number of significant benefits. For example, the tubular sleeve 1418 provides an alignment guide that facilitates the insertion and threaded coupling of the second tubular member 1430 to the first tubular member 1410. In this manner, misalignment that could result in damage to the threaded connections, 1412 and 1426, of the first and second tubular members, 1410 and 1430, may be avoided. In addition, during the relative rotation of the second tubular member with respect to the first tubular member, required during the threaded coupling of the first and second tubular members, the tubular sleeve 1418 provides an indication of to what degree the first and second tubular members are threadably coupled. For example, if the tubular sleeve 1418 can be easily rotated, that would indicate that the first and second tubular members, 1410 and 1430, are not fully threadably coupled and in intimate contact with the internal flange 1420 of the tubular sleeve. Furthermore, the tubular sleeve 1418 may prevent crack propagation during the radial expansion and plastic deformation of the first and second tubular members, 1410 and 1430. In this manner, failure modes such as, for example, longitudinal cracks in the end portions, 1414 and 1428, of the first and second tubular members may be limited in severity or eliminated all together. In addition, after completing the radial expansion and plastic deformation of the first and second tubular members, 1410 and 1430, the tubular sleeve 1418 may provide a fluid tight metal-to-metal seal between the exterior surface of the tubular sleeve and the interior surfaces of the end portions, 1414 and 1428, of the first and second tubular members. In this manner, fluidic materials are prevented from passing through the threaded connections, 1412 and 1426, of the first and second tubular members, 1410 and 1430, into the annulus between the first and second tubular members and the structure 32. Furthermore, because, following the radial expansion and plastic deformation of the first and second tubular members, 1410 and 1430, the tubular sleeve 1418 may be maintained in circumferential compression and the end portions, 1414 and 1428, of the first and second tubular members, 1410 and 1430, may be maintained in circumferential tension, axial loads and/or torque loads may be transmitted through the tubular sleeve.

Figure 13A:
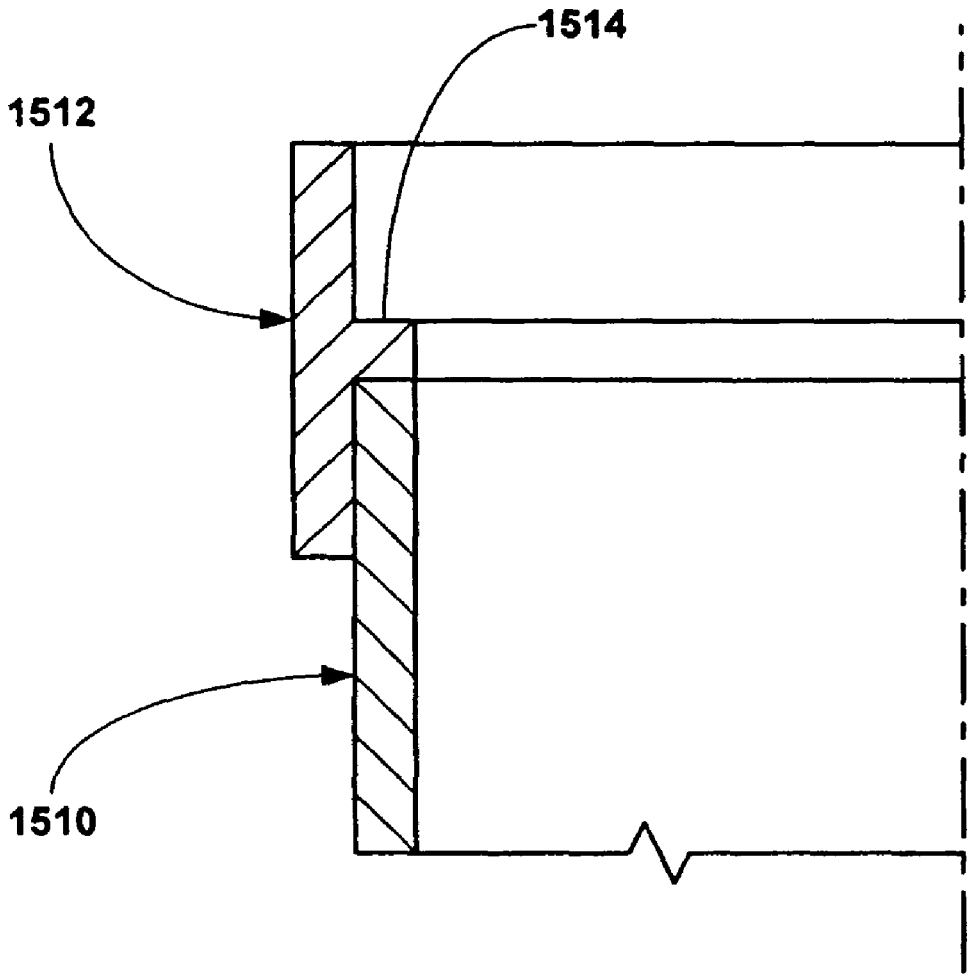
FIG. 13*a* is a fragmentary cross-sectional illustration of the coupling of an end portion of an alternative embodiment of a tubular sleeve onto the end portion of a first tubular member.
Figure 13B:
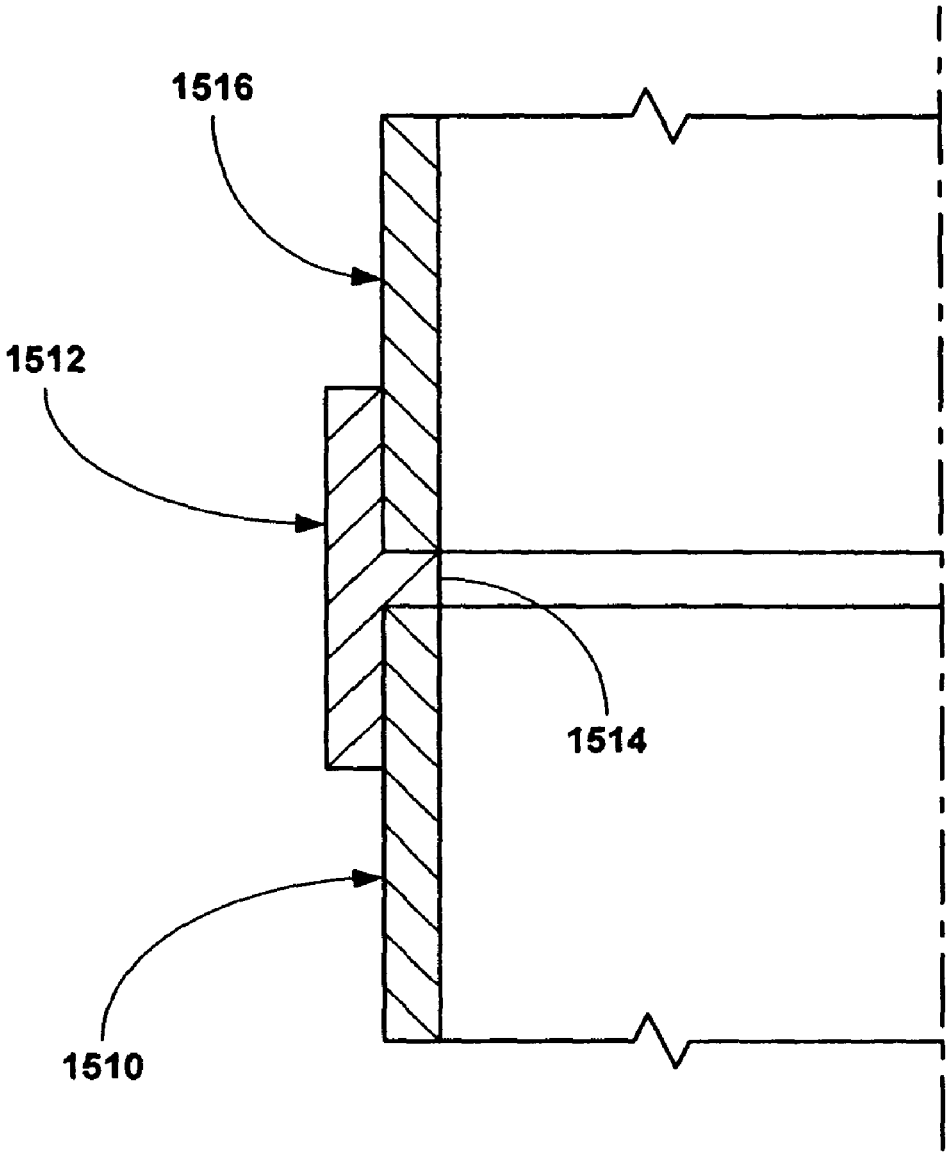
FIG. 13*b* is a fragmentary cross-sectional illustration of the coupling of an end portion of a second tubular member to the other end portion of the tubular sleeve of FIG. 13*a*.

Referring to FIG. 13*a*, an end of a first tubular member 1510 is positioned within and coupled to an end of a tubular sleeve 1512 having an internal flange 1514. In an exemplary embodiment, the end of the first tubular member 1510 abuts one side of the internal flange 1514. As illustrated in FIG. 13*b*, an end of second tubular member 1516 is then positioned within and coupled to another end of the tubular sleeve 1512. In an exemplary embodiment, the end of the second tubular member 1516 abuts another side of the internal flange 1514. In an exemplary embodiment, the tubular sleeve 1512 is coupled to the ends of the first and second tubular members, 1510 and 1516, by expanding the tubular sleeve 1512 using heat and then inserting the ends of the first and second tubular members into the expanded tubular sleeve 1512. After cooling the tubular sleeve 1512, the tubular sleeve is coupled to the ends of the first and second tubular members, 1510 and 1516.

Figure 13C:
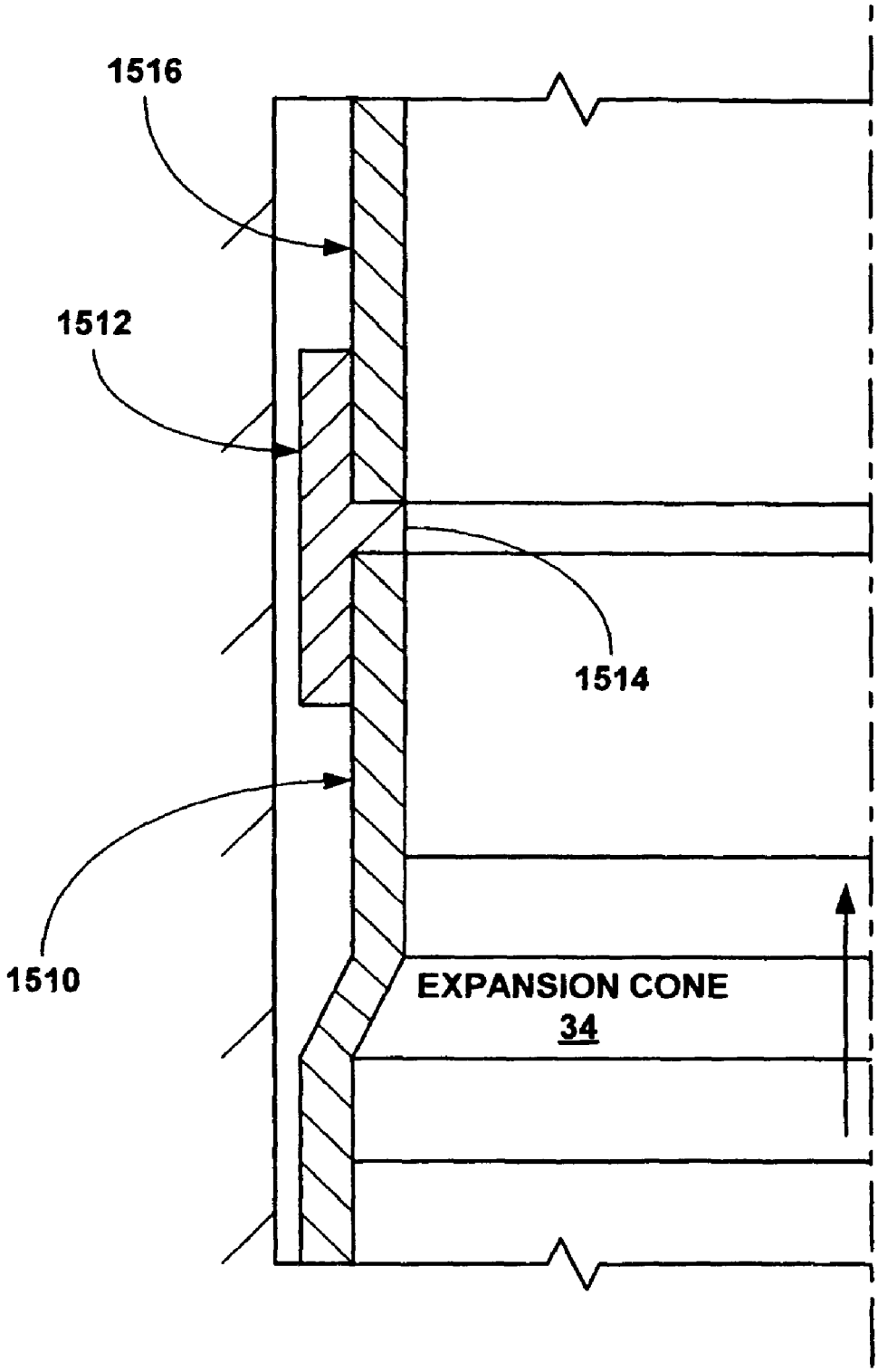
FIG. 13*c* is a fragmentary cross-sectional illustration of the radial expansion and plastic deformation of a portion of the first tubular member of FIG. 13*b*.
Figure 13D:
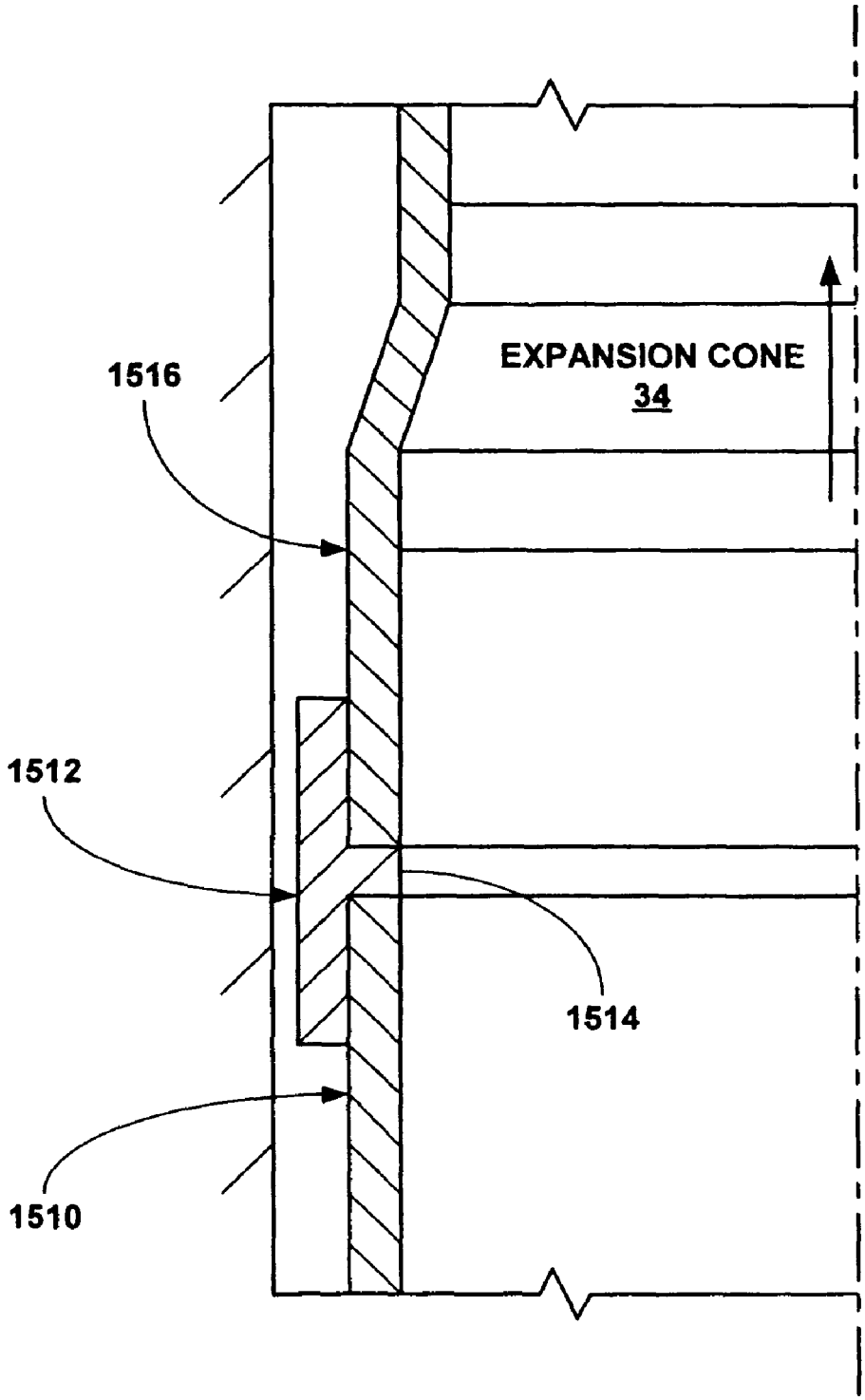
FIG. 13*d* is a fragmentary cross sectional of the continued radial expansion and plastic deformation of the threaded connection between the first and second tubular members and the tubular sleeve of FIG. 13*c*.

In an exemplary embodiment, as illustrated in FIGS. 13*c* and 13*d*, the first and second tubular members, 1510 and 1516, and the tubular sleeve 1512 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1510 and 1516, may be from top to bottom or from bottom to top.

In an exemplary embodiment, during the radial expansion and plastic deformation of the first and second tubular members, 1510 and 1516, the tubular sleeve 1512 is also radially expanded and plastically deformed. In an exemplary embodiment, as a result, the tubular sleeve 1512 may be maintained in circumferential tension and the ends of the first and second tubular members, 1510 and 1516, may be maintained in circumferential compression.

The use of the tubular sleeve 1512 during (a) the placement of the first and second tubular members, 1510 and 1516, in the structure 32 and (b) the radial expansion and plastic deformation of the first and second tubular members provides a number of significant benefits. For example, the tubular sleeve 1512 may prevent crack propagation during the radial expansion and plastic deformation of the first and second tubular members, 1510 and 1516. In this manner, failure modes such as, for example, longitudinal cracks in the ends of the first and second tubular members, 1510 and 1516, may be limited in severity or eliminated all together. In addition, after completing the radial expansion and plastic deformation of the first and second tubular members, 1510 and 1516, the tubular sleeve 1512 may provide a fluid tight metal-to-metal seal between the exterior surface of the tubular sleeve and the interior surfaces of the end of the first and second tubular members. Furthermore, because, following the radial expansion and plastic deformation of the first and second tubular members, 1510 and 1516, the tubular sleeve 1512 may be maintained in circumferential compression and the ends of the first and second tubular members, 1510 and 1516, may be maintained in circumferential tension, axial loads and/or torque loads may be transmitted through the tubular sleeve.

Figure 14A:
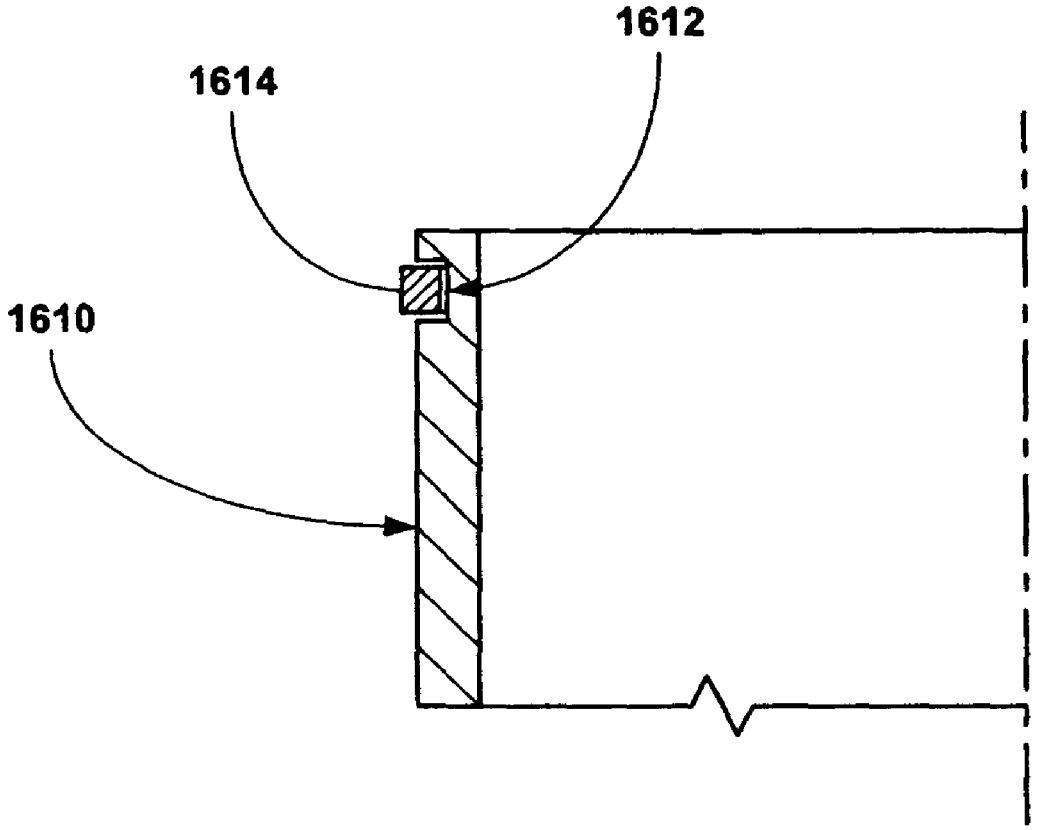
FIG. 14*a* is a fragmentary cross-sectional illustration of an end portion of a first tubular member.
Figure 14B:
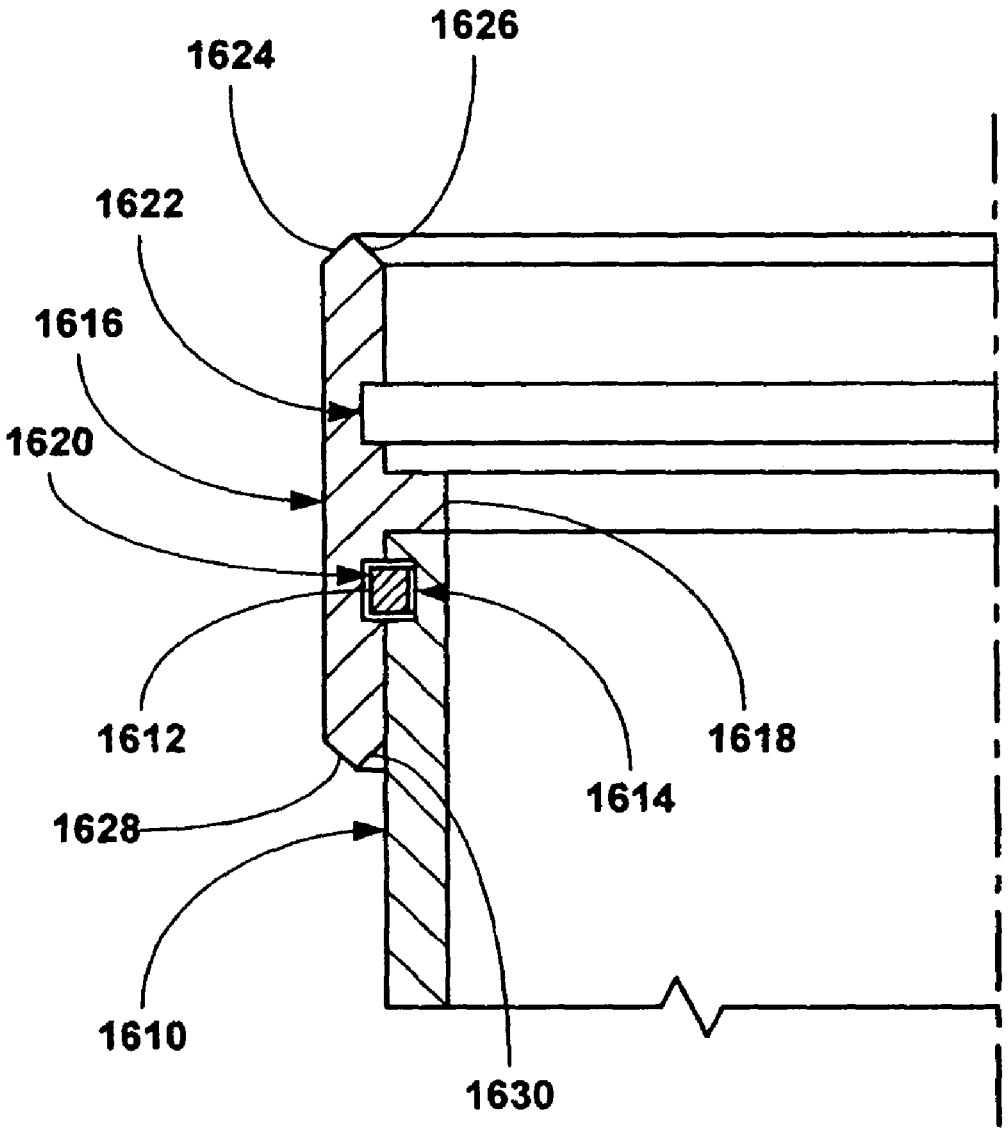
FIG. 14*b* is a fragmentary cross-sectional illustration of the coupling of an end portion of an alternative embodiment of a tubular sleeve onto the end portion of the first tubular member of FIG. 14*a*.

Referring to FIG. 14*a*, a first tubular member 1610 includes a resilient retaining ring 1612 mounted within an annular recess 1614. As illustrated in FIG. 14*b*, the end of the first tubular member 1610 is then inserted into and coupled to an end of a tubular sleeve 1616 including an internal flange 1618 and annular recesses, 1620 and 1622, positioned on opposite sides of the internal flange, tapered portions, 1624 and 1626, on one end of the tubular sleeve, and tapered portions, 1628 and 1630, on the other end of the tubular sleeve. In an exemplary embodiment, the resilient retaining ring 1612 is thereby positioned at least partially in the annular recesses, 1614 and 1620, thereby coupling the first tubular member 1610 to the tubular sleeve 1616, and the end of the first tubular member 1610 abuts one side of the internal flange 1618. During the coupling of the first tubular member 1610 to the tubular sleeve 1616, the tapered portion 1630 facilitates the radial compression of the resilient retaining ring 1612 during the insertion of the first tubular member into the tubular sleeve.

Figure 14C:
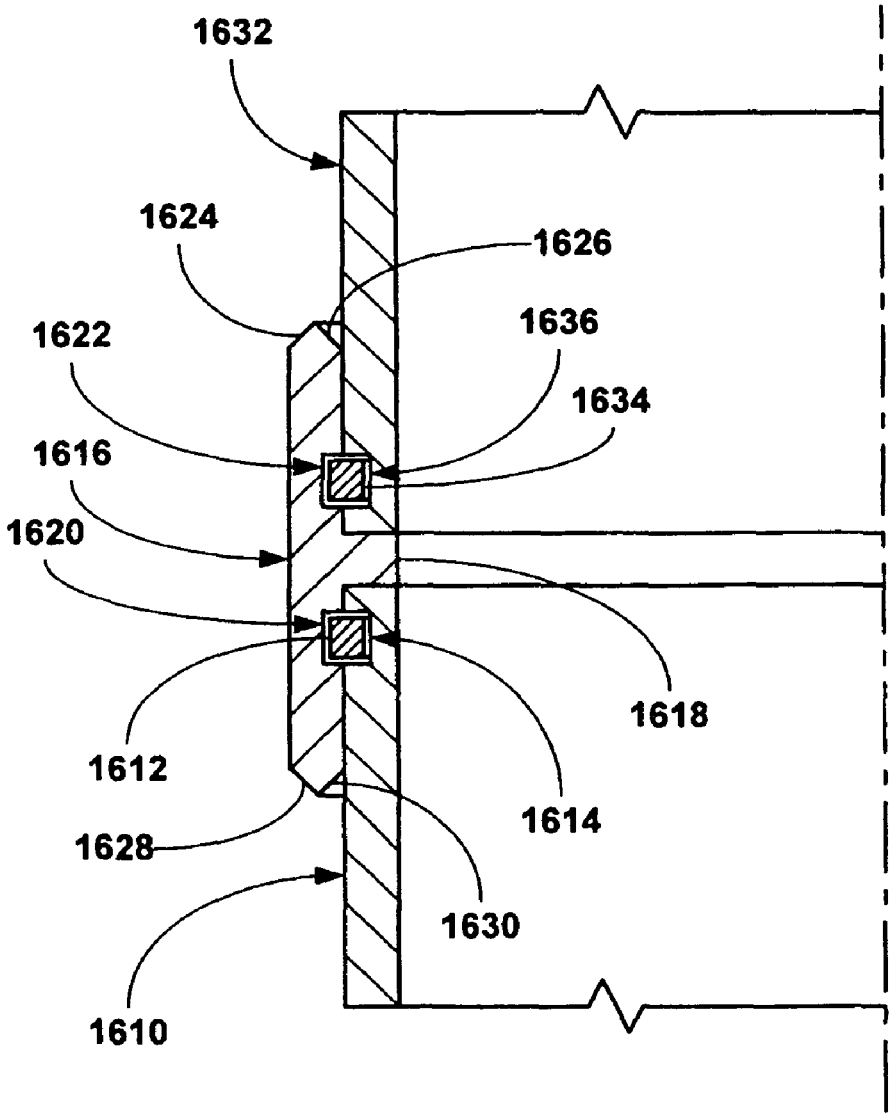
FIG. 14*c* is a fragmentary cross-sectional illustration of the coupling of an end portion of a second tubular member to the other end portion of the tubular sleeve of FIG. 14*b*.

As illustrated in FIG. 14*c*, an end of a second tubular member 1632 that includes a resilient retaining ring 1634 mounted within an annular recess 1636 is then inserted into and coupled to another end of the tubular sleeve 1616. In an exemplary embodiment, the resilient retaining ring 1634 is thereby positioned at least partially in the annular recesses, 1636 and 1622, thereby coupling the second tubular member 1632 to the tubular sleeve 1616, and the end of the second tubular member 1632 abuts another side of the internal flange 1618. During the coupling of the second tubular member 1632 to the tubular sleeve 1616, the tapered portion 1626 facilitates the radial compression of the resilient retaining ring 1634 during the insertion of the second tubular member into the tubular sleeve.

Figure 14D:
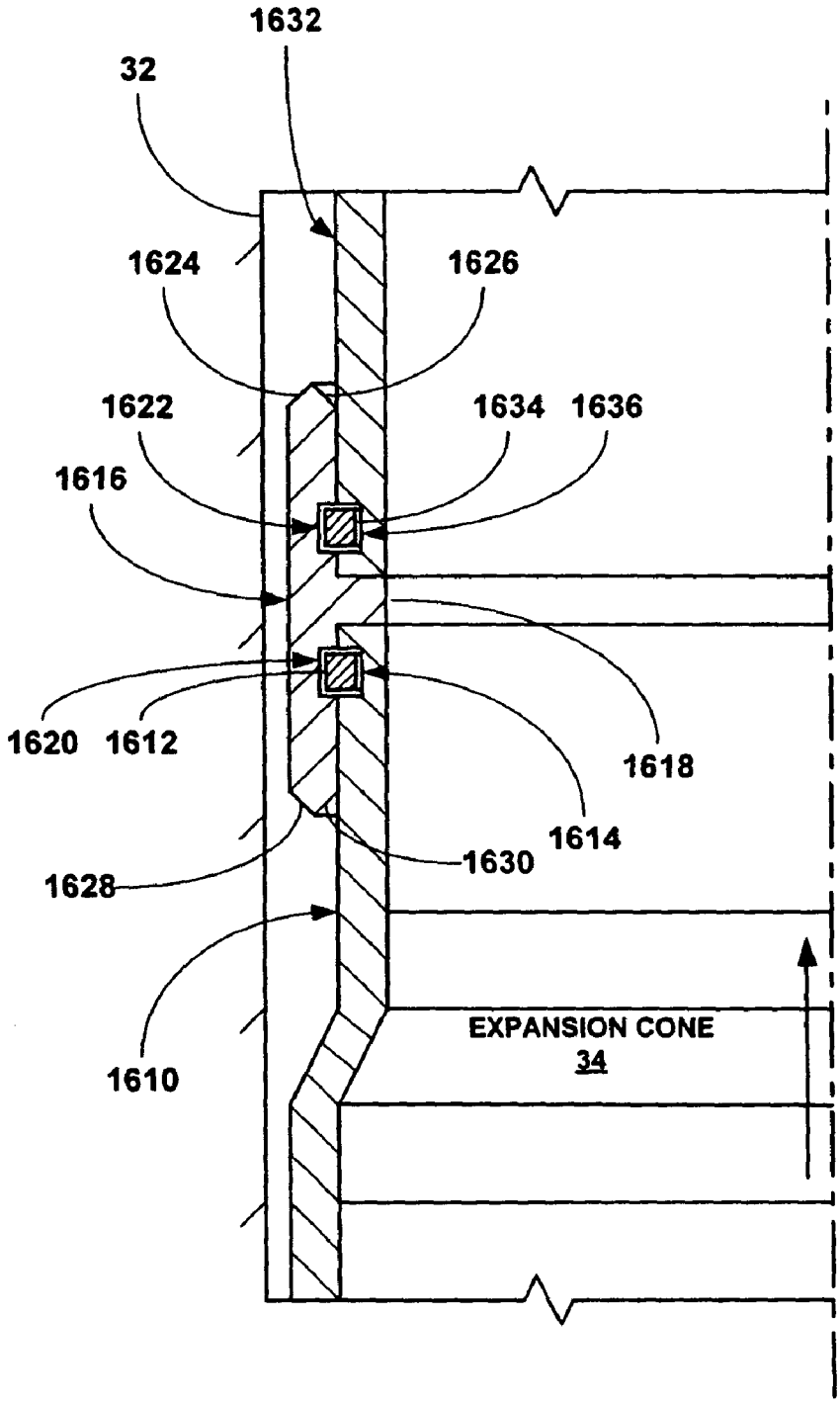
FIG. 14*d* is a fragmentary cross-sectional illustration of the radial expansion and plastic deformation of a portion of the first tubular member of FIG. 14*c*.
Figure 14E:
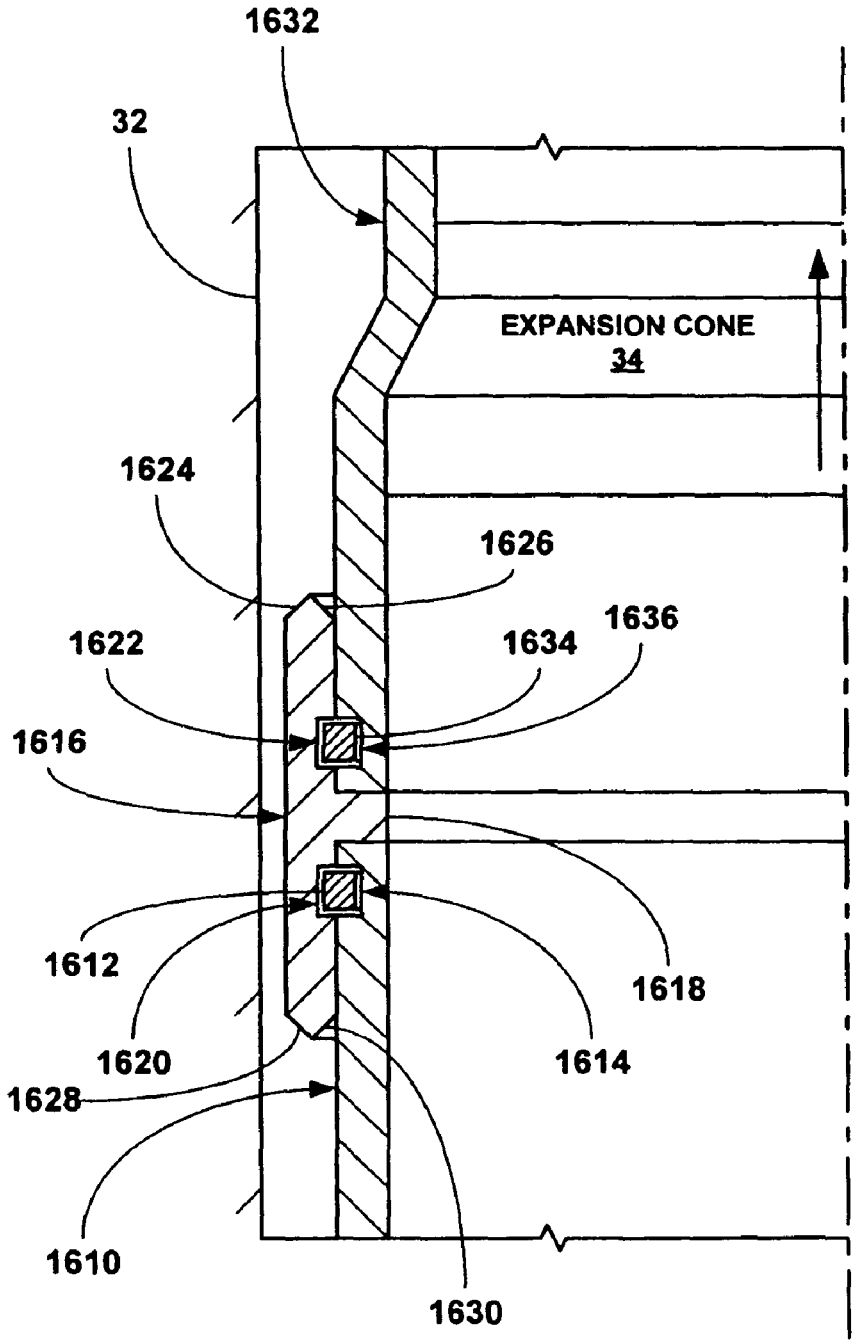
FIG. 14*e* is a fragmentary cross sectional of the continued radial expansion and plastic deformation of the threaded connection between the first and second tubular members and the tubular sleeve of FIG. 14*d*.

In an exemplary embodiment, as illustrated in FIGS. 14*d* and 14*e*, the first and second tubular members, 1610 and 1632, and the tubular sleeve 1616 may then be positioned within another structure 32 such as, for example, a wellbore, and radially expanded and plastically deformed, for example, by moving an expansion cone 34 through the interiors of the first and second tubular members. The movement of the expansion cone 34 through the interiors of the first and second tubular members, 1610 and 1632, may be from top to bottom or from bottom to top.

In an exemplary embodiment, during the radial expansion and plastic deformation of the first and second tubular members, 1610 and 1632, the tubular sleeve 1616 is also radially expanded and plastically deformed. In an exemplary embodiment, as a result, the tubular sleeve 1616 may be maintained in circumferential tension and the ends of the first and second tubular members, 1610 and 1632, may be maintained in circumferential compression.

The use of the tubular sleeve 1616 during (a the placement of the first and second tubular members, 1610 and 1632, in the structure 32, and (c) the radial expansion and plastic deformation of the first and second tubular members provides a number of significant benefits. For example, the tubular sleeve 1616 protects the exterior surfaces of the ends of the first and second tubular members, 1610 and 1632, during handling and insertion of the tubular members within the structure 32. In this manner, damage to the exterior surfaces of the ends of the first and second tubular member, 1610 and 1632, are prevented that could result in stress concentrations that could result in a catastrophic failure during subsequent radial expansion operations. Furthermore, the tubular sleeve 1616 may prevent crack propagation during the radial expansion and plastic deformation of the first and second tubular members, 1610 and 1632. In this manner, failure modes such as, for example, longitudinal cracks in the ends of the first and second tubular members, 1610 and 1632, may be limited in severity or eliminated all together. In addition, after completing the radial expansion and plastic deformation of the first and second tubular members, 1610 and 1632, the tubular sleeve 1616 may provide a fluid tight metal-to-metal seal between interior surface of the tubular sleeve and the exterior surfaces of the ends of the first and second tubular members. Furthermore, because, following the radial expansion and plastic deformation of the first and second tubular members, 1610 and 1632, the tubular sleeve 1616 may be maintained in circumferential tension and the ends of the first and second tubular members, 1610 and 1632, may be maintained in circumferential compression, axial loads and/or torque loads may be transmitted through the tubular sleeve.

Figure 15A:
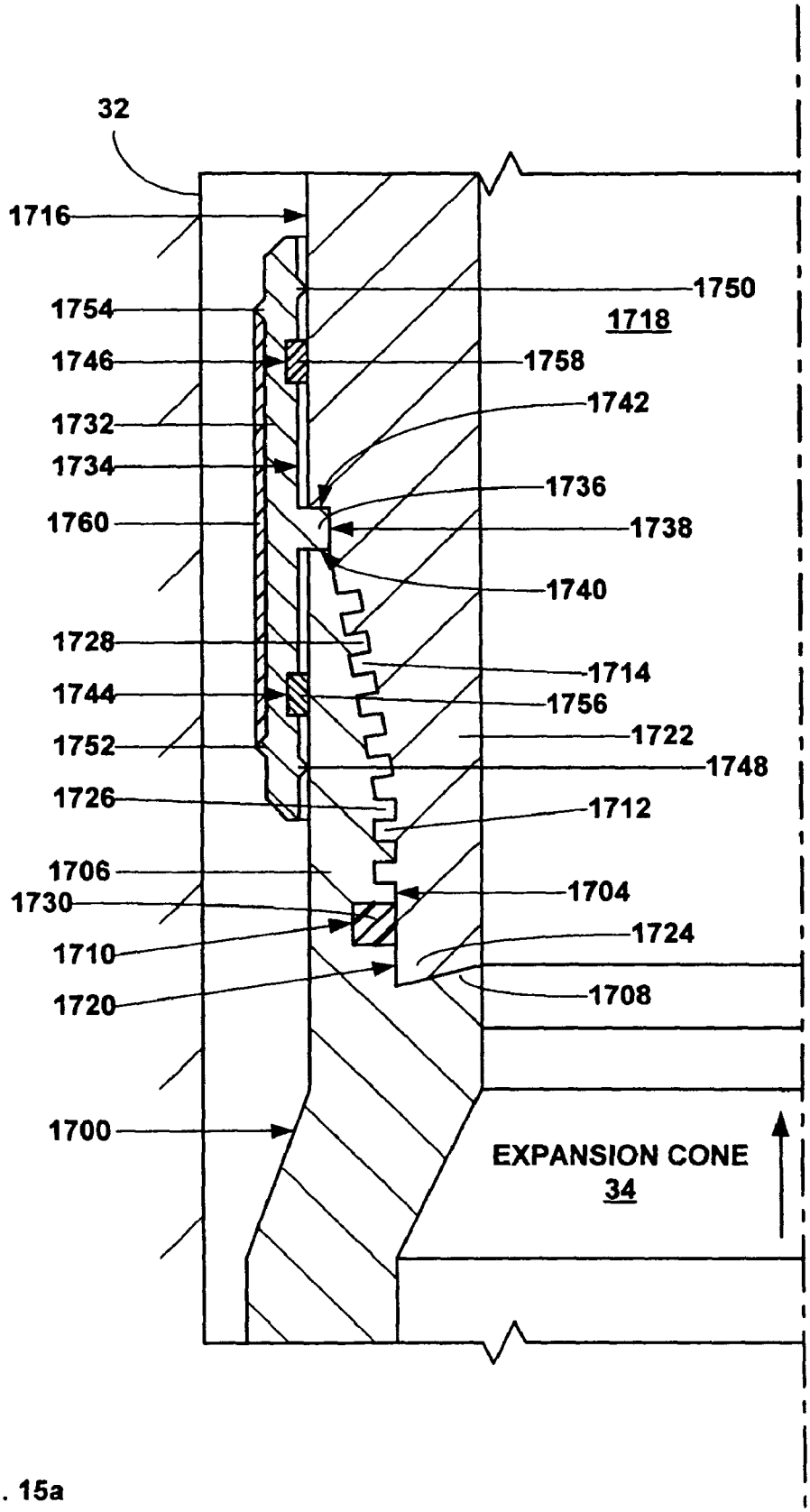
FIG. 15*a* is a fragmentary cross-sectional illustration of the coupling of an internally threaded end portion of a first tubular member to an externally threaded end portion of a second tubular member including a protective sleeve coupled to the end portions of the first and second tubular member.
Figure 15B:
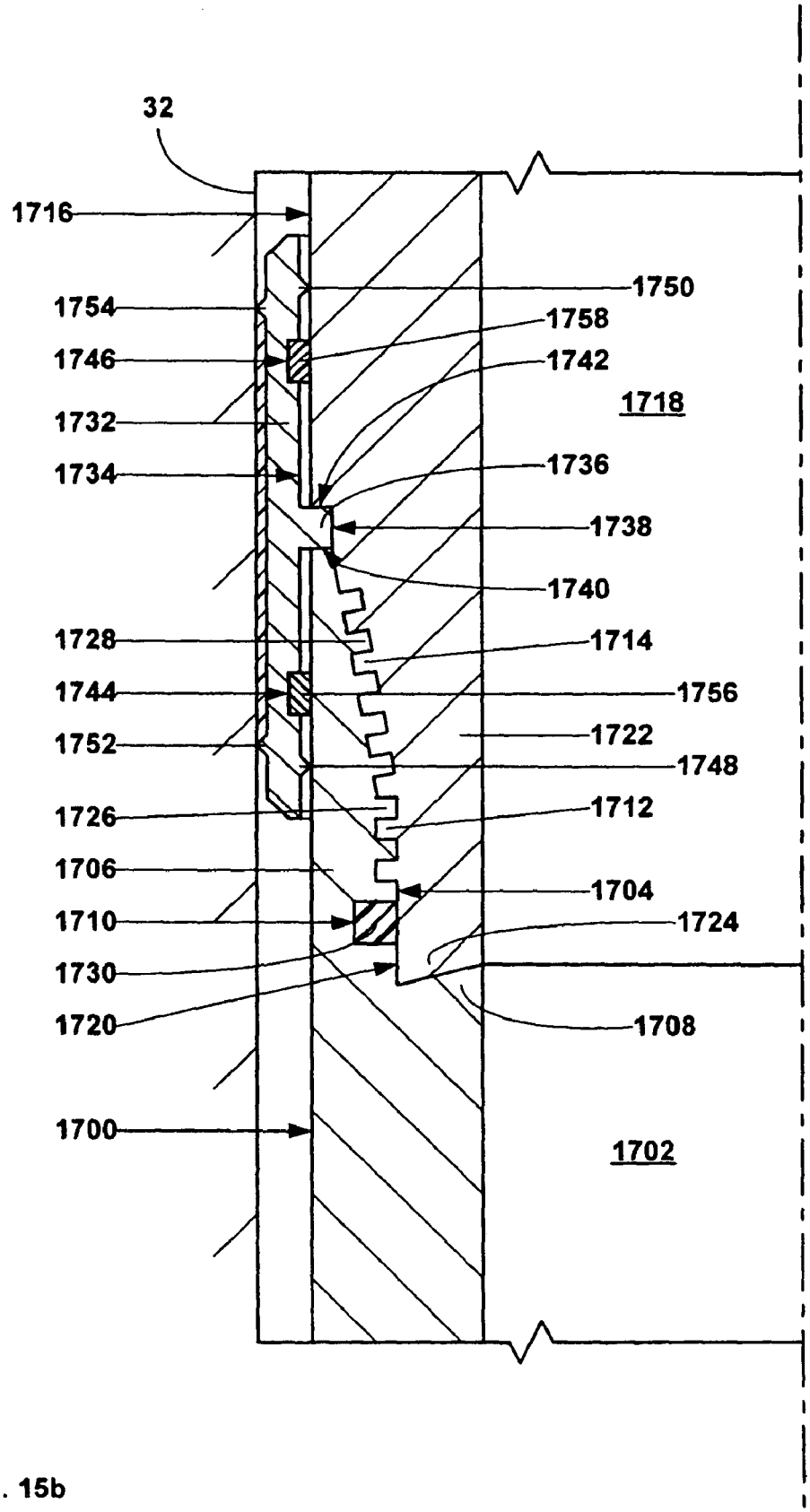
FIG. 15*b* is a cross-sectional illustration of the first and second tubular members and the protective sleeve following the radial expansion of the first and second tubulars and the protective sleeve.

Referring to FIG. 15*a*, a first tubular member 1700 defines a passage 1702 and a counterbore 1704 at an end portion 1706. The counterbore 1704 includes a tapered shoulder 1708, an annular recess 1710, non-tapered internal threads, 1712, and tapered internal threads 1714. A second tubular member 1716 that defines a passage 1718 includes a recessed portion 1720 at an end portion 1722 that includes a tapered end portion 1724 that is adapted to mate with the tapered shoulder 1708 of the counterbore 1704 of the first tubular member 1700, non-tapered external threads 1726 adapted to mate with the non-tapered internal threads 1712 of the counterbore of the first tubular member, and tapered external threads 1728 adapted to mate with the tapered internal threads 1714 of the counterbore of the first tubular member. A sealing ring 1730 is received within the annular recess 1710 of the counterbore 1704 of the of the first tubular member 1700 for fluidicly sealing the interface between the counterbore of the first tubular member and the recessed portion 1720 of the second tubular member 1716. In an exemplary embodiment, the threads, 1712, 1714, 1726, and 1728, are left-handed threads in order to prevent de-coupling of the first and second tubular members, 1700 and 1716, during placement of the tubular members within the structure 32. In an exemplary embodiment, the sealing ring 1730 is an elastomeric sealing ring.

A tubular sleeve 1732 that defines a passage 1734 for receiving the end portions, 1706 and 1722, of the first and second tubular members, 1700 and 1716, respectively, includes an internal flange 1736 that mates with and is received within an annular recess 1738 that is defined between an end face 1740 of the end portion of the first tubular member and an end face 1742 of the recessed portion 1720 of the end portion of the second tubular member. In this manner, the tubular sleeve 1732 is coupled to the first and second tubular members, 1700 and 1716. The tubular sleeve 1732 further includes first and second internal annular recesses, 1744 and 1746, internal tapered flanges, 1748 and 1750, and external tapered flanges, 1752 and 1754.

Sealing members, 1756 and 1758, are received within and mate with the internal annular recesses, 1744 and 1746, respectively, of the tubular sleeve 1732 that fluidicly seal the interface between the tubular sleeve and the first and second tubular members, 1700 and 1716, respectively. A sealing member 1760 is coupled to the exterior surface of the tubular sleeve 1732 for fluidicly sealing the interface between the tubular sleeve and the interior surface of the preexisting structure 32 following the radial expansion of the first and second tubular members, 1700 and 1716, and the tubular sleeve using the expansion cone 34. In an exemplary embodiment, the sealing members, 1756 and 1758, may be, for example, elastomeric or non-elastomeric sealing members fabricated from nitrile, viton, or Teflon™ materials. In an exemplary embodiment, the sealing member 1760 is fabricated from an elastomeric material.

In an exemplary embodiment, during the radial expansion and plastic deformation of the first and second tubular members, 1700 and 1716, the tubular sleeve 1732 is also radially expanded and plastically deformed. In an exemplary embodiment, as a result of the radial expansion, the tubular sleeve 1732 may be maintained in circumferential tension and the end portions, 1706 and 1722, of the first and second tubular members, 1700 and 1716, may be maintained in circumferential compression. Furthermore, in an exemplary embodiment, during and following the radial expansion and plastic deformation of the first and second tubular members, 1700 and 1716, respectively: (a) the sealing members, 1756 and 1758, of the tubular sleeve 1732 engage and fluidicly seal the interface between the tubular sleeve and the end portions, 1706 and 1722, of the first and second tubular members, (b) the internal tapered flanges, 1748 and 1750, of the tubular sleeve engage, and couple the tubular sleeve to, the end portions of the first and second tubular members, (c) the external tapered flanges, 1752 and 1754, of the tubular sleeve engage, and couple the tubular sleeve to, the structure 32, and (d) the sealing member 1760 engages and fluidicly seals the interface between the tubular sleeve and the structure.

In several exemplary embodiments, the first and second tubular members, 1700 and 1716, are radially expanded and plastically deformed using the expansion cone 34 in a conventional manner and/or using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; and (32) U.S. provisional patent application Ser. No. 60/346,309, filed on Jan. 7, 2002, the disclosure of which is incorporated herein by reference.

The use of the tubular sleeve 1732 during (a) the threaded coupling of the first tubular member 1700 to the second tubular member 1716, (b) the placement of the first and second tubular members in the structure 32, and (c) the radial expansion and plastic deformation of the first and second tubular members provides a number of significant benefits. For example, the tubular sleeve 1732 protects the exterior surfaces of the end portions, 1706 and 1722, of the first and second tubular members, 1700 and 1716, during handling and insertion of the tubular members within the structure 32. In this manner, damage to the exterior surfaces of the end portions, 1706 and 1722, of the first and second tubular member, 1700 and 1716, are prevented that could result in stress concentrations that could result in a catastrophic failure during subsequent radial expansion operations. Furthermore, the tubular sleeve 1732 provides an alignment guide that facilitates the insertion and threaded coupling of the second tubular member 1716 to the first tubular member 1700. In this manner, misalignment that could result in damage to the threaded connections, 1712, 1714, 1726, and 1728, of the first and second tubular members, 1700 and 1716, may be avoided. In addition, during the relative rotation of the second tubular member with respect to the first tubular member, required during the threaded coupling of the first and second tubular members, the tubular sleeve 1732 provides an indication of to what degree the first and second tubular members are threadably coupled. For example, if the tubular sleeve 1732 can be easily rotated, that would indicate that the first and second tubular members, 1700 and 1716, are not fully threadably coupled and in intimate contact with the internal flange 1736 of the tubular sleeve. Furthermore, the tubular sleeve 1732 may prevent crack propagation during the radial expansion and plastic deformation of the first and second tubular members, 1700 and 1716. In this manner, failure modes such as, for example, longitudinal cracks in the end portions, 1706 and 1722, of the first and second tubular members may be limited in severity or eliminated all together. In addition, after completing the radial expansion and plastic deformation of the first and second tubular members, 1700 and 1716, the tubular sleeve 16 may provide a fluid tight metal-to-metal seal between interior surface of the tubular sleeve and the exterior surfaces of the end portions, 1706 and 1722, of the first and second tubular members. In this manner, fluidic materials are prevented from passing through the threaded connections, 1712, 1714, 1726, and 1728, of the first and second tubular members, 1700 and 1716, into the annulus between the first and second tubular members and the structure 32. Furthermore, because, following the radial expansion and plastic deformation of the first and second tubular members, 1700 and 1716, the tubular sleeve 1732 may be maintained in circumferential tension and the end portions, 1706 and 1722, of the first and second tubular members, 1700 and 1716, may be maintained in circumferential compression, axial loads and/or torque loads may be transmitted through the tubular sleeve.

In an exemplary experimental implementation, following the radial expansion and plastic deformation of the first and second tubular members, 1700 and 1716, and the tubular sleeve 1732, the threads, 1712, 1714, 1726, and 1728, of the end portions, 1706 and 1722, of the first and second tubular members were unexpectedly deformed such that a fluidic seal was unexpectedly formed between and among the threads of the first and second tubular members. In this manner, a fluid tight seal was unexpectedly provided between the first and second tubular member, 1700 and 1716, due to the presence of the tubular sleeve 1732 during the radial expansion and plastic deformation of the end portions, 1706 and 1722, of the first and second tubular members.

In an exemplary embodiment, the rate and degree of radial expansion and plastic deformation of the first and second tubular members, 1700 and 1716, and the tubular sleeve 1732 are adjusted to generate sufficient localized heating to result in amorphous bonding or welding of the threads, 1712, 1714, 1726, and 1728. As a result, the first and second tubular members, 1700 and 1716, may be amorphously bonded resulting a joint between the first and second tubulars that is nearly metallurgically homogeneous.

Figure 15C:
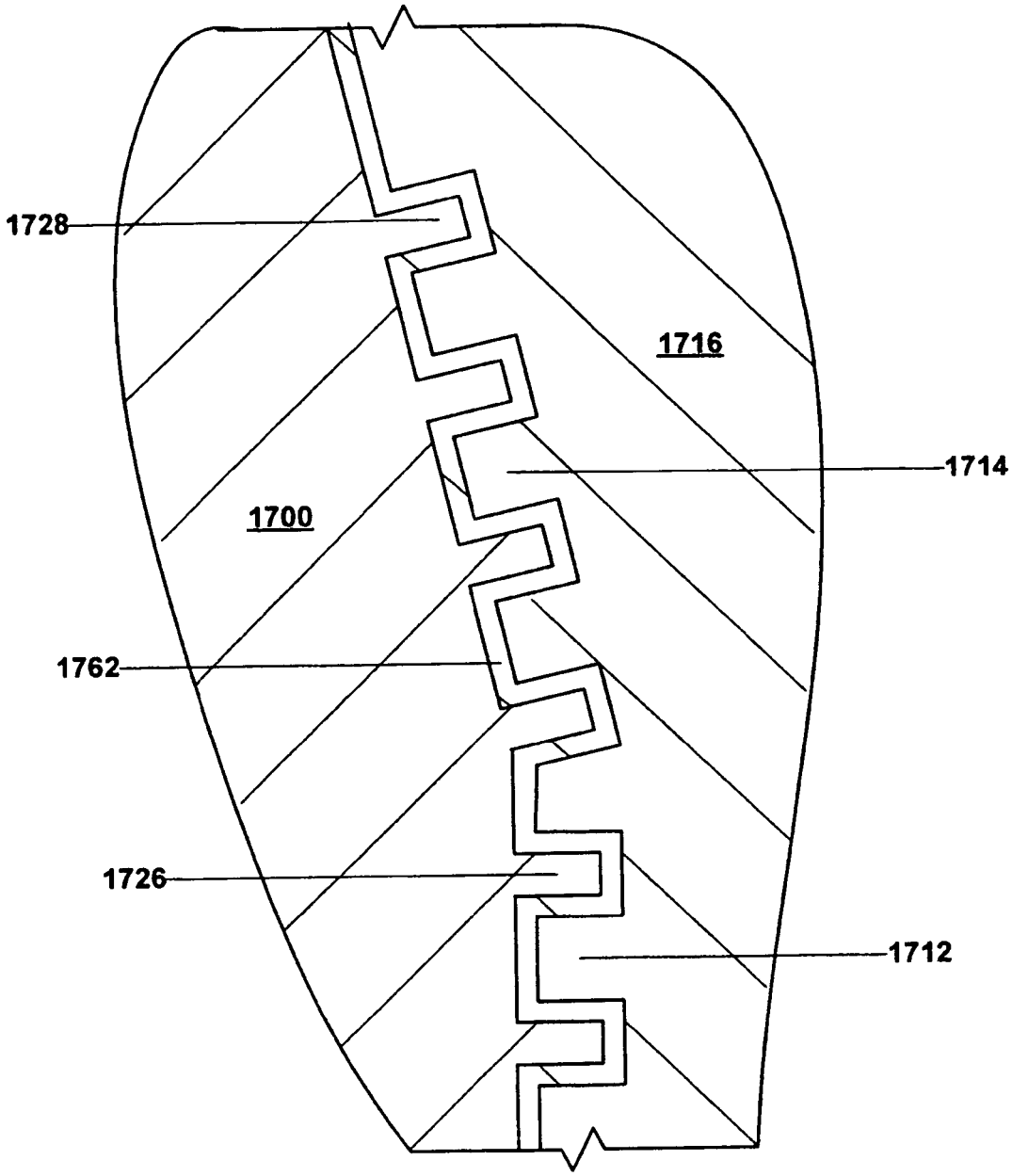
FIG. 15*c* is a fragmentary cross-sectional illustration of an alternative embodiment that includes a metallic foil for amorphously bonding the first and second tubular members of FIGS. 15*a* and 15*b* during the radial expansion and plastic deformation of the tubular members.

In an alternative embodiment, as illustrated in FIG. 15*c*, a metallic foil 1762 of a suitable alloy is placed between and among the threads, 1712, 1714, 1726, and 1728, and during the radial expansion and plastic deformation of the first and second tubular members, 1700 and 1716, and the tubular sleeve 1732, localized heating of the region proximate the threads, 1712, 1714, 1726, and 1728, results in amorphous bonding or a brazing joint of the threads. As a result, the first and second tubular members, 1700 and 1716, may be amorphously bonded resulting a joint between the first and second tubulars that is nearly metallurgically homogeneous.

Figure 16:
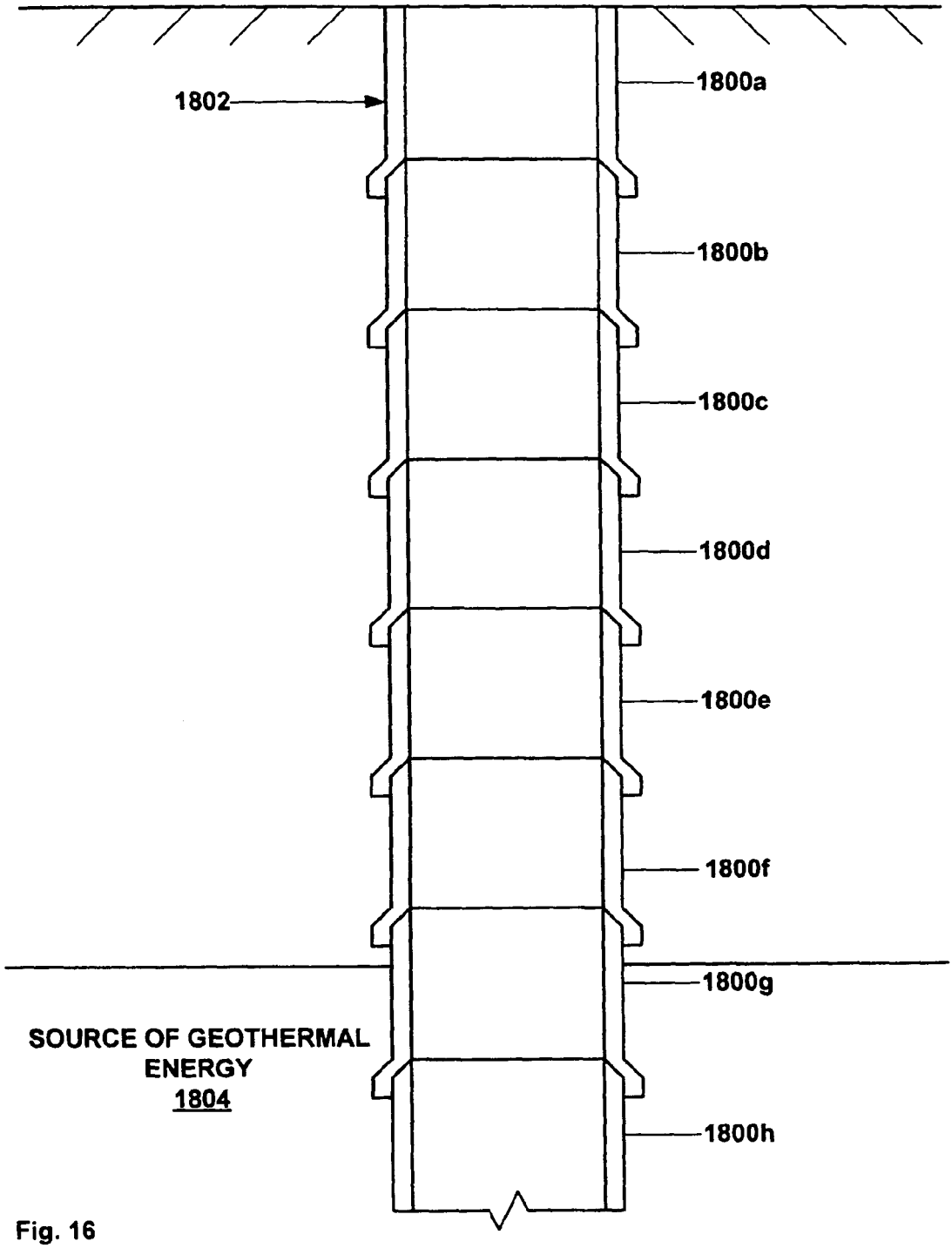
FIG. 16 is a cross-sectional illustration of a borehole including a plurality of overlapping radially expanded wellbore casings that traverses a subterranean source of geothermal energy.

In an exemplary embodiment, as illustrated in FIG. 16, a plurality of overlapping wellbore casing strings 1800*a*-1800*h*, are positioned within a borehole 1802 that traverses a subterranean source 1804 of geothermal energy. In this manner, geothermal energy may then be extracted from the subterranean source 1804 geothermal energy using conventional methods of extraction. In an exemplary embodiment, one or more of the wellbore casing strings 1800 include one or more of the first and second tubular members, 10, 28, 910, 938, 1010, 1036, 1110, 1128, 1210, 1232, 1310, 1328, 1410, 1430, 1510, 1516, 1610, 1632, 1700 and/or 1716, that are threadably coupled end-to-end and include one or more of the tubular sleeves, 16, 110, 210, 310, 410, 510, 610, 710, 810, 918, 1018, 1116, 1216, 1316, 1418, 1512, 1616 and/or 1732.

In an exemplary embodiment, the wellbore casing strings, 1800*a*-1800*h*, are radially expanded and plastically deformed in overlapping fashion within the borehole 1802.

For example, the wellbore casing string 1800*a* is positioned within the borehole 1802 and then radially expanded and plastically deformed. The wellbore casing string 1800*b* is then positioned within the borehole 1802 in overlapping relation to the wellbore casing string 1800*a* and then radially expanded and plastically deformed. In this manner, a mono-diameter wellbore casing may be formed that includes the overlapping wellbore casing strings 1800*a* and 1800*b*. This process may then be repeated for wellbore casing strings 1800*c*-1800*h*. As a result, a mono-diameter wellbore casing may be produced that extends from a surface location to the source 1804 of geothermal energy. In this manner, the geothermal energy from the source 1804 may be efficiently and economically extracted. Furthermore, because the variation in the inside diameter of the wellbore casing strings 1800 is eliminated by the resulting mono-diameter design, the depth of the borehole 1802 may be virtually limitless. As a result, sources of geothermal energy can now be economically extracted from depths of over 50,000 feet.

In several exemplary embodiments, the wellbore casing strings 1800*a*-1800*h* are radially expanded and plastically deformed using the expansion cone 34 using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No.

60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001, (23) U.S. provisional patent application Ser. No. 60/262,434, filed on Jan. 17, 2001, (24) U.S. provisional patent application Ser. No. 60/259,486, filed on Jan. 3, 2001, (25) U.S. provisional patent application Ser. No. 60/303,740, filed on Jul. 6, 2001, (26) U.S. provisional patent application Ser. No. 60/313,453, filed on Aug. 20, 2001, (27) U.S. provisional patent application Ser. No. 60/317,985, filed on Sep. 6, 2001, (28) U.S. provisional patent application Ser. No. 60/318,386, filed on Sep. 10, 2001, (29) U.S. utility patent application Ser. No. 09/969,922, filed on Oct. 3, 2001, (30) U.S. utility patent application Ser. No. 10/016,467, filed on Dec. 10, 2001; (31) U.S. provisional patent application Ser. No. 60/343,674, filed on Dec. 27, 2001; and (32) U.S. provisional patent application Ser. No. 60/346,309, filed on Jan. 7, 2002, the disclosures of which are incorporated herein by reference.

A method of radially expanding and plastically deforming a first tubular member and a second tubular member has been described that includes inserting an end of the first tubular member into an end of a tubular sleeve having an internal flange into abutment with the internal flange, inserting an end of the second tubular member into another end of the tubular sleeve, threadably coupling the ends of the first and second tubular member within the tubular sleeve until both ends of the first and second tubular members abut the internal flange of the tubular sleeve, and displacing an expansion cone through the interiors of the first and second tubular members. In an exemplary embodiment, the internal flange of the tubular sleeve is positioned between the ends of the tubular sleeve. In an exemplary embodiment, the internal flange of the tubular sleeve is positioned at one end of the tubular sleeve. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure comprises a wellbore. In an exemplary embodiment, the other structure comprises a wellbore casing. In an exemplary embodiment, the tubular sleeve further comprises a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages.

A method of radially expanding and plastically deforming a first tubular member and a second tubular member has also been described that includes inserting an end of the first tubular member into an end of a tubular sleeve, coupling the end of the tubular sleeve to the end of the first tubular member, inserting an end of the second tubular member into another end of the tubular sleeve, threadably coupling the ends of the first and second tubular member within the tubular sleeve, coupling the other end of the tubular sleeve to the end of the second tubular member, and displacing an expansion cone through the interiors of the first and second tubular members. In an exemplary embodiment, coupling the ends of the tubular sleeve to the ends of the first and second tubular members includes coupling the ends of the tubular sleeve to the ends of the first and second tubular members using locking rings. In an exemplary embodiment, coupling the ends of the tubular sleeve to the ends of the first and second tubular members using locking rings includes wedging the locking rings between the ends of the tubular sleeve and the ends of the first and second tubular members. In an exemplary embodiment, coupling the ends of the tubular sleeve to the ends of the first and second tubular members using locking rings includes affixing the locking rings to the ends of the first and second tubular members. In an exemplary embodiment, the locking rings are resilient. In an exemplary embodiment, the locking rings are elastomeric. In an exemplary embodiment, coupling the ends of the tubular sleeve to the ends of the first and second tubular members includes crimping the ends of the tubular sleeve onto the ends of the first and second tubular members. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure is a wellbore. In an exemplary embodiment, the other structure is a wellbore casing. In an exemplary embodiment, the tubular sleeve further includes a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages.

A method of radially expanding and plastically deforming a first tubular member and a second tubular member has also been described that includes inserting an end of a tubular sleeve having an external flange into an end of the first tubular member until the external flange abuts the end of the first tubular member, inserting the other end of the tubular sleeve into an end of a second tubular member, threadably coupling the ends of the first and second tubular member within the tubular sleeve until both ends of the first and second tubular members abut the external flange of the tubular sleeve, and displacing an expansion cone through the interiors of the first and second tubular members. In an exemplary embodiment, the external flange of the tubular sleeve is positioned between the ends of the tubular sleeve. In an exemplary embodiment, the external flange of the tubular sleeve is positioned at one end of the tubular sleeve. In an exemplary embodiment, the tubular sleeve further includes one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the other structure comprises a wellbore. In an exemplary embodiment, the other structure comprises a wellbore casing. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages.

A method of radially expanding and plastically deforming a first tubular member and a second tubular member has also been described that includes inserting an end of the first tubular member into an end of a tubular sleeve having an internal flange into abutment with the internal flange, inserting an end of the second tubular member into another end of the tubular sleeve into abutment with the internal flange, coupling the ends of the first and second tubular member to the tubular sleeve, and displacing an expansion cone through the interiors of the first and second tubular members. In an exemplary embodiment, the internal flange of the tubular sleeve is positioned between the ends of the tubular sleeve. In an exemplary embodiment, the internal flange of the tubular sleeve is positioned at one end of the tubular sleeve. In an exemplary embodiment, the tubular sleeve further comprises one or more sealing members for sealing the interface between the tubular sleeve and at least one of the tubular members. In an exemplary embodiment, the method further includes placing the tubular members in another structure, and displacing the expansion cone through the interiors of the first and second tubular members. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure is a wellbore. In an exemplary embodiment, the other structure is a wellbore casing. In an exemplary embodiment, the tubular sleeve further includes a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages. In an exemplary embodiment, coupling the ends of the first and second tubular member to the tubular sleeve includes heating the tubular sleeve and inserting the ends of the first and second tubular members into the tubular sleeve. In an exemplary embodiment, coupling the ends of the first and second tubular member to the tubular sleeve includes coupling the tubular sleeve to the ends of the first and second tubular members using a locking ring.

A method has been described that includes coupling an end of a first tubular member to an end of a tubular sleeve, coupling an end of a second tubular member to another end of the tubular sleeve, threadably coupling the ends of the first and second tubular members, and radially expanding and plastically deforming the first tubular member and the second tubular member. In an exemplary embodiment, the tubular sleeve includes an internal flange. In an exemplary embodiment, coupling the end of the first tubular member to the end of the tubular sleeve includes inserting the end of the first tubular member into the end of the tubular sleeve into abutment with the internal flange. In an exemplary embodiment, coupling the end of the second tubular member to the other end of the tubular sleeve includes inserting the end of the second tubular member into the other end of the tubular sleeve into abutment with the internal flange. In an exemplary embodiment, coupling the end of the second tubular member to the other end of the tubular sleeve includes inserting the end of the second tubular member into the other end of the tubular sleeve into abutment with the internal flange. In an exemplary embodiment, the tubular sleeve includes an external flange. In an exemplary embodiment, coupling the end of the first tubular member to the end of the tubular sleeve includes inserting the end of the tubular sleeve into the end of the first tubular member until the end of the first tubular member abuts the external flange. In an exemplary embodiment, coupling the end of the second tubular member to the other end of the tubular sleeve includes inserting the other end of the tubular sleeve into the end of the second tubular member until the end of the second tubular member abuts the external flange. In an exemplary embodiment, coupling the end of the second tubular member to the other end of the tubular sleeve includes inserting the other end of the tubular sleeve into the end of the second tubular member until the end of the second tubular member abuts the external flange. In an exemplary embodiment, coupling the end of the first tubular member to the end of the tubular sleeve includes inserting a retaining ring between the end of the first tubular member and the end of the tubular sleeve. In an exemplary embodiment, coupling the end of the second tubular member to the other end of the tubular sleeve includes inserting another retaining ring between the end of the second tubular member and the other end of the tubular sleeve. In an exemplary embodiment, coupling the end of the second tubular member to the other end of the tubular sleeve includes inserting a retaining ring between the end of the first tubular member and the other end of the tubular sleeve. In an exemplary embodiment, the retaining ring is resilient. In an exemplary embodiment, the retaining ring and the other retaining ring are resilient. In an exemplary embodiment, the retaining ring is resilient. In an exemplary embodiment, coupling the end of the first tubular member to the end of the tubular sleeve includes deforming the end of the tubular sleeve. In an exemplary embodiment, coupling the end of the second tubular member to the other end of the tubular sleeve includes deforming the other end of the tubular sleeve. In an exemplary embodiment, coupling the end of the second tubular member to the other end of the tubular sleeve includes deforming the other end of the tubular sleeve. In an exemplary embodiment, coupling the end of the first tubular member to the end of the tubular sleeve includes coupling a retaining ring to the end of the first tubular member. In an exemplary embodiment, coupling the end of the second tubular member to the other end of the tubular sleeve includes coupling another retaining ring to the end of the second tubular member. In an exemplary embodiment, coupling the end of the second tubular member to the other end of the tubular sleeve includes coupling a retaining ring to the end of the second tubular member. In an exemplary embodiment, the retaining ring is resilient. In an exemplary embodiment, the retaining ring and the other retaining ring are resilient. In an exemplary embodiment, the retaining ring is resilient. In an exemplary embodiment, coupling the end of the first tubular member to the end of the tubular sleeve includes heating the end of the tubular sleeve, and inserting the end of the first tubular member into the end of the tubular sleeve. In an exemplary embodiment, coupling the end of the second tubular member to the other end of the tubular sleeve includes heating the other end of the tubular sleeve, and inserting the end of the second tubular member into the other end of the tubular sleeve. In an exemplary embodiment, coupling the end of the second tubular member to the other end of the tubular sleeve includes heating the other end of the tubular sleeve, and inserting the end of the second tubular member into the other end of the tubular sleeve. In an exemplary embodiment, coupling the end of the first tubular member to the end of the tubular sleeve includes inserting the end of the first tubular member into the end of the tubular sleeve, and latching the end of the first tubular member to the end of the tubular sleeve. In an exemplary embodiment, coupling the end of the second tubular member to the other end of the tubular sleeve includes inserting the end of the second tubular member into the end of the tubular sleeve, and latching the end of the second tubular member to the other end of the tubular sleeve. In an exemplary embodiment, coupling the end of the second tubular member to the other end of the tubular sleeve includes inserting the end of the second tubular member into the end of the tubular sleeve, and latching the end of the second tubular member to the other end of the tubular sleeve. In an exemplary embodiment, the tubular sleeve further comprises one or more sealing members for sealing the interface between the tubular sleeve and at least one of the tubular members. In an exemplary embodiment, the method further includes placing the tubular members in another structure, and then radially expanding and plastically deforming the first tubular member and the second tubular member. In an exemplary embodiment, the method further includes radially expanding the tubular sleeve into engagement with the structure. In an exemplary embodiment, the method further includes sealing an annulus between the tubular sleeve and the other structure. In an exemplary embodiment, the other structure is a wellbore. In an exemplary embodiment, the other structure is a wellbore casing. In an exemplary embodiment, the tubular sleeve further includes a sealing element coupled to the exterior of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the method further includes breaking the tubular sleeve. In an exemplary embodiment, the tubular sleeve includes one or more longitudinal slots. In an exemplary embodiment, the tubular sleeve includes one or more radial passages. In an exemplary embodiment, radially expanding and plastically deforming the first tubular member, the second tubular member, and the tubular sleeve includes displacing an expansion cone within and relative to the first and second tubular members. In an exemplary embodiment, radially expanding and plastically deforming the first tubular member, the second tubular member, and the tubular sleeve includes applying radial pressure to the interior surfaces of the first and second tubular member using a rotating member. In an exemplary embodiment, the method further includes amorphously bonding the first and second tubular members during the radial expansion and plastic deformation of the first and second tubular members. In an exemplary embodiment, the method further includes welding the first and second tubular members during the radial expansion and plastic deformation of the first and second tubular members. In an exemplary embodiment, the method further includes providing a fluid tight seal within the threaded coupling between the first and second tubular members during the radial expansion and plastic deformation of the first and second tubular members. In an exemplary embodiment, the method further includes placing the tubular sleeve in circumferential tension, placing the end of the first tubular member in circumferential compression, and placing the end of the second tubular member in circumferential compression. In an exemplary embodiment, the method further includes placing the tubular sleeve in circumferential compression, placing the end of the first tubular member in circumferential tension, and placing the end of the second tubular member in circumferential tension.

A method has been described that includes providing a tubular sleeve including an internal flange positioned between the ends of the tubular sleeve, inserting an end of a first tubular member into an end of the tubular sleeve into abutment with the internal flange, inserting an end of a second tubular member into another end of the tubular sleeve into abutment the internal flange, threadably coupling the ends of the first and second tubular members, radially expanding and plastically deforming the first tubular member and the second tubular member, placing the tubular sleeve in circumferential tension, placing the end of the first tubular member in circumferential compression, and placing the end of the second tubular member in circumferential compression.

A method has been described that includes providing a tubular sleeve including an external flange positioned between the ends of the tubular sleeve, inserting an end of the tubular sleeve into an end of a first tubular member until the end of the first tubular member abuts with the external flange, inserting another end of the tubular sleeve into an end of the second tubular member until the end of the second tubular member abuts the external flange, threadably coupling the ends of the first and second tubular members, radially expanding and plastically deforming the first tubular member and the second tubular member, placing the tubular sleeve in circumferential compression, placing the end of the first tubular member in circumferential tension, and placing the end of the second tubular member in circumferential tension.

An apparatus has been described that includes a tubular sleeve, a first tubular member coupled to an end of the tubular sleeve comprising internal threads at an end portion, and a second tubular member coupled to another end of the tubular sleeve comprising external threads at an end portion that engage the internal threads of the end portion of the first tubular member. In an exemplary embodiment, the tubular sleeve is in circumferential tension, the end portion of the first tubular member is in circumferential compression, and the end portion of the second tubular member is in circumferential compression. In an exemplary embodiment, the tubular sleeve is in circumferential compression, the end portion of the first tubular member is in circumferential tension, and the end portion of the second tubular member is in circumferential tension. In an exemplary embodiment, the tubular sleeve includes an internal flange. In an exemplary embodiment, the end portion of the first tubular member is received within an end of the tubular sleeve, and the end portion of the second tubular member is received within another end of the tubular sleeve. In an exemplary embodiment, the end portions of the first and second tubular members abut the internal flange of the tubular sleeve. In an exemplary embodiment, the end portion of the first tubular member is received within an end of the tubular sleeve. In an exemplary embodiment, the end portions of the first and second tubular members abut the internal flange of the tubular sleeve. In an exemplary embodiment, the end portion of the second tubular member is received within an end of the tubular sleeve. In an exemplary embodiment, the end portions of the first and second tubular members abut the internal flange of the tubular sleeve. In an exemplary embodiment, the internal flange of the tubular sleeve is positioned between the ends of the tubular sleeve. In an exemplary embodiment, the internal flange of the tubular sleeve is positioned at an end of the tubular sleeve. In an exemplary embodiment, the tubular sleeve includes an external flange. In an exemplary embodiment, an end portion of the tubular sleeve is received within the first tubular member; and another end portion of the tubular sleeve is received within the end portion of the second tubular member. In an exemplary embodiment, the end portions of the first and second tubular members abut the external flange of the tubular sleeve. In an exemplary embodiment, an end portion of the tubular sleeve is received within the end portion of the first tubular member. In an exemplary embodiment, the end portions of the first and second tubular members abut the external flange of the tubular sleeve. In an exemplary embodiment, an end portion of the tubular sleeve is received within the end portion of the second tubular member. In an exemplary embodiment, the end portions of the first and second tubular members abut the external flange of the tubular sleeve. In an exemplary embodiment, the external flange of the tubular sleeve is positioned between the ends of the tubular sleeve. In an exemplary embodiment, the external flange of the tubular sleeve is positioned at an end of the tubular sleeve. In an exemplary embodiment, the tubular sleeve further comprises one or more sealing members for sealing the interface between the tubular sleeve and at least one of the tubular members. In an exemplary embodiment, the apparatus further includes a retaining ring positioned between the end of the first tubular member and the end of the tubular sleeve. In an exemplary embodiment, the apparatus further includes another retaining ring positioned between the end of the second tubular member and the other end of the tubular sleeve. In an exemplary embodiment, the apparatus further includes a retaining ring positioned between the end of the first tubular member and the other end of the tubular sleeve. In an exemplary embodiment, the retaining ring is resilient. In an exemplary embodiment, the retaining ring and the other retaining ring are resilient. In an exemplary embodiment, the retaining ring is resilient. In an exemplary embodiment, the end of the tubular sleeve is deformed onto the end of the first tubular member. In an exemplary embodiment, the other end of the tubular sleeve is deformed onto the end of the second tubular member. In an exemplary embodiment, the other end of the tubular sleeve is deformed onto the end of the second tubular member. In an exemplary embodiment, the apparatus further includes a retaining ring coupled to the end of the first tubular member for retaining the tubular sleeve onto the end of the first tubular member. In an exemplary embodiment, the apparatus further includes another retaining ring coupled to the end of the second tubular member for retaining the other end of the tubular sleeve onto the end of the second tubular member. In an exemplary embodiment, the apparatus further includes a retaining ring coupled to the end of the second tubular member for retaining the other end of the tubular sleeve onto the end of the second tubular member. In an exemplary embodiment, the retaining ring is resilient. In an exemplary embodiment, the retaining ring and the other retaining ring are resilient. In an exemplary embodiment, the retaining ring is resilient. In an exemplary embodiment, the apparatus further includes a locking ring for coupling the end of the first tubular member to the end of the tubular sleeve. In an exemplary embodiment, the apparatus further includes another locking ring for coupling the end of the second tubular member to the other end of the tubular sleeve. In an exemplary embodiment, the apparatus further includes a locking ring for coupling the end of the second tubular member to the other end of the tubular sleeve. In an exemplary embodiment, the apparatus further includes a structure for receiving the first and second tubular members and the tubular sleeve, and the tubular sleeve contacts the interior surface of the structure. In an exemplary embodiment, the tubular sleeve further includes a sealing member for fluidicly sealing the interface between the tubular sleeve and the structure. In an exemplary embodiment, the other structure is a wellbore. In an exemplary embodiment, the other structure is a wellbore casing. In an exemplary embodiment, the tubular sleeve further includes a sealing element coupled to the exterior surface of the tubular sleeve. In an exemplary embodiment, the tubular sleeve is metallic. In an exemplary embodiment, the tubular sleeve is non-metallic. In an exemplary embodiment, the tubular sleeve is plastic. In an exemplary embodiment, the tubular sleeve is ceramic. In an exemplary embodiment, the tubular sleeve is frangible. In an exemplary embodiment, the tubular sleeve includes one or more longitudinal slots. In an exemplary embodiment, the tubular sleeve includes one or more radial passages. In an exemplary embodiment, the first and second tubular members are amorphously bonded. In an exemplary embodiment, the first and second tubular members are welded. In an exemplary embodiment, the internal threads of the first tubular member and the internal threads of the second tubular member together provide a fluid tight seal.

An apparatus has been described that includes a tubular sleeve including an internal flange positioned between the ends of the tubular sleeve, a first tubular member received within an end of the tubular sleeve in abutment with the internal flange that comprises internal threads, and a second tubular member received within another end of the tubular sleeve in abutment with the internal flange that comprises external threads that engage the internal threads of the first tubular member. The tubular sleeve is in circumferential tension, the end of first tubular member is in circumferential compression, and the end of the second tubular member is in circumferential compression.

An apparatus has been described that includes a tubular sleeve comprising an external flange positioned between the ends of the tubular sleeve, a first tubular member that receives an end of the tubular sleeve and abuts the external flange that comprises internal threads, and a second tubular member that receives another end of the tubular sleeve that abuts the external flange that comprises external threads that engage the internal threads of the first tubular member. The tubular sleeve is in circumferential compression, the first tubular member is in circumferential tension, and the second tubular member is in circumferential tension.

A method of extracting geothermal energy from a subterranean source of geothermal energy has been described that includes drilling a borehole that traverses the subterranean source of geothermal energy, positioning a first casing string within the borehole, radially expanding and plastically deforming the first casing string within the borehole, positioning a second casing string within the borehole that traverses the subterranean source of geothermal energy, overlapping a portion of the second casing string with a portion of the first casing string, radially expanding and plastically deforming the second casing string within the borehole, and extracting geothermal energy from the subterranean source of geothermal energy using the first and second casing strings. In an exemplary embodiment, the interior diameter of a passage defined by the first and second casing strings is constant. In an exemplary embodiment, at least one of the first and second casing strings includes a tubular sleeve, a first tubular member coupled to an end of the tubular sleeve comprising internal threads at an end portion, and a second tubular member coupled to another end of the tubular sleeve comprising external threads at an end portion that engage the internal threads of the end portion of the first tubular member.

A method of extracting geothermal energy from a subterranean source of geothermal energy has been described that includes drilling a borehole that traverses the subterranean source of geothermal energy, positioning a first casing string within the borehole, radially expanding and plastically deforming the first casing string within the borehole, positioning a second casing string within the borehole that traverses the subterranean source of geothermal energy, overlapping a portion of the second casing string with a portion of the first casing string, radially expanding and plastically deforming the second casing string within the borehole, and extracting geothermal energy from the subterranean source of geothermal energy using the first and second casing strings. the interior diameter of a passage defined by the first and second casing strings is constant, and at least one of the first and second casing strings includes a tubular sleeve comprising an internal flange positioned between the ends of the tubular sleeve, a first tubular member received within an end of the tubular sleeve in abutment with the internal flange that comprises internal threads, and a second tubular member received within another end of the tubular sleeve in abutment with the internal flange that comprises external threads that engage the internal threads of the first tubular member.

A method of extracting geothermal energy from a subterranean source of geothermal energy has been described that includes drilling a borehole that traverses the subterranean source of geothermal energy, positioning a first casing string within the borehole, radially expanding and plastically deforming the first casing string within the borehole, positioning a second casing string within the borehole that traverses the subterranean source of geothermal energy, overlapping a portion of the second casing string with a portion of the first casing string, radially expanding and plastically deforming the second casing string within the borehole, and extracting geothermal energy from the subterranean source of geothermal energy using the first and second casing strings. The interior diameter of a passage defined by the first and second casing strings is constant, and at least one of the first and second casing strings include: a tubular sleeve comprising an external flange positioned between the ends of the tubular sleeve, a first tubular member that receives an end of the tubular sleeve that abuts external flange that comprises internal threads, and a second tubular member that receives another end of the tubular sleeve that abuts the external flange that comprises external threads that engage the internal threads of the first tubular member.

An apparatus for extracting geothermal energy from a subterranean source of geothermal energy has been described that includes a borehole that traverses the subterranean source of geothermal energy, a first casing string positioned within the borehole, and a second casing positioned within the borehole that overlaps with the first casing string that traverses the subterranean source of geothermal energy. The first casing string and the second casing string are radially expanded and plastically deformed within the borehole. In an exemplary embodiment, the interior diameter of a passage defined by the first and second casing strings is constant. In an exemplary embodiment, at least one of the first and second casing strings include a tubular sleeve, a first tubular member coupled to an end of the tubular sleeve comprising internal threads at an end portion, and a second tubular member coupled to another end of the tubular sleeve comprising external threads at an end portion that engage the internal threads of the end portion of the first tubular member.

An apparatus for extracting geothermal energy from a subterranean source of geothermal energy has been described that includes a borehole that traverses the subterranean source of geothermal energy, a first casing string positioned within the borehole, a second casing string within the borehole that traverses the subterranean source of geothermal energy that overlaps with the first casing string. The first and second casing strings are radially expanded and plastically deformed within the borehole, the inside diameter of a passage defined by the first and second casing strings is constant, and at least one of the first and second casing strings includes a tubular sleeve comprising an internal flange positioned between the ends of the tubular sleeve, a first tubular member received within an end of the tubular sleeve in abutment with the internal flange that comprises internal threads, and a second tubular member received within another end of the tubular sleeve in abutment with the internal flange that comprises external threads that engage the internal threads of the first tubular member.

An apparatus for extracting geothermal energy from a subterranean source of geothermal energy has been described a borehole that traverses the subterranean source of geothermal energy, a first casing string positioned within the borehole, and a second casing string positioned within the borehole that traverses the subterranean source of geothermal energy that overlaps with the first casing string. The interior diameter of a passage defined by the first and second casing strings is constant, and wherein at least one of the first and second casing strings include: a tubular sleeve comprising an external flange positioned between the ends of the tubular sleeve, a first tubular member that receives an end of the tubular sleeve that abuts external flange that comprises internal threads, and a second tubular member that receives another end of the tubular sleeve that abuts the external flange that comprises external threads that engage the internal threads of the first tubular member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. An apparatus, comprising:

a tubular sleeve comprising an internal flange positioned between the ends of the tubular sleeve;

a first tubular member received within an end of the tubular sleeve in abutment with the internal flange, the first tubular member comprising internal threads; and a second tubular member received within another end of the tubular sleeve in abutment with the internal flange, the second tubular member comprising external threads that engage the internal threads of the first tubular member;

wherein the tubular sleeve and the first and second tubular members are radially expanded and plastically deformed placing:

the tubular sleeve in circumferential tension;

the end of first tubular member in circumferential compression; and the end of the second tubular member in circumferential compression.

2. A method of radially expanding and plastically deforming a first tubular member and a second tubular member, comprising:

coupling an end of the first tubular member with an end of a metallic tubular sleeve using a first coupling member engaged with an outer surface of the end of the first tubular member and an end surface of the metallic tubular sleeve;

coupling an end of the second tubular member with another end of the metallic tubular sleeve using a second coupling member engaged with an outer surface of the end of the second tubular member and another end surface of the metallic tubular sleeve;

threadably coupling the ends of the first and second tubular members;

placing the tubular members within a wellbore; and displacing an expansion device through the interiors of the first and second tubular members to radially expand and plastically deform portions of the first and second tubular members.

3. The method of claim 2, wherein the ends of the first and second tubular members are received within the ends of the tubular sleeve.

4. The method of claim 2, wherein the ends of the first and second tubular members receive the ends of the tubular sleeve.

5. The method of claim 2, wherein, before, during, and after the radial expansion of the portions of the first and second tubular members, a fluid tight seal is provided by the interface between the tubular sleeve and the ends of the first and second tubular members.

6. A method of radially expanding and plastically deforming a first tubular member and a second tubular member, comprising:

coupling an end of the first tubular member with an end of an aperture-free tubular sleeve;

coupling an end of the second tubular member with another end of the aperture-free tubular sleeve; and displacing an expansion device through the interiors of the first and second tubular members to radially expand and plastically deform portions of the first and second tubular members;

wherein, before, during, and after the radial expansion of the portions of the first and second tubular members, a fluid tight seal is provided by the interface between the aperture-free tubular sleeve and the ends of the first and second tubular members.

7. The method of claim 6, wherein the ends of the first and second tubular members are received within the ends of the tubular sleeve.

8. The method of claim 6, wherein the ends of the first and second tubular members receive the ends of the tubular sleeve.

9. The method of claim 6, further comprising:

placing the tubular members within a wellbore prior to displacing the expansion device through the interiors of the first and second tubular members to radially expand and plastically deform the portions of the first and second tubular members.

10. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve and the end portions of the first and second tubular members are radially expanded and plastically deformed placing:

the tubular sleeve in circumferential tension;

the end portion of the first tubular member in circumferential compression; and the end portion of the second tubular member in circumferential compression.

11. The apparatus of claim 10, wherein the tubular sleeve is non-metallic.

12. The apparatus of claim 10, wherein the tubular sleeve is plastic.

13. The apparatus of claim 10, wherein the tubular sleeve is ceramic.

14. The apparatus of claim 10, wherein the tubular sleeve is frangible.

15. The apparatus of claim 10 wherein the tubular sleeve is non-metallic.

16. The apparatus of claim 10 wherein the tubular sleeve is plastic.

17. The apparatus of claim 10 wherein the tubular sleeve is ceramic.

18. The apparatus of claim 10 wherein the tubular sleeve comprises one or more longitudinal slots.

19. The apparatus of claim 10 wherein the tubular sleeve comprises one or more radial passages.

20. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve and the end portions of the first and second tubular members are radially expanded and plastically deformed placing:

the tubular sleeve in circumferential compression;

the end portion of the first tubular member in circumferential tension; and the end portion of the second tubular member in circumferential tension.

21. The apparatus of claim 20 wherein:

the tubular sleeve comprises an external flange positioned between the ends of the tubular sleeve;

the first tubular member receives the end of the tubular sleeve and abuts the external flange; and the second tubular member receives the another end of the tubular sleeve and abuts the external flange.

22. The apparatus of claim 20 wherein the tubular sleeve comprises an external flange.

23. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve comprises an internal flange;

wherein the coupled tubular sleeve and first and second tubular members include a radially expanded and plastically deformed position.

24. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve further comprises one or more sealing members for sealing the interface between the tubular sleeve and at least one of the tubular members;

wherein the coupled tubular sleeve and first and second tubular members include a radially expanded and plastically deformed position.

25. An apparatus, comprising:

a tubular sleeve;

a first tubular member coupled to an end of the tubular sleeve, the first tubular member comprising internal threads at an end portion;

a second tubular member coupled to another end of the tubular sleeve, the second tubular member comprising external threads at an end portion that engage the internal threads of the end portion of the first tubular member; and a structure for receiving the first and second tubular members and the tubular sleeve;

wherein the coupled tubular sleeve and first and second tubular members include a radially expanded and plastically deformed position wherein the tubular sleeve contacts the interior surface of the structure.

26. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve further comprises a sealing element coupled to the exterior surface of the tubular sleeve;

wherein the coupled tubular sleeve and first and second tubular members include a radially expanded and plastically deformed position.

27. An apparatus comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve is metallic;

wherein the coupled tubular sleeve and first and second tubular members include a radially expanded and plastically deformed position.

28. The apparatus of claim 27 further comprising:

a coupling member engaged between an outer end surface of one of the ends of the tubular sleeve and an outer surface of one of the first and second tubular members.

29. The apparatus of claim 28, wherein the tubular sleeve is in circumferential tension;

wherein the end portion of the first tubular member is in circumferential compression; and wherein the end portion of the second tubular member is in circumferential compression.

30. The apparatus of claim 28, wherein the tubular sleeve is in circumferential compression;

wherein the end portion of the first tubular member is in circumferential tension; and wherein the end portion of the second tubular member is in circumferential tension.

31. The apparatus of claim 28, wherein the tubular sleeve comprises an internal flange.

32. The apparatus of claim 31, wherein the end portion of the first tubular member is received within the end of the tubular sleeve; and wherein the end portion of the second tubular member is received within the other end of the tubular sleeve.

33. The apparatus of claim 32, wherein the end portions of the first and second tubular members abut the internal flange of the tubular sleeve.

34. The apparatus of claim 31, wherein the end portion of the first tubular member is received within the end of the tubular sleeve.

35. The apparatus of claim 34, wherein the end portions of the first and second tubular members abut the internal flange of the tubular sleeve.

36. The apparatus of claim 31, wherein the end portion of the second tubular member is received within the other end of the tubular sleeve.

37. The apparatus of claim 36, wherein the end portions of the first and second tubular members abut the internal flange of the tubular sleeve.

38. The apparatus of claim 31, wherein the internal flange of the tubular sleeve is positioned between the ends of the tubular sleeve.

39. The apparatus of claim 31, wherein the internal flange of the tubular sleeve is positioned at an end of the tubular sleeve.

40. The apparatus of claim 28, wherein the tubular sleeve comprises an external flange.

41. The apparatus of claim 40, wherein an end portion of the tubular sleeve is received within the first tubular member; and wherein another end portion of the tubular sleeve is received within the end portion of the second tubular member.

42. The apparatus of claim 41, wherein the end portions of the first and second tubular members abut the external flange of the tubular sleeve.

43. The apparatus of claim 40, wherein an end portion of the tubular sleeve is received within the end portion of the first tubular member.

44. The apparatus of claim 43, wherein the end portions of the first and second tubular members abut the external flange of the tubular sleeve.

45. The apparatus of claim 40, wherein an end portion of the tubular sleeve is received within the end portion of the second tubular member.

46. The apparatus of claim 45, wherein the end portions of the first and second tubular members abut the external flange of the tubular sleeve.

47. The apparatus of claim 40, wherein the external flange of the tubular sleeve is positioned between the ends of the tubular sleeve.

48. The apparatus of claim 40, wherein the external flange of the tubular sleeve is positioned at an end of the tubular sleeve.

49. The apparatus of claim 28, wherein the tubular sleeve further comprises one or more sealing members for sealing the interface between the tubular sleeve and at least one of the tubular members.

50. The apparatus of claim 28, wherein:

the coupling member comprises a retaining ring positioned between the end of the first tubular member and the end of the tubular sleeve.

51. The apparatus of claim 50, further comprising:

another retaining ring positioned between the end of the second tubular member and the other end of the tubular sleeve.

52. The apparatus of claim 51, wherein the retaining ring and the other retaining ring are resilient.

53. The apparatus of claim 50, wherein the retaining ring is resilient.

54. The apparatus of claim 28, wherein:

the coupling member comprises a retaining ring positioned between the end of the first tubular member and the other end of the tubular sleeve.

55. The apparatus of claim 54, wherein the retaining ring is resilient.

56. The apparatus of claim 28, wherein the end of the tubular sleeve is deformed onto the end of the first tubular member.

57. The apparatus of claim 56, wherein the other end of the tubular sleeve is deformed onto the end of the second tubular member.

58. The apparatus of claim 28, wherein the other end of the tubular sleeve is deformed onto the end of the second tubular member.

59. The apparatus of claim 28, wherein:

the coupling member comprises a retaining ring coupled to the end of the first tubular member for retaining the tubular sleeve onto the end of the first tubular member.

60. The apparatus of claim 59, further comprising:

another retaining ring coupled to the end of the second tubular member for retaining the other end of the tubular sleeve onto the end of the second tubular member.

61. The apparatus of claim 60, wherein the retaining ring and the other retaining ring are resilient.

62. The apparatus of claim 59, wherein the retaining ring is resilient.

63. The apparatus of claim 28, wherein:

the coupling member comprises a retaining ring coupled to the end of the second tubular member for retaining the other end of the tubular sleeve onto the end of the second tubular member.

64. The apparatus of claim 63, wherein the retaining ring is resilient.

65. The apparatus of claim 28, wherein:

the coupling member comprises a locking ring for coupling the end of the first tubular member to the end of the tubular sleeve.

66. The apparatus of claim 65, further comprising:

another locking ring for coupling the end of the second tubular member to the other end of the tubular sleeve.

67. The apparatus of claim 28, wherein:

the coupling member comprises a locking ring for coupling the end of the second tubular member to the other end of the tubular sleeve.

68. The apparatus of claim 28, further comprising:

a structure for receiving the first and second tubular members and the tubular sleeve;

wherein the tubular sleeve contacts the interior surface of the structure.

69. The apparatus of claim 68, wherein the tubular sleeve further comprises:

a sealing member for fluidicly sealing the interface between the tubular sleeve and the structure.

70. The apparatus of claim 68, wherein the other structure comprises a wellbore.

71. The apparatus of claim 68, wherein the other structure comprises a wellbore casing.

72. The apparatus of claim 28, wherein the tubular sleeve further comprises a sealing element coupled to the exterior surface of the tubular sleeve.

73. The apparatus of claim 28, wherein the tubular sleeve comprises one or more longitudinal slots.

74. The apparatus of claim 28, wherein the tubular sleeve comprises one or more radial passages.

75. The apparatus of claim 28, wherein the first and second tubular members are amorphously bonded.

76. The apparatus of claim 28, wherein the first and second tubular members are welded.

77. The apparatus of claim 28, wherein the internal threads of the first tubular member and the external threads of the second tubular member together provide a fluid tight seal.

78. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the tubular sleeve is frangible;

wherein the coupled tubular sleeve and first and second tubular members include a radially expanded and plastically deformed position.

79. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the coupled tubular sleeve and first and second tubular members include a radially expanded and plastically deformed position wherein the first and second tubular members are amorphously bonded.

80. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the coupled tubular sleeve and first and second tubular members include a radially expanded and plastically deformed position wherein the first and second tubular members are welded.

81. An apparatus, comprising:

a tubular sleeve;

a first tubular member coupled to an end of the tubular sleeve, the first tubular member comprising internal threads at an end portion; and a second tubular member coupled to another end of the tubular sleeve, the second tubular member comprising external threads at an end portion that engage the internal threads of the end portion of the first tubular member;

wherein the coupled tubular sleeve and first and second tubular members include a radially expanded and plastically deformed position;

wherein the internal threads of the first tubular member and the external threads of the second tubular member together provide a fluid tight seal.

82. A method of radially expanding and plastically deforming a first tubular member and a second tubular member, comprising:

inserting a threaded end portion of the first tubular member into an end of a tubular sleeve having an internal flange;

inserting a threaded end portion of the second tubular member into another end of the tubular sleeve;

threadably coupling the threaded end portions of the first and second tubular members within the tubular sleeve;

placing the tubular members in another structure; and then, displacing an expansion device through the interiors of the first and second tubular members to radially expand and plastically deform portions of the first and second tubular members;

wherein the internal diameters of the radially expanded and plastically deformed portions of the first and second tubular members are equal.

83. The method of claim 82, further comprising:

radially expanding the tubular sleeve into engagement with the structure.

84. The method of claim 82, further comprising:

sealing an annulus between the tubular sleeve and the other structure.

85. The method of claim 82, wherein the tubular sleeve further comprises a sealing element coupled to the exterior of the tubular sleeve.

86. A method of radially expanding and plastically deforming a first tubular member and a second tubular member, comprising:

inserting a threaded end portion of the first tubular member into an end of a tubular sleeve;

coupling the end of the tubular sleeve to the threaded end portion of the first tubular member;

inserting a threaded end portion of the second tubular member into another end of the tubular sleeve;

threadably coupling the threaded end portions of the first and second tubular members within the tubular sleeve;

coupling the other end of the tubular sleeve to the threaded end portion of the second tubular member; and displacing an expansion device through the interiors of the first and second tubular members to radially expand and plastically deform portions of the first and second tubular members;

wherein the internal diameters of the radially expanded and plastically deformed portions of first and second tubular members are equal.

87. The method of claim 86, further comprising:

placing the tubular members in another structure prior to displacing the expansion device through the interiors of the first and second tubular members.

88. The method of claim 87, further comprising:

radially expanding the tubular sleeve into engagement with the structure.

89. The method of claim 87, further comprising:

sealing an annulus between the tubular sleeve and the structure.

90. The method of claim 86, wherein the tubular sleeve further comprises a sealing element coupled to the exterior of the tubular sleeve.

91. An apparatus, comprising:

a first expandable tubular member coupled with an end of an aperture-free tubular sleeve;

a second expandable tubular member coupled with another end of the aperture-free tubular sleeve; and an expansion device axially displaceable through the interiors of the first and second tubular members to radially expand and plastically deform portions of the first and second tubular members;

wherein, before, during, and after the radial expansion of the portions of the first and second tubular members, a fluid tight seal is provided by the interface between the aperture-free tubular sleeve and the first and second tubular members.

92. The apparatus of claim 91, wherein the first and second tubular members are received within the ends of the tubular sleeve.

93. The apparatus of claim 91, wherein the first and second tubular members receive the ends of the tubular sleeve.

94. The apparatus of claim 91, further comprising a wellbore receiving the first and second tubular members.

95. The apparatus of claim 27 further comprising:

a retaining ring positioned between the end of the first tubular member and the end of the tubular sleeve.

96. The apparatus of claim 27 further comprising:

a retaining ring positioned between the end of the first tubular member and the another end of the tubular sleeve.

97. The apparatus of claim 27 wherein the end of the tubular sleeve is deformed onto the end of the first tubular member.

98. The apparatus of claim 27 wherein the another end of the tubular sleeve is deformed onto the end of the second tubular member.

99. The apparatus of claim 27 further comprising:

a retaining ring coupled to the end of the first tubular member for retaining the tubular sleeve onto the end of the first tubular member.

100. The apparatus of claim 27 further comprising:

a retaining ring coupled to the end of the second tubular member for retaining the another end of the tubular sleeve onto the end of the second tubular member.

101. The apparatus of claim 27 further comprising:

a locking ring for coupling the end of the first tubular member to the end of the tubular sleeve.

102. The apparatus of claim 27 further comprising:

a locking ring for coupling the end of the second tubular member to the another end of the tubular sleeve.

* * * * *